US006537740B1

(12) United States Patent
Omae et al.

(10) Patent No.: US 6,537,740 B1
(45) Date of Patent: Mar. 25, 2003

(54) SILVER HALIDE COLOR PHOTOGRAPHIC LIGHTSENSITIVE MATERIAL

(75) Inventors: Norihiro Omae, Minami-Ashigara (JP); Shunichi Aida, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/662,495

(22) Filed: Sep. 15, 2000

(30) Foreign Application Priority Data

Sep. 16, 1999 (JP) ..... 11-262187
May 31, 2000 (JP) ..... 2000-163294

(51) Int. Cl.[7] ..... G03C 1/46

(52) U.S. Cl. ..... 430/506; 430/567; 430/955; 430/599; 430/603

(58) Field of Search ..... 430/502, 503, 430/506, 557, 599, 603, 955, 567

(56) References Cited

U.S. PATENT DOCUMENTS 4,952,485 A * 8/1990 Shibahara et al. ..... 430/506
5,091,293 A 2/1992 Nozawa et al.
5,382,501 A * 1/1995 Inoie ..... 430/506

* cited by examiner

*Primary Examiner*—Geraldine Letscher
(74) *Attorney, Agent, or Firm*—Birch, Stewart, Kolasch & Birch, LLP

(57) ABSTRACT

A silver halide color negative photographic lightsentive material comprises at least one red-sensitive silver halide emulsion layer, at least one green-sensitive silver halide emulsion layer and at least one blue-sensitive silver halide emulsion layer on a support. The lightsensitive material has an ISO speed of 640 or more, the total silver content of 3.0 to 9.0 g/m$^2$. Each of the red-sensitive emulsion layer, green-sensitive emulsion layer and blue-sensitive emulsion layer comprises two or more silver halide emulsion sub-layers having the same color sensitivity but different in speed to each other, and each of the red-sensitive sub-layer having the highest speed, green-sensitive sub-layer having the highest speed and blue-sensitive emulsion sub-layer having the highest speed has a silver content of 0.3 to 1.3 g/m$^2$. At least two sub-layers selected from the red-sensitive sub-layer having the highest sensitivity, green-sensitive sub-layer having the highest sensitivity and blue-sensitive sub-layer having the highest speed contain silver halide grains in which tabular silver halide grains occupy 50% or more of the total projected area of all the silver halide grains in the sub-layer, and the tabular grains have an average aspect ratio of 8 or more.

12 Claims, No Drawings

SILVER HALIDE COLOR PHOTOGRAPHIC LIGHTSENSITIVE MATERIAL

CROSS-REFERENCE TO RELATED APPLICATIONS

This application is based upon and claims the benefit of priority from the prior Japanese Patent Applications No. 11-262187, filed Sep. 16, 1999; and No. 2000-163294, filed May 31, 2000, the entire contents of which are incorporated herein by reference.

BACKGROUND OF THE INVENTION

The present invention relates to a high-speed color negative photographic lightsensitive material. The present invention also relates to a lightsensitive material-built-in photographic product with which an exposure mechanism is provided and a high-speed color negative photographic lightsensitive material is built therein. More particularly, the present invention relates to a high-speed color photographic lightsensitive material, especially for photographing, which is highly sensitive and ensures excellent image quality and high color reproduction saturation and which is improved with respect to the fog increase, sensitivity lowering and graininess deterioration experienced with the passage of time during the period from lightsensitive material production to use. The present invention also relates to a lightsensitive material-built-in photographic product with which an exposure mechanism is provided and into which the above color negative photographic lightsensitive material is built.

High-speed lightsensitive materials are in succession put on the market in accordance with the progress of the technology on lightsensitive materials for photography. Expansion of photographing zone by the increase of the sensitivity of lightsensitive material, such as photographing in dark indoor scenes without the use of strobe or photographing of high shutter speed with the use of a telephotographic lens in, for example, sport photographing, is being realized.

A lightsensitive material-built-in photographic product (what is called a lens equipped film) to which an exposure mechanism is provided and into which a color negative photographic lightsensitive material is built, is widely used due to convenience thereof. However, in order to supply it at a low price, the shutter speed and the aperture thereof are often fixed, and even if the product is provided with strobe, its function is often limited. In order to compensate these problems, many of the built-in color negative photographic lightsensitive materials are high-sensitive color negative films.

For attaining the sensitivity increase of lightsensitive material, conventional means in the art to which the present invention pertains is to prepare a high-speed lightsensitive material by combining the method of increasing the size of silver halide emulsion grains with other technology. The increase of the size of silver halide emulsion grains, although enhancing the sensitivity to a certain extent, inevitably leads to a serious drawback such that, as long as the content of silver halide is fixed, the number of silver halide emulsion grains, accordingly the number of development centers, is reduced to thereby cause an extensive graininess deterioration.

With respect to the high-speed color negative lightsensitive material, designs increasing the content of silver halide emulsion grains, namely the silver coating amount, so far as properties such as desilvering at bleach-fix are permitted, have been implemented in order to increase, even if slightly, the number of development centers simultaneously with the increase of the size of silver halide emulsion grains.

However, it is disclosed in Jpn. Pat. Appln. KOKAI Publication No. (hereinafter referred to as JP-A-) 63-226650 that the thus produced lightsensitive material of high speed and high image quality has the following drawback.

That is, the drawback is that there occur deteriorations of photographic performance, such as a fog increase, sensitivity lowering and graininess deterioration, during the period from lightsensitive material production to use. The main cause of these photographic performance deteriorations is the exposure of lightsensitive silver halide emulsion grains to natural radiation, such as γ-rays or cosmic rays, emitted from, for example, building materials and the ground. It is known that the performance of lightsensitive material is deteriorated by X-rays and other high-energy radiation. However, with respect to the high-speed color negative lightsensitive material of 640 or more in ISO speed, it has been found that the performance deterioration even by extremely weak radiation occurring in nature is unexpectedly intense. Countermeasure to this performance deterioration would be provided by the method of cutting radiation with the use of a material whose radiation absorption coefficient is high, such as lead, in a package or storage shed for lightsensitive material, as described in, for example, Research Disclosure No. 25610 (August, 1985). However, the object of completely implementing this method cannot be attained unless a heavy metal such as lead is used in a considerable thickness, so that easy and low price supply to general consumers is almost impossible. JP-A-63-226650 discloses the technology of coping with the performance deterioration due to natural radiation by reducing the total silver content, or silver content of high-speed layers, in the color negative lightsensitive material. However, the invention of JP-A-63-226650 does not suggest any concrete countermeasures to the above problem that the increase of the size of silver halide emulsion grains in order to attain a sensitivity enhancement inevitably leads to a serious drawback such that, as long as the content of silver halide is fixed, the number of silver halide emulsion grains, accordingly the number of development centers, is reduced to thereby cause an extensive graininess deterioration.

Apart from the above, it is known that a technology for bettering the graininess of high-speed lightsensitive material is provided by employing silver halide grains whose aspect ratio has been increased, as disclosed in, for example, U.S. Pat. No. 4,434,226.

As a result of the inventors' investigations, it has been found that the invention of employing silver halide grains with high aspect ratio, although being effective in reconciling high sensitivity and graininess, brings about the phenomenon such that, when silver halide grains with an aspect ratio of 8 or more are employed in the color negative lightsensitive material, the development inhibitor released from a DIR coupler is excessively trapped because of the large surface area thereof as compared with that of conventional silver halide grains to thereby suppress the exertion of an interlayer effect. It has further been found that, as a consequence, there occurs an extreme lowering of color reproduction saturation, which is a serious problem to the color negative lightsensitive material.

From the viewpoint that the silver coating amount of high-speed emulsion layer is increased for bettering the graininess and that, the greater the size of grains used in the high-speed emulsion layer, the greater the increase of surface area by rendering the aspect ratio 8 or more, the inventors have also found that the above problem of lowering of color reproduction saturation is more serious when grains with an aspect ratio of 8 or more are employed in the high-speed emulsion layer.

Furthermore, in recent years, it has been recognized that using a selenium sensitizer in combination with a gold sensitizer and a sulfur sensitizer is preferable for increasing the sensitivity of silver halide emulsion. As a result of the inventors' investigations, it has been revealed that the use of this technology enables reducing the size of silver halide grains required for realizing identical sensitivity to thereby relieve the suffering of the effect of environmental radiation and that, however, the problem of lowering of color reproduction saturation is still simultaneously brought about thereby.

The above lowering of color reproduction saturation can be compensated for by using a DIR coupler in a large amount. However, this not only causes a cost increase but also leads to excess release of a development inhibitor from the DIR coupler at the time of development of the emulsion of medium-speed and low-speed emulsion layers to thereby invite a sensitivity decrease with the result that there occurs the problem that the total silver coating amount of the lightsensitive material must be large.

Therefore, it is utterly impossible to produce a high-speed color negative lightsensitive material which is excellent with respect to all of the improvement to performance deterioration by environmental radiation, the enhancement of graininess immediately after coating operation and the enhancement of color reproduction saturation with the use of conventional technology.

It has been widely known that incorporation, into a photographic lightsensitive material, of a compound capable of releasing bleach accelerator through a reaction with an aromatic primary amine color developing agent in an oxidized form can accelerate desilvering during development processing. However, effects attained by the use of the compound in a color negative photographic lightsensitive material on a sensitivity change and on a graininess change, especially on the graininess change due to exposure to environmental radiation when the compound is incorporated in a high-sensitive color negative photographic lightsensitive material, have been little known before the present inventors have found.

Knowledge of doping a metal ion dopant thereby to practically performing formation of an electron-trapping zone in a silver halide grain, can be referred to, for example, Japanese Patent Application KOKAI Publication No. (hereinafter referred to as JP-A-) 2-20854 and JP-A-7-72569. However, effects attained by the use of tabular silver halide grains having the electron-trapping zone in a high-speed layer of a high-sensitive color negative photographic lightsensitive material on the changes of photographic properties due to exposure to environmental radiation, especially the effects attained when the content of silver in the lightsensitive material is varied, have been little known before the present inventors have found.

BRIEF SUMMARY OF THE INVENTION

One of the object of the present invention is to provide a high-speed color negative photographic lightsensitive material which is highly sensitive and ensures excellent graininess and high color reproduction saturation and which minimizes the fog increase, sensitivity decrease and graininess deterioration, caused by the exposure to environmental radiation, during the storage after production.

The other object of the present invention is to provide a lightsensitive material-built-in photographic product into which the above high-speed color negative photographic lightsensitive material is built and to which an exposure mechanism is provided.

The inventors have found, as a result of extensive and intensive efforts, that the task of the present invention can be attained by the following means.

(Embodiment 1)

A silver halide color negative photographic lightsentive material comprising at least one red-sensitive silver halide emulsion layer, at least one green-sensitive silver halide emulsion layer and at least one blue-sensitive silver halide emulsion layer on a support, wherein the lightsensitive material has an ISO speed of 640 or more;

the lightsensitive material has the total silver content of 3.0 to 9.0 g/m$^2$;

each of the red-sensitive emulsion layer, green-sensitive emulsion layer and blue-sensitive emulsion layer comprises two or more silver halide emulsion sub-layers having the same color sensitivity but different in speed to each other;

each of the red-sensitive emulsion sub-layer, green-sensitive emulsion sub-layer and blue-sensitive emulsion sub-layer each having the highest speed has a silver content of 0.3 to 1.3 g/m$^2$;

at least two of the red-sensitive emulsion sub-layer, green-sensitive emulsion sub-layer and blue-sensitive emulsion sub-layer each having the highest speed contain silver halide grains in which tabular silver halide grains occupy 50% or more of the total projected area of all the silver halide grains in the sub-layer; and the tabular grains have an average aspect ratio of 8 or more.

(Embodiment 2)

The lightsensitive material recited in embodiment 1, wherein each of the red-sensitive emulsion sub-layer, green-sensitive emulsion sub-layer and blue-sensitive emulsion sub-layer each having the highest speed has a silver content of 0.3 to 1.2 g/m$^2$.

(Embodiment 3)

The lightsensitive material recited in embodiment 1 or 2, wherein at least one of the emulsion sub-layers comprising tabular grains in an amount of 50% or more of the total projected area contains a selenium sensitizer in an mount of $2\times10^{-6}$ to $5\times10^{-6}$ mol per mol of the silver in the emulsion sub-layer.

(Embodiment 4)

A silver halide color negative photographic lightsentive material comprising at least one red-sensitive silver halide emulsion layer, at least one green-sensitive silver halide emulsion layer and at least one blue-sensitive silver halide emulsion layer on a support, wherein the lightsensitive material has an ISO speed of 640 or more;

the lightsensitive material has the total silver content of 3.0 to 9.0 g/m$^2$;

each of the red-sensitive emulsion layer, green-sensitive emulsion layer and blue-sensitive emulsion layer comprises two or more silver halide emulsion sub-layers having the same color sensitivity but different in speed to each other;

the sum of a silver content in the red-sensitive emulsion sub-layer, green-sensitive emulsion sub-layer and blue-sensitive emulsion sub-layer each having the highest speed is 1.5 to 3.5 g/m$^2$;

at least two of the red-sensitive emulsion sub-layer, green-sensitive emulsion sub-layer and blue-sensitive emulsion sub-layer each having the highest speed contain silver halide grains in which tabular silver halide grains occupy 50% or more of the total projected area of all the silver halide grains in the sub-layer; and the tabular grains have an average aspect ratio of 8 or more.

(Embodiment 5)

The lightsensitive material recited in embodiment 4, wherein the sum of a silver content in the red-sensitive emulsion sub-layer, green-sensitive emulsion sub-layer and blue-sensitive emulsion sub-layer each having the highest speed is 1.5 to 3.0 g/m$^2$.

(Embodiment 6)

The lightsensitive material recited in embodiment 4 or 5, wherein at least one of the emulsion sub-layers comprising tabular grains in an amount of 50% or more of the total projected area contains a selenium sensitizer in an mount of $2\times10^{-6}$ to $5\times10^{-6}$ mol per mol of the silver in the emulsion sub-layer.

(Embodiment 7)

The lightsensitive material recited in any one of embodiments 1 to 6, wherein at least one of the emulsion sub-layers contains a compound capable of releasing a bleach accelerator through a reaction with an aromatic primary amine color developing agent in an oxidized form.

(Embodiment 8)

The lightsensitive material recited in any one of embodiments 1 to 7, wherein at least one of emulsions containing the silver halide tabular grains whose average aspect ratio is 8 or more contained in the at least two of the emulsion sublayers each having the highest sensitivity, contains tabular grains each having an electron-trapping zone.

(Embodiment 9)

A lightsensitive material-built-in photographic product in which a color photographic lightsensitive material is built and to which an exposure mechanism is provided, wherein the built-in light sensitive material is the light sensitive material recited in any one of embodiments 1 to 8.

DETAILED DESCRIPTION OF THE INVENTION

The present invention will be described in detail below.

It is known for long that the photographic sensitivity to γ-rays and X-rays is increased by increasing the amount of applied silver halide emulsion grains. This is described in, for example, "The Photographic Action of Ionizing Radiation" written by R. H. Herz and published by Viley-Interscience in 1969. However, as aforementioned, when the silver content is increased over a certain level, the high-speed color photographic lightsensitive material suffers from exposure due to what is known as natural radiation, such as extremely weak γ-rays occurring in our living environment, during a practical storage period. As a result, the high-speed color photographic lightsensitive material suffers from performance deterioration, such as a fog increase and a graininess degradation, which performance deterioration has been serious beyond expectation.

The color negative photographic lightsensitive material of the present invention (hereinafter also referred to simply as "color photographic lightsensitive material" or "lightsensitive material") is one of 640 or more in ISO speed comprising a support and, superimposed thereon, a red-sensitive silver halide emulsion layer, a green-sensitive silver halide emulsion layer and a blue-sensitive silver halide emulsion layer, each of these silver halide emulsion layers comprising a plurality of silver halide emulsion sub-layers whose speeds are different from each other.

In the field of color photographic lightsensitive material, for obtaining a color photographic lightsensitive material of high image quality, it is common practice to adopt a design such that, when emulsion layers with identical color sensitivity are composed of a plurality of emulsion sub-layers whose speeds are different from each other, high-speed emulsion sub-layers have high silver contents in order to utilize what is known as a graininess vanishing effect. However, in the high-speed color photographic lightsensitive material of 640 or more in ISO speed, the increase of the silver content of high-speed emulsion sub-layer aggravates the performance deterioration with the passage of time after storage as compared with the increase of the silver content of low-speed emulsion sub-layer. Therefore, lowering the silver content of the highest-speed emulsion sub-layer among emulsion sub-layers with identical color sensitivity favorably enables suppressing to a practically non-problematical level the performance deterioration of high-speed color photographic lightsensitive material after storage attributed to the influence of natural radiation.

In one embodiment of the present invention, the lightsensitive material of the invention comprises a red-sensitive emulsion unit layer comprising two or more sub-layers having different speeds to each other, a green-sensitive emulsion unit layer comprising two or more sub-layers having different speeds to each other, and a blue-sensitive emulsion unit layer having different speeds to each other. Each of the red-sensitive sub-layer having the highest-speed, the green-sensitive sub-layer having the highest-speed, and the blue-sensitive sub-layer having the highest-speed has a silver content of 0.3 g/m$^2$ to 1.3 g/m$^2$, preferably 0.3 g/m$^2$ to 1.2 g/m$^2$.

In another embodiment of the present invention, the sum of the silver content in the highest-speed red-sensitive sub-layer, the highest-speed green-sensitive sub-layer and the highest-speed blue-sensitive sub-layer of the color photographic lightsensitive material of the present invention is in the range of 1.5 g/m$^2$ to 3.5 g/m$^2$, preferably 1.5 g/m$^2$ to 3.0 g/m$^2$.

The total silver content of the color photographic lightsensitive material of the present invention is in the range of 3.0 g/m$^2$ to 9.0 g/m$^2$, preferably 3.0 g/m$^2$ to 8.0 g/m$^2$.

The terminology "silver content" used herein means the total amount, in terms of silver, of contained silvers such as silver halides and metallic silver. Some methods are known for analyzing the silver content of lightsensitive material. Although any of the methods can be employed, for example, the elemental analysis using fluorescent X-ray technique is easy to apply.

The ISO speed of the color photographic lightsensitive material of the present invention is 640 or more, preferably 800 or more.

The emulsions which can be employed in the lightsensitive material of the present invention relate to those of tabular grains of silver iodobromide or silver chloroiodobromide.

The tabular silver halide grains for use in the present invention are silver halide grains of tabular form each having two or more mutually parallel twin faces.

With respect to the tabular silver halide grains (hereinafter also simply referred to as "tabular grains"), the terminology "aspect ratio" means the ratio of diameter to thickness of the silver halide. That is, it is a quotient of the diameter divided by the thickness of each individual silver halide grain. The terminology "diameter" used herein refers to the diameter of a circle having an area equal to the projected area of grain as obtained when observing silver halide grains through a microscope or an electron microscope.

The color photographic lightsensitive material of the present invention comprises a support and, superimposed thereon, a red-sensitive silver halide emulsion layer, a green-sensitive silver halide emulsion layer and a blue-sensitive silver halide emulsion layer, each of these silver halide emulsion layers comprising a plurality of silver halide emulsion sub-layers whose speeds are different from each other, wherein 50% or more of a total projected area of silver halide grains contained in at least two of the highest-speed emulsion sub-layers consists of tabular silver halide grains, the tabular silver halide grains having an average aspect ratio of 8 or more, preferably 10 or more, and more preferably 12 or more. Preferably, the upper limit of the aspect ratio is 50. Among the highest-speed emulsion sub-layers of red-sensitive, green-sensitive and blue-sensitive, the at least two sub-layers are preferably, green-sensitive and blue-sensitive sub-layers.

In the present invention, the fog by natural radiation has successfully been suppressed by lowering the silver content of high-speed sub-layers. Further, the graininess deterioration, irrespective of the lowering of the silver content of high-speed sub-layers, has successfully been prevented by using tabular grains of high aspect ratio, such as those of 8 or more average aspect ratio, in the high-speed sub-layers. Still further, the problem of less interlayer effect attributed to the use of tabular grains of high aspect ratio has successfully been resolved by lowering the silver content of high-speed sub-layers containing tabular grains of high aspect ratio.

In the present invention, the terminology "average aspect ratio" means an average of the aspect ratios of all the tabular grains of the emulsion.

The method of taking a transmission electron micrograph by the replica technique and measuring the equivalent circular diameter and thickness of each individual grain can be mentioned as an example of aspect ratio determining method. In the mentioned method, the thickness is calculated from the length of replica shadow.

The configuration of tabular grains used in the present invention is generally hexagonal. The terminology "hexagonal configuration" means that the shape of the principal plane of tabular grains is hexagonal, the neighboring side ratio (maximum side length/minimum side length) thereof being 2 or less. The neighboring side ratio is preferably 1.6 or less, more preferably 1.2 or less. That the lower limit thereof is 1.0 is needless to mention. In the grains of high aspect ratio, especially, triangular tabular grains are increased in the tabular grains. The triangular tabular grains are produced when the Ostwald ripening has excessively been advanced. From the viewpoint of obtaining substantially hexagonal tabular grains, it is preferred that the period of this ripening be minimized. For this purpose, it is requisite to endeavor to raise the tabular grain ratio by nucleation. It is preferred that one or both of an aqueous silver ion solution and an aqueous bromide ion solution contain gelatin for the purpose of raising the probability of occurrence of hexagonal tabular grains at the time of adding silver ions and bromide ions to a reaction mixture according to the double jet technique, as described in JP-A-63-11928 by Saito.

The hexagonal tabular grains for use in the present invention are formed through the steps of nucleation, Ostwald ripening and growth. Although all of these steps are important for suppressing the spread of grain size distribution, especial attention should be paid so as to prevent the spread of size distribution at the aforementioned nucleation step because the spread of size distribution brought about in a former step cannot be narrowed by an ensuing step. What is important in the nucleation step is the relationship between the temperature of reaction mixture and the period of nucleation comprising adding silver ions and bromide ions to a reaction mixture according to the double jet technique and producing precipitates. JP-A-63-92942 by Saito describes that it is preferred that the temperature of the reaction mixture at the time of nucleation be in the range of from 20 to 45° C. for realizing a monodispersity enhancement. Further, JP-A-2-222940 by Zola et al describes that the suitable temperature at nucleation is 60° C. or below.

Gelatin may be further added during the grain formation in order to obtain monodisperse tabular grains of high aspect ratio. The added gelatin preferably consists of a chemically modified gelatin (gelatin in which at least two —COOH groups have newly been introduced at a chemical modification of —$NH_2$ group contained in the gelatin) as described in JP-A's-10-148897 11-143002, the disclosures of which are incorporated herein by reference. Although this chemically modified gelatin is a gelatin characterized in that at least two carboxyl groups have newly been introduced at a chemical modification of amino group contained in the gelatin, it is preferred that trimellitated gelatin be used as the same. Also, succinated gelatin is preferably used. The chemically modified gelatin is preferably added prior to the growth step, more preferably immediately after the nucleation. The addition amount thereof is preferably at least 60%, more preferably at least 80%, and much more preferably at least 90%, based on the total weight of dispersion medium used in grain formation.

The tabular grain emulsion is composed of silver iodobromide or silver chloroiodobromide. Although silver chloride may be contained, the silver chloride content is preferably 8 mol % or less, more preferably 3 mol % or less, or 0 mol %. The silver iodide content is preferably 20 mol % or less since the variation coefficient of the grain size distribution of the tabular grain emulsion is preferably 30% or less. The lowering of the variation coefficient of the distribution of equivalent circular diameter of the tabular grain emulsion can be facilitated by lowering the silver iodide content. The variation coefficient of the grain size distribution of the tabular grain emulsion is more preferably 20% or less, and the silver iodide content is more preferably 10 mol % or less.

It is preferred that the tabular grain emulsion have some intragranular structure with respect to the silver iodide distribution. The silver iodide distribution may have a double structure, a treble structure, a quadruple structure or a structure of higher order.

In the present invention, the tabular grains preferably have dislocation lines. The dislocation lines of the tabular grains can be observed by the direct method using a transmission electron microscope at low temperatures as described in, for example, J. F. Hamilton, Phot. Sci. Eng., 11, 57 (1967) and T. Shiozawa, J. Soc. Phot. Sci. Japan, 3, 5, 213 (1972). Illustratively, silver halide grains are harvested from the emulsion with the care that the grains are not pressurized with such a force that dislocation lines occur on the grains, are put on a mesh for electron microscope observation and, while cooling the specimen so as to prevent damaging (printout, etc.) by electron beams, are observed by the transmission method. The greater the thickness of the above grains, the more difficult the transmission of electron beams. Therefore, the use of an electron microscope of high voltage type (at least 200 kV on the grains of 0.25 $\mu$m in thickness) is preferred for ensuring clearer observation. The thus obtained photograph of grains enables determining the position and number of dislocation lines in each grain viewed in the direction perpendicular to the principal planes.

The number of dislocation lines of the tabular grains according to the present invention is preferably at least 10 per grain on the average and more preferably at least 20 per grain on the average. When dislocation lines are densely present or when dislocation lines are observed in the state of crossing each other, it happens that the number of dislocation lines per grain cannot accurately be counted. However, in this instance as well, rough counting on the order of, for example, 10, 20 or 30 dislocation lines can be effected, so that a clear distinction can be made from the presence of only a few dislocation lines. The average number of dislocation lines per grain is determined by counting the number of dislocation lines of each of at least 100 grains and calculating a number average thereof. There are instances when hundreds of dislocation lines are observed.

Dislocation lines can be introduced in, for example, the vicinity of the periphery of tabular grains. In this instance, the dislocation is nearly perpendicular to the periphery, and each dislocation line extends from a position corresponding to x% of the distance from the center of tabular grains to the side (periphery) to the periphery. The value of x preferably ranges from 10 to less than 100, more preferably from 30 to less than 99, and most preferably from 50 to less than 98. In this instance, the figure created by binding the positions from which the dislocation lines start is nearly similar to the configuration of the grain. The created figure may be one which is not a complete similar figure but deviated. The dislocation lines of this type are not observed around the center of the grain. The dislocation lines are crystallographically oriented approximately in the (211) direction. However, the dislocation lines often meander and may also cross each other.

Dislocation lines may be positioned either nearly uniformly over the entire zone of the periphery of the tabular grains or local points of the periphery. That is, referring to, for example, hexagonal tabular silver halide grains, dislocation lines may be localized either only in the vicinity of six apexes or only in the vicinity of one of the apexes. Contrarily, dislocation lines can be localized only in the sides excluding the vicinity of six apexes.

Furthermore, dislocation lines may be formed over regions including the centers of two mutually parallel principal planes of tabular grains. In the case where dislocation lines are formed over the entire regions of the principal planes, the dislocation lines may crystallographically be oriented approximately in the (211) direction when viewed in the direction perpendicular to the principal planes, and the formation of the dislocation lines may be effected either in the (110) direction or randomly. Further, the length of each dislocation line may be random, and the dislocation lines may be observed as short lines on the principal planes or as long lines extending to the side (periphery). The dislocation lines may be straight or often meander. In many instances, the dislocation lines cross each other.

The position of dislocation lines may be localized on the periphery, principal planes or local points as mentioned above, or the formation of dislocation lines may be effected on a combination thereof. That is, dislocation lines may be concurrently present on both the periphery and the principal planes.

The introduction of dislocation lines in the tabular grains can be accomplished by disposing a specified phase of high silver iodide content within the grains. In the dislocation line introduction, the phase of high silver iodide content may be provided with discontinuous regions of high silver iodide content. Practically, the phase of high silver iodide content within the grains can be obtained by first preparing base grains, providing them with a phase of high silver iodide content and covering the outside thereof with a phase of silver iodide content lower than that of the phase of high silver iodide content. The silver iodide content of the base tabular grains is lower than that of the phase of high silver iodide content, and is preferably 0 to 20 mol %, more preferably 0 to 15 mol % of the silver halide in the base.

The terminology "phase of high silver iodide content within the grains" refers to a silver halide solid solution containing silver iodide. The silver halide of this solid solution is preferably silver iodide, silver iodobromide or silver chloroiodobromide, more preferably silver iodide or silver iodobromide (the silver iodide content is in the range of 10 to 40 mol % based on the silver halides contained in the phase of high silver iodide content). For selectively causing the phase of high silver iodide content within the grains (hereinafter referred to as "internal high silver iodide phase") to be present on any place of the sides, corners and faces of the base grains, it is desirable to control forming conditions for the base grains, forming conditions for the internal high silver iodide phase and forming conditions for the phase covering the outside thereof. With respect to the forming conditions for the base grains, the pAg (logarithm of inverse number of silver ion concentration), the presence or absence, type and amount of silver halide solvent and the temperature are important factors. Regulating the pAg at base grain growth to 8.5 or less, preferably 8 or less, enables selectively causing the internal high silver iodide phase to be present near the apex or on the face of the base grains in the subsequent step of forming the internal high silver iodide phase. On the other hand, regulating the pAg at base grain growth to at least 8.5, preferably at least 9, enables causing the internal high silver iodide phase to be present on the side of the base grains in the subsequent step of forming the internal high silver iodide phase. The threshold value of the pAg is changed upward or downward depending on the temperature and the presence or absence, type and amount of silver halide solvent. When, for example, a thiocyanate is used as the silver halide solvent, the threshold value of the pAg is deviated toward a higher value.

What is most important as the pAg at growth is the pAg at the termination of growth of base grains. On the other hand, even when the pAg at growth does not satisfy the above value, the selected position of the internal high silver iodide phase can be controlled by carrying out, after the growth of base grains, the regulation to the above pAg and a ripening. During the period, ammonia, an amine compound, a thiourea derivative or a thiocyanate salt is effective as the silver halide solvent. For the formation of the internal high silver iodide phase, use can be made of the so-called conversion methods. These conversion methods include one in which, during grain formation, halide ions whose salts formed with silver ions exhibit a solubility lower than that of the salts formed with the halide ions that are forming the grains or the vicinity of the surface of the grains occurring at the time of grain formation, are added. In the present invention, it is preferred that the amount of added low-solubility halide ions be at least some value (relating to halogen composition) relative to the surface area of grains occurring at the time of the addition. For example, it is preferred that, during grain formation, KI be added in an amount not smaller than some amount relative to the surface area of silver halide grains occurring at the time of the grain formation. Specifically, it is preferred that an iodide salt be added in an amount of at least $8.2\times10^{-5}$ mol/m$^2$.

Preferred process for forming the internal high silver iodide phase comprises adding an aqueous solution of a silver salt simultaneously with the addition of an aqueous solution of halide salts containing an iodide salt.

For example, an aqueous solution of $AgNO_3$ is added simultaneously with the addition of an aqueous solution of KI by the double jet. The addition initiating times and addition completing times of the aqueous solution of KI and the aqueous solution of $AgNO_3$ may be differed from each other, that is, the one may be earlier or later than the other. The addition molar ratio of an aqueous solution of $AgNO_3$ to an aqueous solution of KI is preferably at least 0.1, more preferably at least 0.5, and most preferably at least 1. The total addition molar amount of an aqueous solution of $AgNO_3$ relative to halide ions within the system and added iodide ions may fall in a silver excess region. It is preferred that the pAg exhibited when the aqueous solution of halide containing such iodide ions and the aqueous solution of silver salt are added by the double jet be decreased in accordance with the passage of double jet addition time. The pAg prior to the addition initiation is preferably in the range of 6.5 to 13, more preferably 7.0 to 11. The pAg at the time of addition completion is most preferably in the range of 6.5 to 10.0.

In the performing of the above process, it is preferred that the solubility in the mixture system be as low as possible. Accordingly, the temperature of the mixture system exhibited at the time of formation of the high silver iodide phase is preferably in the range of 30 to 80° C., more preferably 30 to 70° C.

Furthermore, the formation of the internal high silver iodide phase can preferably be performed by adding fine grains of silver iodide, fine grains of silver iodobromide, fine grains of silver chloroiodide or fine grains of silver chloroiodobromide. It is especially preferred that the formation be effected by adding fine grains of silver iodide. Although these fine grains generally have a size of 0.01 to 0.1 $\mu$m, use can also be made of fine grains with a size of not greater than 0.01 $\mu$m, or 0.1 $\mu$m or more. With respect to the process for preparing these fine grains of silver halide, reference can be made to descriptions of JP-A's-1-183417, 2-44335, 1-183644, 1-183645, 2-43534 and 2-43535. The internal high silver iodide phase can be provided by adding these fine grains of silver halide and conducting a ripening. When the fine grains are dissolved by ripening, use can be made of the aforementioned silver halide solvent. It is not needed that all these added fine grains be immediately dissolved and disappear. It is satisfactory if, when the final grains have been completed, they are dissolved and disappear.

The position of the internal high silver iodide phase, as measured from the center of, for example, a hexagon resulting from grain projection, is preferably present in the range of 5 to less than 100 mol %, more preferably 20 to less than 95 mol %, and most preferably 50 to less than 90 mol %, based on the amount of silver of the whole grain. The amount of silver halide forming this internal high silver iodide phase, in terms of the amount of silver, is 50 mol % or less, preferably 20 mol % or less, based on the amount of silver of the whole grain. With respect to the above high silver iodide phase, there are provided recipe values of the production of silver halide emulsion, not values obtained by measuring the halogen composition of final grains according to various analytical methods. The internal high silver iodide phase is often caused to completely disappear in final grains by, for example, recrystallization during the shell covering step, and all the above silver amounts relate to recipe values thereof.

Therefore, although the observation of dislocation lines can be easily performed in the final grains by the above method, the internal silver iodide phase introduced for the introduction of dislocation lines often cannot be confirmed as a clear phase because the boundary silver iodide composition is continuously changed. The halogen composition at each grain part can be determined by a combination of X-ray diffractometry, the EPMA method (also known as the XMA method, in which silver halide grains are scanned by electron beams to thereby detect the silver halide composition), the ESCA method (also known as the XPS method, in which X rays are irradiated and photoelectrons emitted from grain surface are separated into spectra), etc.

The outside phase which covers the internal high silver iodide phase has a silver iodide content lower than that of the internal high silver iodide phase. The silver iodide content of the covering outside phase is preferably in the range of 0 to 30 mol %, more preferably 0 to 20 mol %, and most preferably 0 to 10 mol %, based on the silver halide contained in the covering outside phase.

Although the temperature and pAg employed at the formation of the outside phase which covers the internal high silver iodide phase are arbitrary, the temperature preferably ranges from 30 to 80° C., most preferably from 35 to 70° C., and the pAg preferably ranges from 6.5 to 11.5. The use of the aforementioned silver halide solvent is occasionally preferred, and the most preferred silver halide solvent is a thiocyanate salt.

Another method of introducing dislocation lines in the tabular grains comprises using an iodide ion-releasing agent as described in JP-A-6-11782, which can preferably be employed.

Also, dislocation lines can be introduced by appropriately combining this method of introducing dislocation lines with the aforementioned method of introducing dislocation lines.

The variation coefficient of the intergranular iodine distribution of silver halide grains for use in the present invention is preferably 20% or less, more preferably 15% or less, and much more preferably 10% or less. When the variation coefficient of the iodine content distribution of each silver halide is greater than 20%, unfavorably, a high contrast is not realized and a sensitivity lowering is intense when a pressure is applied.

Any known processes such as the process of adding fine grains as described, for example, in JP-A-1-183417 and the process of using an iodide ion-releasing agent as described in JP-A-2-68538 can be employed either individually or in combination for the production of silver halide grains whose intergranular iodine distribution is narrow for use in the present invention.

The silver halide grains according to the present invention preferably have a variation coefficient of intergranular iodine distribution of 20% or less. The process described in JP-A-3-213845 can be used as the most suitable process for converting the intergranular iodine distribution to a monodispersion. That is, a monodisperse intergranular iodine distribution can be accomplished by a process in which fine silver halide grains containing silver iodide in an amount of at least 95 mol % are formed by mixing together an aqueous solution of a water soluble silver salt and an aqueous solution of a water soluble halide (containing at least 95 mol % of iodide ions) by means of a mixer provided outside a reactor vessel for crystal growth and, immediately after the formation, fed in the reactor vessel. The terminology "reactor vessel" used herein means the vessel in which the nucleation and/or crystal growth of tabular silver halide grains is carried out.

With respect to the above process of mixer preparation followed by adding procedure and the preparatory means for use therein, the following three techniques can be employed as described in JP-A-3-213845:

(1) immediately after formation of fine grains in a mixer, the fine grains are transferred into a reactor vessel;

(2) powerful and effective agitation is carried out in the mixer; and (3) an aqueous solution of protective colloid is injected into the mixer.

The protective colloid used in technique (3) above may be separately injected in the mixer, or may be incorporated in the aqueous solution of silver halide or the aqueous solution of silver nitrate before the injection in the mixer. The concentration of protective colloid is at least 1% by weight, preferably in the range of 2 to 5% by weight. Examples of polymeric compounds exhibiting a protective colloid function to the silver halide grains for use in the present invention include polyacrylamide polymers, amino polymers, polymers having thioether groups, polyvinyl alcohol, acrylic polymers, hydroxyquinoline having polymers, cellulose, starch, acetal, polyvinylpyrrolidone and ternary polymers. Low-molecular-weight gelatin can preferably be used as the above polymeric compound. The molecular weight of low-molecular-weight gelatin is preferably 40,000 or less, more preferably 30,000 or less.

The grain formation temperature in the preparation of fine silver halide grains is preferably 35° C. or below, more preferably 25° C. or below. The temperature of the reactor vessel in which fine silver halide grains are incorporated is at least 50° C., preferably at least 60° C., and more preferably at least 70° C.

The grain size of fine-size silver halide employed by the present invention can be determined by placing grains on a mesh and making a direct observation through a transmission electron microscope. The size of fine grains of the present invention is 0.3 μm or less, preferably 0.1 μm or less, and more preferably 0.01 μm or less. This fine silver halide may be added simultaneously with the addition of other halide ions and silver ions, or may be separately added. The fine silver halide grains are mixed in an amount of 0.005 to 20 mol %, preferably 0.01 to 10 mol %, based on the total silver halide.

The silver iodide content of each individual grain can be measured by analyzing the composition of each individual grain by means of an X-ray microanalyzer. The terminology "variation coefficient of intergranular iodine distribution" means a value defined by the formula:

variation coefficient=(standard deviation/av. silver iodide content)×100 wherein the standard deviation, specifically the standard deviation of silver iodide content, and the average silver iodide content are obtained by measuring the silver iodide contents of at least 100, preferably at least 200, and more preferably at least 300 emulsion grains. The measuring of the silver iodide content of each individual grain is described in, for example, EP No. 147,868. There are cases in which a correlation exists between the silver iodide content Yi (mol %) of each individual grain and the equivalent spherical diameter Xi (μm) of each individual grain and cases in which no such correlation exists. It is preferred that no correlation exist therebetween. The structure associate d with the silver halide composition of grains of the present invention can be identified by, for example, a combination of X-ray diffractometry, the EPMA method (also known as the XMA method, in which silver halide grains are scanned by electron beams to thereby detect the silver halide composition) and the ESCA method (also known as the XPS method, in which X rays are irradiated and photoelectrons emitted from grain surface are separated into spectra). In the measuring of silver iodide content in the present invention, the terminology "grain surface" refers to the region whose depth from surface is about 50 Å and the terminology "grain internal part" refers to the region other than the above surface. The halogen composition of such a grain surface can generally be measured by the ESCA method.

The silver halide emulsions of the present invention are preferably subjected to selenium sensitization.

Selenium compounds disclosed in hitherto published patents can be used as the selenium sensitizer in the present invention. In the use of unstable selenium compound and/or nonunstable selenium compound, generally, it is added to an emulsion and the emulsion is agitated at high temperature, preferably 40° C. or above, for a given period of time. Compounds described in, for example, Jpn. Pat. Appln. KOKOKU Publication No. (hereinafter referred to as JP-B-) 44-15748, JP-B-43-13489, JP-A's-4-25832 and 4-109240 are preferably used as the unstable selenium compound.

Specific examples of the unstable selenium sensitizers include isoselenocyanates (for example, aliphatic isoselenocyanates such as allyl isoselenocyanate), selenoureas, selenoketones, selenoamides, selenocarboxylic acids (for example, 2-selenopropionic acid and 2-selenobutyric acid), selenoesters, diacyl selenides (for example, bis(3-chloro-2, 6-dimethoxybenzoyl) selenide), selenophosphates, phosphine selenides and colloidal metal selenium.

The unstable selenium compounds, although preferred types thereof are as mentioned above, are not limited thereto. It is generally understood by persons of ordinary skill in the art to which the invention pertains that the structure of the unstable selenium compound as a photographic emulsion sensitizer is not so important as long as the selenium is unstable and that the unstable selenium compound plays no other role than having its selenium carried by organic portions of selenium sensitizer molecules and causing it to present in unstable form in the emulsion. In the present invention, the unstable selenium compounds of this broad concept can be used advantageously.

Compounds described in JP-B's-46-4553, 52-34492 and 52-34491 can be used as the nonunstable selenium compound in the present invention. Examples of the nonunstable selenium compounds include selenious acid, potassium selenocyanate, selenazoles, quaternary selenazole salts, diaryl selenides, diaryl diselenides, dialkyl selenides, dialkyl diselenides, 2-selenazolidinedione, 2-selenoxazolidinethione and derivatives thereof.

Of these selenium compounds, those of the following general formula (A) and general formula (B) re preferred.

(A)

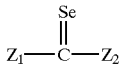

In the formula, $Z_1$ and $z_2$ may be identical with or different from each other, and each represent an alkyl group (for example, methyl, ethyl, t-butyl, adamantyl or t-octyl), an alkenyl group (for example, vinyl or propenyl), an aralkyl group (for example, benzyl or phenethyl), an aryl group (for example, phenyl, pentafluorophenyl, 4-chlorophenyl, 3-nitrophenyl, 4-octylsulfamoylphenyl or α-naphthyl), a heterocyclic group (for example, 2-pyridyl, 3-thienyl, 2-furyl or 2-imidazolyl), —$NR_1(R_2)$, —$OR_3$ or —$SR_4$.

$R_1$, $R_2$, $R_3$ and $R_4$ may be identical with or different from each other, and each represent a hydrogen atom, an alkyl group, an aralkyl group, an aryl group, a heterocyclic group or an acyl group. Examples of the alkyl, aralkyl, aryl and heterocyclic groups are the same as mentioned with respect to $Z_1$. Provided that each of $R_1$ and $R_2$ may represent a hydrogen atom or an acyl group (for example, acetyl, propanoyl, benzoyl, heptafluorobutanoyl, difluoroacetyl, 4-nitrobenzoyl, α-naphthoyl or 4-trifluoromethylbenzoyl).

In the general formula (A), it is preferred that $Z_1$ represent an alkyl group, an aryl group or —$NR_1(R_2)$ and that $Z_2$ represent —$NR_5(R_6)$. $R_1$, $R_2$, $R_5$ and $R_6$ may be identical with or different from each other, and each represent a hydrogen atom, an alkyl group, an aryl group or an acyl group.

The general formula (A) more preferably represents N,N-dialkylselenoureas, N,N,N'-trialkyl-N'-acylselenoureas, tetraalkylselenoureas, N,N-dialkylarylselenoamides and N-alkyl-N-arylarylselenoamides.

(B)

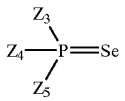

In the formula, $Z_3$, $Z_4$ and $Z_5$ may be identical with or different from each other, and each represent an alkyl group, an alkenyl group, an alkynyl group, an aralkyl group, an aryl group, a heterocyclic group, —$OR_7$, —$NR_8(R_9)$, —$SR_{10}$, —$SeR_{11}$, X or a hydrogen atom.

Each of $R_7$, $R_{10}$ and $R_{11}$ represents an alkyl group, an alkenyl group, an alkynyl group, an aralkyl group, an aryl group, a heterocyclic group, a hydrogen atom or a cation. Each of $R_8$ and $R_9$ represents an alkyl group, an alkenyl group, an alkynyl group, an aralkyl group, an aryl group, a heterocyclic group or a hydrogen atom. X represents a halogen atom.

In the general formula (B), the alkyl group, alkenyl group, alkynyl group and aralkyl group represented by $Z_3$, $Z_4$, $Z_5$, $R_7$, $R_8$, $R_9$, $R_{10}$ and $R_{11}$ are linear, branched or cyclic alkyl group, alkenyl group, alkynyl group and aralkyl group, respectively (for example, methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentynyl, benzyl and phenethyl).

In the general formula (B), the aryl group represented by $Z_3$, $Z_4$, $Z_5$, $R_7$, $R_8$, $R_9$, $R_{10}$ and $R_{11}$ is a monocyclic or condensed-ring aryl group (for example, phenyl, pentafluorophenyl, 4-chlorophenyl, 3-sulfophenyl, α-naphthyl or 4-methylphenyl).

In the general formula (B), the heterocyclic group represented by $Z_3$, $Z_4$, $Z_5$, $R_7$, $R_8$, $R_9$, $R_{10}$ and $R_{11}$ is a saturated or an unsaturated heterocyclic group of 3 to 10 membered ring containing at least one of nitrogen, oxygen and sulfur atoms (for example, 2-pyridyl, 3-thienyl, 2-furyl, 2-thiazolyl, 2-imidazolyl or 2-benzimidazolyl). The heterocyclic group may have a condensed ring attached thereto.

In the general formula (B), the cation represented by $R_7$, $R_{10}$ and $R_{11}$ is an alkali metal atom (for example, potassium or sodium) or ammonium. The halogen atom represented by X is, for example, a fluorine atom, a chlorine atom, a bromine atom or an iodine atom.

In the general formula (B), it is preferred that each of $Z_3$, $Z_4$ and $Z_5$ represent an alkyl group, an aryl group or —$OR_7$ and that $R_7$ represent an alkyl group or an aryl group.

The general formula (B) more preferably represents a trialkylphosphine selenide, a triarylphosphine selenide, a trialkyl selenophosphate or a triaryl selenophosphate.

Specific examples of the compounds of the general formulae (A) and (B) will be shown below, which in no way limit the present invention.

1.

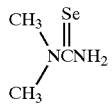

2.

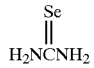

3.

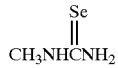

4.

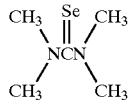

5.

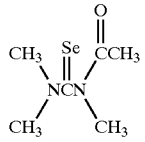

6.

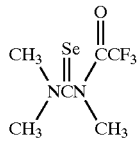

7.

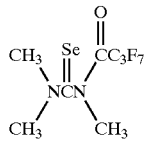

8.

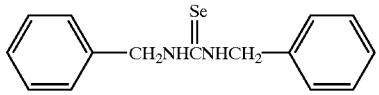

9.

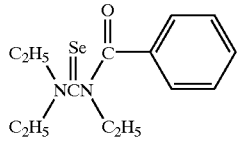

-continued
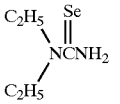
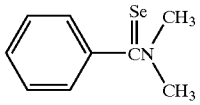
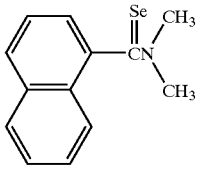
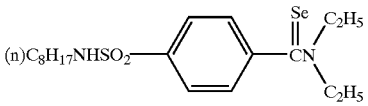
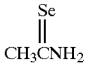
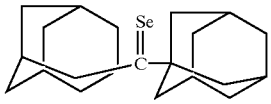
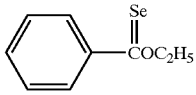
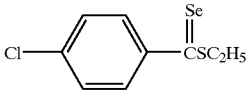
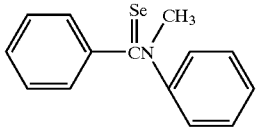
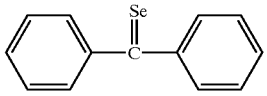
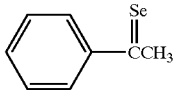
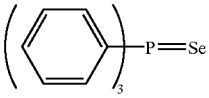
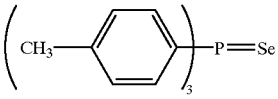
10.
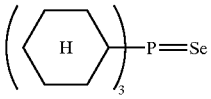
11.
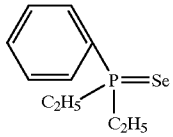
12.
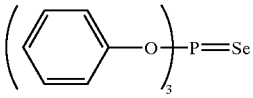
13.
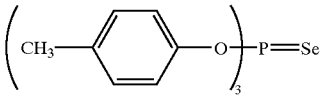
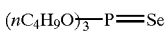
14.
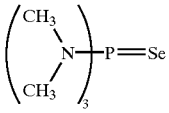
15.
16.
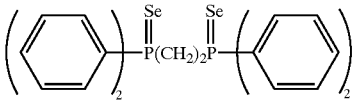
17.
18.
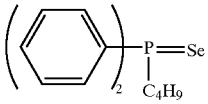
19.
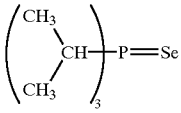
20.
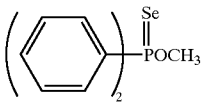
21.
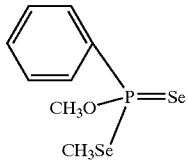
22.
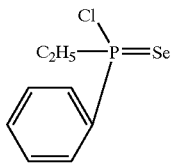
23.
24.
25.
26.
27.
28.
29.
30.
31.
32.
33.
34.
35.
36.
37.

-continued

38.

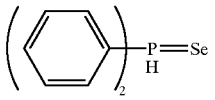

39.

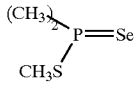

40.

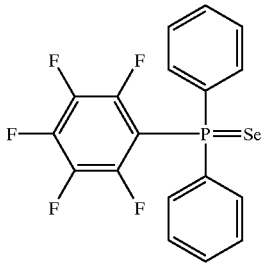

These selenium sensitizers are dissolved in a single solvent or a mixture of solvents selected from among water and organic solvents such as methanol and ethanol and added at the time of chemical sensitization. Preferably, the addition is performed prior to the initiation of chemical sensitization. The above selenium sensitizers can be used either individually or in combination. The joint use of an unstable selenium compound and a nonunstable selenium compound is preferred.

The addition amount of selenium sensitizer for use in the present invention, although varied depending on the activity of employed selenium sensitizer, the type and size of silver halide, the ripening temperature and time, etc., is preferably in the range of $2\times10^{-6}$ to $5\times10^{-6}$ mol per mol of silver halide. The temperature of chemical sensitization in the use of a selenium sensitizer is preferably between 40° C. and 80° C. The pAg and pH are arbitrary. For example, with respect to pH, the effect of the present invention can be exerted even if it widely ranges from 4 to 9.

The selenium sensitization can more effectively be accomplished by performing it in the presence of a silver halide solvent.

Examples of the silver halide solvents which can be employed in the present invention include (a) organic thioethers described in U.S. Pat. Nos. 3,271,157, 3,531,289, and 3,574,628, and JP-A's-54-1019 and 54-158917, (b) thiourea derivatives described in, for example, JP-A's-53-82408, 55-77737 and 55-2982, (c) silver halide solvents having a thiocarbonyl group interposed between an oxygen or sulfur atom and a nitrogen atom, described in JP-A-53-144319, (d) imidazoles described in JP-A-54-100717, (e) sulfites and (f) thiocyanates.

Thiocyanates and tetramethylthiourea can be mentioned as especially preferred silver halide solvents. The amount of added solvent, although varied depending on the type thereof, is, for example, preferably in the range of $1\times10^{-4}$ to $1\times10^{-2}$ mol per mol of silver halide.

The emulsion for use in the present invention is preferably subjected to the sensitization in combination with gold sensitization. The oxidation number of gold of the gold sensitizer used in the gold sensitization may be either +1 or +3, and gold compounds customarily used as gold sensitizers can be employed. Representative examples thereof include chloroauric acid salts, potassium chloroaurate, auric trichloride, potassium auric thiocyanate, potassium iodoaurate, tetracyanoauric acid, ammonium aurothiocyanate, pyridyltrichlorogold, gold sulfide and gold selenide. The addition amount of gold sensitizer, although varied depending on various conditions, is preferably between $1\times10^{-7}$ mol and $5\times10^{-5}$ mol per mol of silver halide as a yardstick.

With respect to the emulsion for use in the present invention, it is desired to perform the chemical sensitization in combination with sulfur sensitization.

The sulfur sensitization is generally performed by adding a sulfur sensitizer and agitating the emulsion at high temperature, preferably 40° C. or above, for a given period of time.

In the above sulfur sensitization, those known as sulfur sensitizers can be used. For example, use can be made of thiosulfates, allylthiocarbamidothiourea, allyl isothiacyanate, cystine, p-toluenethiosulfonates and rhodanine. Use can also be made of other sulfur sensitizers described in, for example, U.S. Pat. Nos. 1,574,944, 2,410,689, 2,278,947, 2,728,668, 3,501,313, and 3,656,955, and DE No. 1,422,869, JP-B-56-24937 and JP-A-55-45016. The addition amount of sulfur sensitizer is satisfactory if it is sufficient to effectively increase the sensitivity of the emulsion. This amount, although varied to a large extent under various conditions such as the pH, temperature and size of silver halide grains, is preferably in the range of $1\times10^{-7}$ to $5\times10^{-5}$ mol per mol of silver halide.

The silver halide emulsion for use in the present invention can be subjected to a reduction sensitization during the grain formation, or after the grain formation but before the chemical sensitization, during the chemical sensitization or after the chemical sensitization.

The reduction sensitization can be performed by a method selected from among the method in which a reduction sensitizer is added to the silver halide emulsion, the method commonly known as silver ripening in which growth or ripening is carried out in an environment of pAg as low as 1 to 7, and the method commonly known as high-pH ripening in which growth or ripening is carried out in an environment of pH as high as 8 to 11. At least two of these methods can be used in combination.

The above method in which a reduction sensitizer is added is preferred from the viewpoint that the level of reduction sensitization can be finely regulated.

Examples of known reduction sensitizers include stannous salts, ascorbic acid and derivatives thereof, amines and polyamines, hydrazine derivatives, formamidinesulfinic acid, silane compounds and borane compounds. In the reduction sensitization employed in the present invention, appropriate one may be selected from among these known reduction sensitizers and used or at least two may be selected and used in combination. Preferred reduction sensitizers are stannous chloride, thiourea dioxide, dimethylaminoborane, ascorbic acid and derivatives thereof. Although the addition amount of reduction sensitizer must be selected because it depends on the emulsion manufacturing conditions, it is preferred that the addition amount range from $10^{-7}$ to $10^{-3}$ mol per mol of silver halide.

Each reduction sensitizer is dissolved in water or any of organic solvents such as alcohols, glycols, ketones, esters and amides and added during the grain growth. Although the reduction sensitizer may be put in a reaction vessel in advance, it is preferred that the addition be effected at an appropriate time during the grain growth. It is also suitable to add in advance the reduction sensitizer to an aqueous solution of a water-soluble silver salt or a water-soluble alkali halide and to precipitate silver halide grains with the use of the resultant aqueous solution. Alternatively, the reduction sensitizer solution may preferably be either divided and added a plurality of times in accordance with the grain growth or continuously added over a prolonged period of time.

An oxidizer capable of oxidizing silver is preferably used during the process of producing the emulsion for use in the present invention. The silver oxidizer is a compound having an effect of acting on metallic silver to thereby convert the same to silver ion. A particularly effective compound is one that converts very fine silver grains, formed as a by-product in the step of forming silver halide grains and the step of chemical sensitization, into silver ions. Each silver ion produced may form a silver salt sparingly soluble in water, such as a silver halide, silver sulfide or silver selenide, or may form a silver salt easily soluble in water, such as silver nitrate. The silver oxidizer may be either an inorganic or an organic substance. Examples of suitable inorganic oxidizers include ozone, hydrogen peroxide and its adducts (e.g., $NaBO_2.H_2O_2.3H_2O$, $2NaCO_3.3H_2O_2$, $Na_4P_2O_7.2H_2O_2$ and $2Na_2SO_4.H_2O_2.2H_2O$), peroxy acid salts (e.g., $K_2S_2O_8$, $K_2C_2O_6$ and $K_2P_2O_8$), peroxy complex compounds (e.g., $K_2[Ti(O_2)C_2O_4].3H_2O$, $4K_2SO_4.Ti(O_2)OH.SO_4.2H_2O$ and $Na_3[VO(O_2)(C_2H_4)_2]6H_2O$), permanganates (e.g., $KMnO_4$), chromates (e.g., $K_2Cr_2O_7$) and other oxyacid salts, halogen elements such as iodine and bromine, perhalogenates (e.g., potassium periodate), salts of high-valence metals (e.g., potassium hexacyanoferrate (II)) and thiosulfonates.

Examples of suitable organic oxidizers include quinones such as p-quinone, organic peroxides such as peracetic acid and perbenzoic acid and active halogen-releasing compounds (e.g., N-bromosuccinimide, chloramine T and chloramine B).

Oxidizers preferred in the present invention are inorganic oxidizers selected from among ozone, hydrogen peroxide and its adducts, halogen elements and thiosulfonates and organic oxidizers selected from among quinones.

The use of the silver oxidizer in combination with the above reduction sensitization is preferred. This combined use can be effected by performing the reduction sensitization after the use of the oxidizer or vice versa or by simultaneously performing the reduction sensitization and the use of the oxidizer. These methods can be performed during the step of grain formation or the step of chemical sensitization.

The photographic emulsion for use in the present invention is preferably subjected to a spectral sensitization with a methine dye or the like to thereby exert the effects of the present invention. Examples of employed dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes and composite merocyanine dyes. These dyes may contain any of nuclei commonly used in cyanine dyes as basic heterocyclic nuclei. Examples of such nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have substituents on carbon atoms thereof.

The merocyanine dye or composite merocyanine dye may have a 5 or 6-membered heterocyclic nucleus such as a pyrazolin-5-one nucleus, a thiohydantoin nucleus, a 2-thioxazolidine-2,4-dione nucleus, a thiazolidine-2,4-dione nucleus, a rhodanine nucleus or a thiobarbituric acid nucleus as a nucleus having a ketomethylene structure.

These spectral sensitizing dyes may be used either individually or in combination. The spectral sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, and 3,837,862, 4,026,707, GB Nos. 1,344,281 and 1,507,803, JP-B's-43-4936 and 53-12375, and JP-A's-52-110618 and 52-109925.

The emulsion used in the present invention may contain a dye which itself exerts no spectral sensitizing effect or a substance which absorbs substantially none of visible radiation and exhibits supersensitization, together with the above spectral sensitizing dye.

The addition timing of the spectral sensitizing dye to the emulsion may be performed at any stage of the process for preparing the emulsion which is known as being useful. Although the doping is most usually conducted at a stage between the completion of the chemical sensitization and the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, the spectral sensitization can be conducted prior to the chemical sensitization and, also, the spectral sensitizing dye can be added prior to the completion of silver halide grain precipitation to thereby initiate the spectral sensitization as described in JP-A-58-113928. Further, the above sensitizing dye can be divided prior to addition, that is, part of the sensitizing dye can be added prior to the chemical sensitization with the rest of the sensitizing dye added after the chemical sensitization as taught in U.S. Pat. No. 4,225,666. Still further, the spectral sensitizing dye can be added at any stage during the formation of silver halide grains according to the method disclosed in U.S. Pat. No. 4,183,756 and other methods.

Although the sensitizing dye can be used in an amount of $4\times10^{-6}$ to $8\times10^{-3}$ mol per mol of silver halide, the use thereof in an amount of about $5\times10^{-5}$ to $2\times10^{-3}$ mol per mol of silver halide is more effective when the size of silver halide grains is in the preferred range of 0.2 to 1.2 $\mu$m.

The silver halide grains for use in the present invention preferably have a twin face spacing of 0.017 $\mu$m or less, more preferably 0.007 to 0.017 $\mu$m, and especially preferably 0.007 to 0.015 $\mu$m.

The fogging during aging of the silver halide emulsion for use in the present invention can be improved by adding and dissolving a previously prepared silver iodobromide emulsion at the time of chemical sensitization. Although the timing of the addition is arbitrary as long as it is performed during chemical sensitization, it is preferred that the silver iodobromide emulsion be first added and dissolved and, thereafter, a sensitizing dye and a chemical sensitizer be added in this order. The employed silver iodobromide emulsion has an iodine content lower than the surface iodine content of host grains, which is preferably a pure silver bromide emulsion. This silver iodobromide emulsion, although the size thereof is not limited as long as it is completely dissolvable, preferably has an equivalent spherical diameter of 0.1 $\mu$m or less, more preferably 0.05 $\mu$m or less. Although the addition amount of silver iodobromide emulsion depends on employed host grains, basically, it preferably ranges from 0.005 to 5 mol %, more preferably from 0.1 to 1 mol %, based on the mole of silver.

The bleaching accelerator-releasing compound which can be used in the present invention will be described below.

The bleaching accelerator-releasing compound can preferably be represented by the following general formula (I):

$$A—(L)_k—Z \quad (I)$$

wherein A represents a group which reacts with a developing agent in an oxidized form to thereby cleave $(L)_k$—Z; L represents a group which, after the cleavage of the bond with A, cleaves Z; k is 0 or 1; and Z represents a bleaching accelerator.

The general formula (I) will be described in detail below.

In the general formula (I), specifically, A represents a coupler residue or a redox group.

The coupler residue represented by A can be, for example, any of yellow coupler residues (e.g., open-chain ketomethylene type coupler residues such as acylacetanilide and malondianilide), magenta coupler residues (e.g., 5-pyrazolone type and pyrazolotriazole type coupler residues), cyan coupler residues (e.g., phenol type and naphthol type coupler residues) and colorless compound forming couplers (e.g., indanone type and acetophenone type coupler residues). Also, the coupler residue represented by A can be any of heterocyclic coupler residues described in, for example, U.S. Pat. Nos. 4,315,070 and 4,183,752, the disclosures of which are incorporated herein by reference.

When A represents a redox group, the redox group is a group which can be cross oxidized by a developing agent in an oxidized form and can be, for example, any of hydroquinones, catechols, pyrogallols, 1,4-naphthohydroquinones, 1,2-naphthohydroquinones, sulfonamidophenols, hydrazides and sulfonamidonaphthols. Specific examples of these groups are described in, for example, JP-A's-61-230135, 62-251746 and 61-278852, U.S. Pat. Nos. 3,364,022, 3,379,529, 3,639,417 and 4,684,604 and J. Org. Chem., 29, 588 (1964), the disclosures of which are incorporated herein by reference.

L of the general formula (I) can preferably be any of the following groups.

(1) Groups utilizing a hemiacetal cleavage reaction:

These are, for example, groups described in U.S. Pat. No. 4,146,396, and JP-A's-60-249148 60-249149, the disclosure of which are incorporated herein by reference, and represented by the following formula. In the formula, mark * represents a position bonded to the left side in the general formula (I), and mark ** represents a position bonded to the right side in the general formula (I).

(T-1)

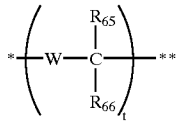

In formula (T-1), W represents an oxygen atom, a sulfur atom or a group of the formula —$NR_{67}$—; each of $R_{65}$ and $R_{66}$ represents a hydrogen atom or a substituent; $R_{67}$ represents a substituent; and t is 1 or 2. When t is 2, two —W—$CR_{65}R_{66}$— groups represent the same species or species different from each other. Typical examples of each of $R_{65}$ and $R_{66}$, when these representing substituents, and $R_{67}$ include $R_{69}$, $R_{69}CO$—, $R_{69}SO_2$—, $R_{69}R_{70}NCO$— and $R_{69}R_{70}NSO_2$—. In these formulae, $R_{69}$ represents an aliphatic group, an aromatic group or a heterocyclic group. $R_{70}$ represents an aliphatic group, an aromatic group, a heterocyclic group or a hydrogen atom. The present invention also comprehends $R_{65}$, $R_{66}$ and $R_{67}$ which represent respective divalent groups and are connected to each other to thereby form a cyclic structure.

(2) Groups inducing a cleavage reaction with the use of an intramolecular nucleophilic substitution reaction:

These can be, for example, timing groups described in U.S. Pat. No. 4,248,962, the disclosure of which is incorporated herein by reference, which can be represented by the formula:

*-Nu-Link-E-** (T-2)

In formula (T-2), mark * represents a position bonded to the left side in the general formula (I), and mark  represents a position bonded to the right side in the general formula (I). Nu represents a nucleophilic group, which is, for example, an oxygen atom or a sulfur atom. E represents an electrophilic group, which encounters a nucleophilic attack from Nu with the result that the bond with the mark  can be cleaved. Link represents a connecting group which provides such a steric association that an intramolecular nucleophilic substitution reaction can be effected by Nu and E.

(3) Groups inducing a cleavage reaction with the use of an electron transfer reaction along a conjugated system:

These can be, for example, groups described in U.S. Pat. Nos. 4,409,323 and 4,421,845, the disclosures of which are incorporated herein by reference, and represented by the following formula.

(T-3)

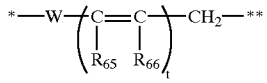

In formula (T-3), the mark *, mark **, W, $R_{65}$, $R_{66}$ and t have the same meaning as specified with respect to the formula (T-1).

(4) Groups utilizing a cleavage reaction of hydrolysis of ester:

These can be, for example, connecting groups described in German Offenlegungshrift 2,626,315, the disclosure of which is incorporated herein by reference, and represented by the following formulae.

In the formulae, the mark * and mark ** have the same meaning as specified with respect to the formula (T-1).

(T-4)

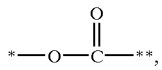

(T-5)

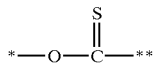

(5) Groups utilizing a cleavage reaction of iminoketal:

These can be, for example, connecting groups described in U.S. Pat. No. 4,546,073, the disclosure of which is incorporated by reference, and represented by the following formula.

(T-6)

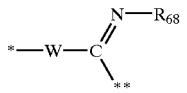

In the formula, the mark *, mark ** and W have the same meaning as specified with respect to the formula (T-1). $R_{68}$ has the same meaning as $R_{67}$.

Examples of groups represented by L, which is to function as couplers or redox groups, include the following.

Couplers, for example, phenol type couplers are those bonded to A of the general formula (I) at the oxygen atom of the hydroxyl group thereof from which a hydrogen atom is deleted. On the other hand, 5-pyrazolone type couplers are those bonded to A of the general formula (I) at the oxygen atom of the hydroxyl group from which a hydrogen atom is deleted in its tautomer form of 5-hydroxypyrazole.

These each function as couplers only after being split from A and react with a developer in an oxidized form to thereby release Z bonded to the coupling position thereof.

Preferred examples of L functioning as couplers include those represented by the following formulae (C-1) to (C-4):

(C-1)

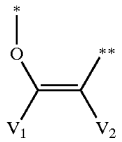

(C-2)

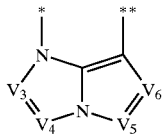

(C-3)

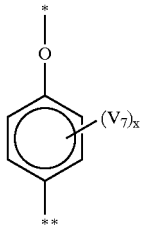

(C-4)

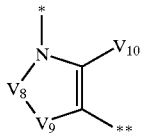

In the formulae, $V_1$ and $V_2$ represent substituents, and each of $V_3$, $V_4$, $V_5$ and $V_6$ represents a nitrogen atom or a substituted or unsubstituted methine group. $V_7$ represents a substituent, and x is an integer of 0 to 4. When x is two or more, groups $V_7$ may be identical with or different from each other and two groups $V_7$ may be linked with each other to thereby form a cyclic structure. $V_8$ represents group —CO—, group —$SO_2$—, an oxygen atom or a substituted imino group. $V_9$ represents a nonmetallic atom group for constituting a 5 to 8-membered ring in combination with a group of the formula:

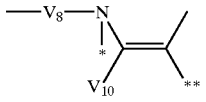

$V_{10}$ represents a hydrogen atom or a substituent.

In the general formula (I), when the group represented by L is a redox group, it is preferably represented by the following formula (R-1):

$$*—P—(Y{=})_k—Q—B$$

In the formula, each of P and Q independently represents an oxygen atom or a substituted or unsubstituted imino group. At least one of k Ys and k Zs represents a methine group containing Z as a substituent, while each of the other Ys and Zs represents a substituted or unsubstituted methine group or a nitrogen atom. k is an integer of 1 to 3 (k Ys and Zs may be identical with or different from each other). B represents a hydrogen atom or a group which can be removed by an alkali. The present invention comprehends P, Y, Z, Q and B, of which any two are divalent substituents and linked with each other to thereby form a cyclic structure. For example, the formation of a benzene ring or pyridine ring by $(Y{=}Z)_k$, is comprehended.

When P and Q represent substituted or unsubstituted imino groups, they are preferably imino groups substituted with a sulfonyl group or an acyl group.

In this instance, P and Q are represented by the following formulae:

(N-1)

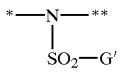

(N-2)

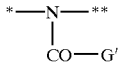

In the formulae, the mark * represents a position bonded to B, and the mark ** represents a position bonded to one free bonding hand of —$(Y{=}Z)_k$—.

In the formulae, the group represented by G' is an aliphatic group, an aromatic group or a heterocyclic group.

Among the groups represented by the formula (R-1), especially preferred groups are represented by the following formula (R-2) or (R-3):

(R-2)

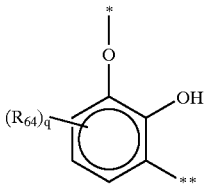

-continued (R-3)

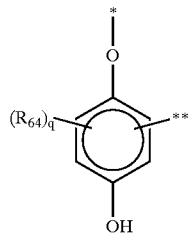

In the formulae, the mark * represents a position bonded to A of the general formula (I), and the mark ** represents a position bonded to z thereof.

$R_{64}$ represents a substituent, and q is an integer of 0 and 1 to 3. When q is 2 or greater, the two or more groups $R_{64}$ may be identical with or different from each other. When two groups $R_{64}$ are substituents on neighboring carbon atoms, they may be divalent groups and linked to each other to thereby form a cyclic structure. These groups are also comprehended in the present invention.

In the general formula (I), specifically, the group represented by Z can be selected from known bleaching accelerator groups. For example, it can be any of groups derived from various mercapto compounds as described in U.S. Pat. No. 3,893,858, GB No. 1,138,842 and JP-A-53-141623, the disclosures of which are incorporated herein by reference; compounds having disulfido bonds as described in JP-A-53-95630, the disclosure of which is incorporated by reference; thiazolidine derivatives as described in JP-B-53-9854, the disclosure of which is incorporated herein by reference; isothiourea derivatives as described in JP-A-53-94927, the disclosure of which is incorporated herein by reference; thiourea derivatives as described in JP-B-45-8506 and JP-B-49-26586, the disclosures of which are incorporated herein by reference; thioamide compounds as described in JP-A-49-42349, dithiocarbamic acid salts as described in JP-A-55-26506, the disclosure of which is incorporated herein by reference; and arylenediamine compounds as described in U.S. Pat. No. 4,552,834, the disclosure of which is incorporated herein by reference. In preferable instances, these compounds are bonded, at a substitutable hetero atom contained in the molecule thereof, with $A—(L)_k—$ of the formula (I).

The group represented by Z is preferably any of the groups represented by the following formula (V), (VI) and (VII).

(V)

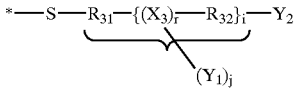

(VI)

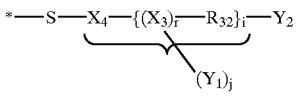

(VII)

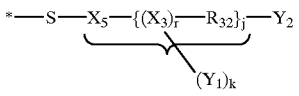

In the formulae, the mark * represents a position bonded to group $A—(L)_k—$, and $R_{31}$ represents a divalent aliphatic group having 1 to 8 carbon atoms, preferably 1 to 5 carbon atoms. $R_{32}$ represents the same group as represented by $R_{31}$, an aromatic group having 6 to 10 carbon atoms or a 3- to 8-membered, preferably 5- or 6-membered, divalent heterocyclic group. $X_3$ represents —O—, —S—, —COO—, $—SO_2—$, $—NR_{33}—$, $—NR_{33}—CO—$, $—NR_{33}—SO_2—$, —S—CO—, —CO—, $—NR_{33}—COO—$, $—N{=}CR_{33}—$, $—NR_{33}CO—NR_{34}—$ or $—NR_{33}SO_2NR_{34}—$. $X_4$ represents a divalent aromatic group having 6 to 10 carbon atoms, and $X_5$ represents a 3- to 8-membered, preferably 5- or 6-membered, divalent heterocyclic group having at least one carbon atom bonded to S in rings thereof. $Y_1$ represents a carboxyl group or its salt, a sulfo group or its salt, a hydroxyl group, a phosphonic acid group or its salt, an amino group (unsubstituted or substituted with an aliphatic group having 1 to 4 carbon atoms), $—NHSO_2—R_{35}$ or $—SO_2NH—R_{35}$ (these salts are, for example, sodium, potassium and ammonium salts). $Y_2$ represents the same group as represented by $Y_1$ or a hydrogen atom. r is 0 or 1, i is an integer of 0 to 4, j is an integer of 1 to 4, and k is an integer of 0 to 4. Provided, however, that j $Y_1$'s are bonded to substitutable positions of $R_{31}—\{(X_3)_r—R_{32}\}_i$ and $X_4—\{(X_3)_r—R_{32}\}_i$, and k $Y_1$'s are bonded to substitutable positions of $X_5—\{(X_3)_r—R_{32}\}_i$. When k and j are 2 or greater, respective k and j $Y_1$'s may represent identical or different groups. When i and j are 2 or greater, respective i and j $((X_3)_r—R_{32})$'s may represent identical or different groups. In these formulae, each of $R_{33}$, $R_{34}$ and $R_{35}$ represents a hydrogen atom or an aliphatic group having 1 to 8 carbon atoms, preferably 1 to 5 carbon atoms.

When each of $R_{31}$ to $R_{35}$ represents an aliphatic group, the aliphatic group may be in chain form or cyclic, linear or branched, saturated or unsaturated, and substituted or unsubstituted. Although an unsubstituted aliphatic group is preferred, the aliphatic group may be substituted with, for example, a halogen atom, an alkoxy group (e.g., methoxy or ethoxy) or an alkylthio group (e.g., methylthio or ethylthio) as a substituent.

The aromatic group represented by $X_4$ and, when $R_{32}$ is an aromatic group, represented thereby may have a substituent. This substituent may be, for example, any of those mentioned above with respect to the aliphatic group.

The heterocyclic group represented by $X_5$ and, when $R_{32}$ is a heterocyclic group, represented thereby is a saturated or unsaturated, substituted or unsubstituted, heterocyclic group containing an oxygen atom, a sulfur atom or a nitrogen atom as a hetero atom. For example, it can be any of pyridine, imidazole, piperidine, oxolane, sulfolane, imidazolidine, thiazepine and pyrazole groups. The substituent can be any of those mentioned above with respect to the aliphatic group. Specific examples of the groups represented by the formula (V) include the following groups:

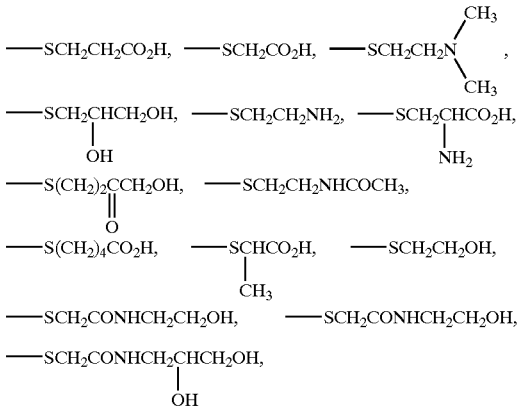

-continued

—$SCH_2CONHCH_2CH_2COOH$

Specific examples of the group represented by formula (VI) can be enumerated as follows:

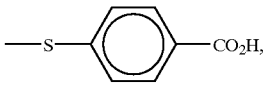

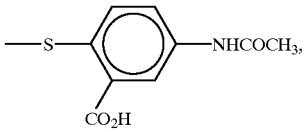

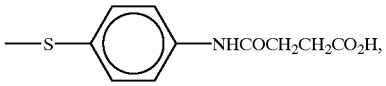

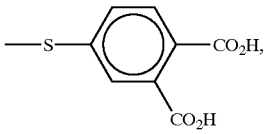

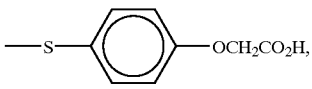

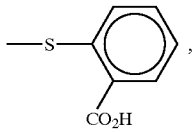

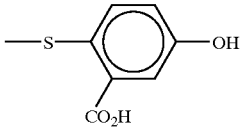

Specific examples of the group represented by formula (VII) can be enumerated as follows:

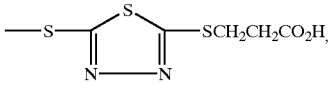

-continued

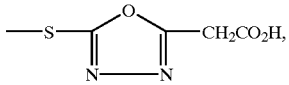

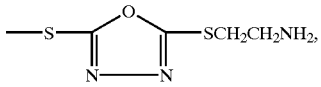

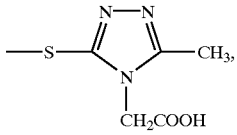

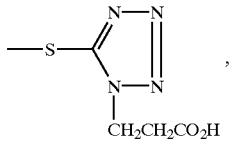

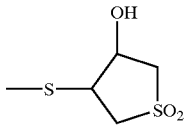

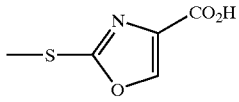

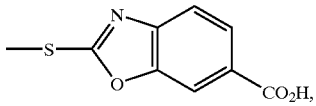

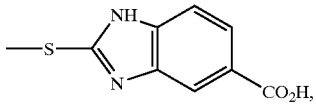

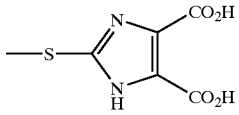

Specific examples of the compound represented by general formula (I) that are preferably used in the present invention are enumerated as follows, however, the present invention is not limited to these.

(1)

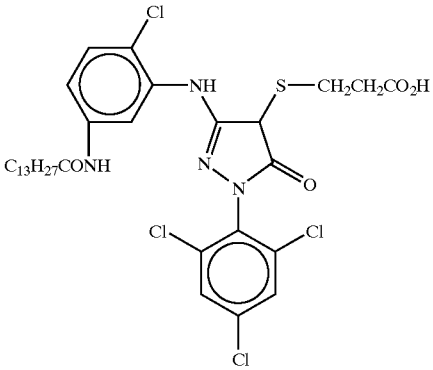

(2)

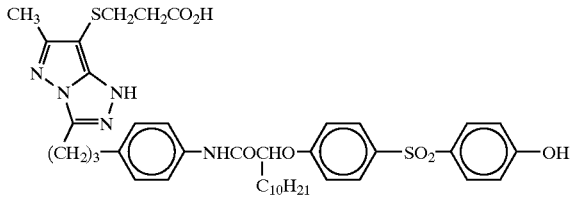

-continued
(3)
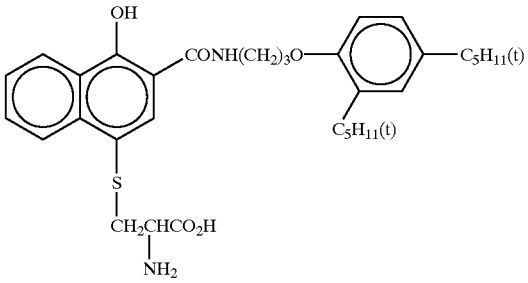
(4)
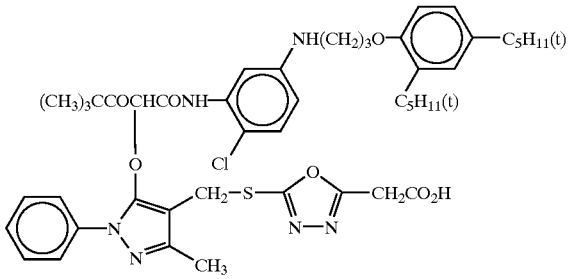
(5)
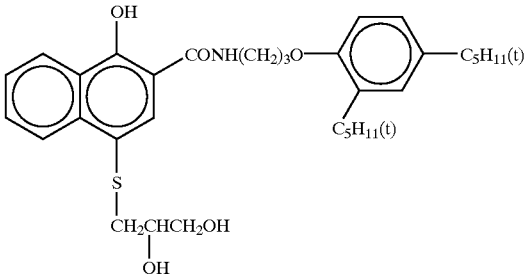
(6)
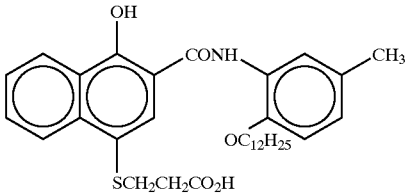
(7)
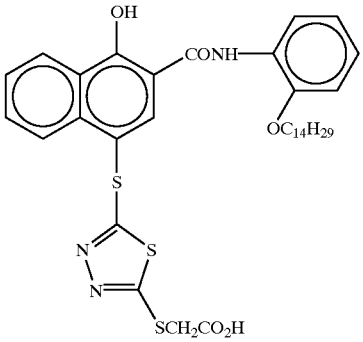
(8)
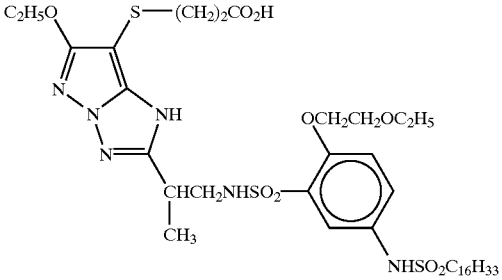
(9)
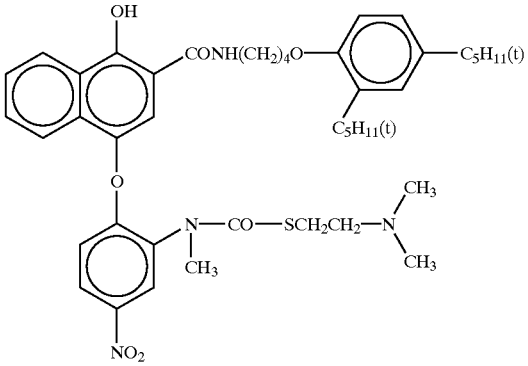
(10)
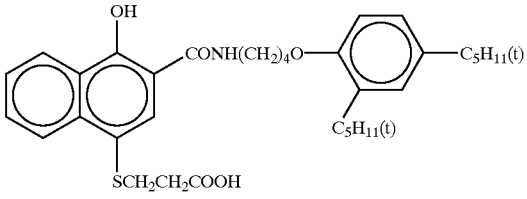

-continued
(11)
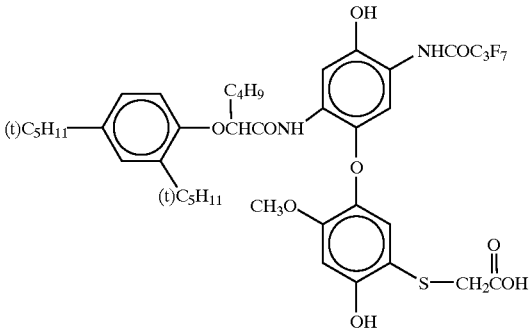
(12)
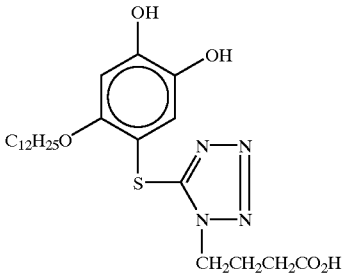
(13)
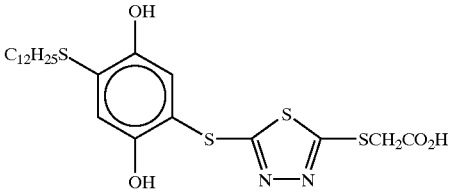
(14)
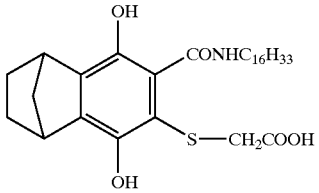
(15)
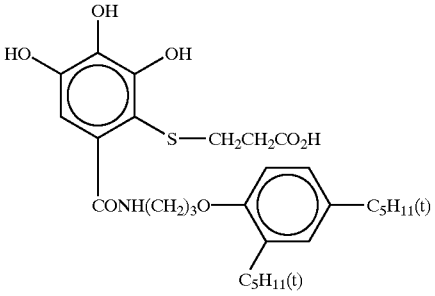
(16)
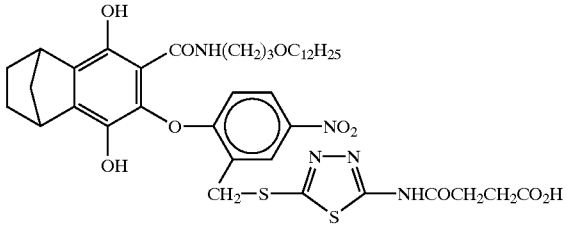
(17)
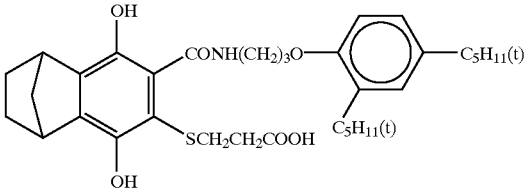
(18)
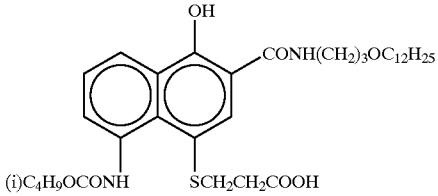
(19)
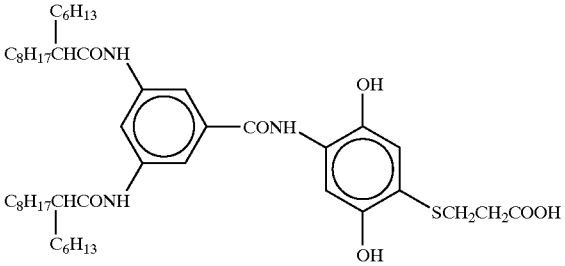
(20)
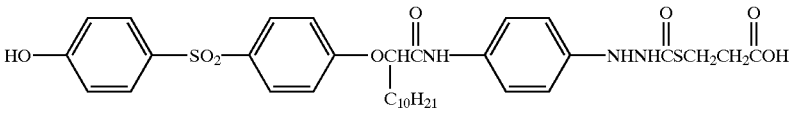

-continued (21)

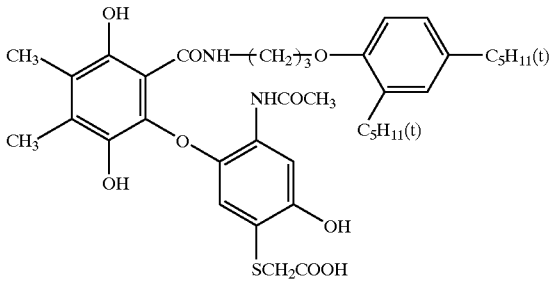

(22)

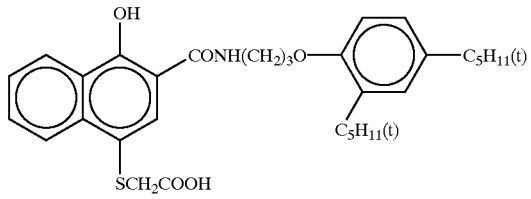

(23)

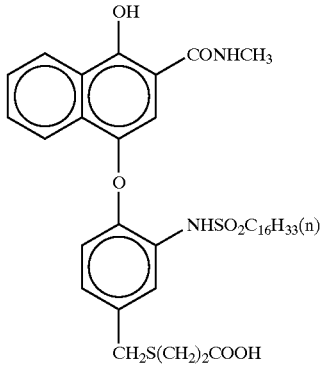

(24)

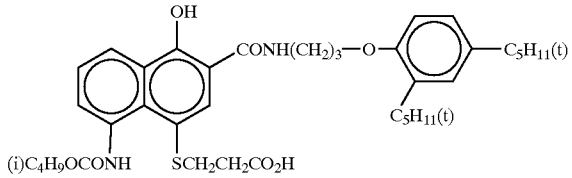

In addition to the above compounds, those compounds that are described in Research Disclosure Item Nos. 24241 and 11449, and JP-A's-61-201247, 63-106749, 63-121843, 63-121844, 63-214752 and 2-93454, the disclosures of which are incorporated herein by reference, can also be used similarly.

The compounds represented by general formula (I) of the invention can be synthesized easily based on the descriptions of the above patent specifications.

The compound represented by general formula (I) of the invention can be added at any layer of the lightsensitive material of the invention, but the compound can preferably be added to a lightsensitive silver halide emulsion layer or an adjacent layer thereof.

The use of the compound represented by formula (I) of the invention can improve desilvering as a result of bleach accelerating effect, thereby improve color reproduction. The use of the compound represented by formula (I) of the invention in a lightsensitive silver halide emulsion layer farther from the support, i.e., nearer to the exposure side, for example, a blue-sensitive layer, or an adjacent layer of the silver halide emulsion layer, in an amount smaller than the addition amount that can exert desilvering improving effect, can provide the lightsensitive material with stability with a small change of photographic property during a running processing of color developing processing.

The addition amount of the compound represented by formula (I) of the invention varies depending on the structure of the compound, but usually the addition amount is in the range of $5\times10^{-4}$ to 1.0 g/m$^2$, preferably, $1\times10^{-3}$ to $5\times10^{-1}$ g/m$^2$, more preferably $2\times10^{-3}$ to $2\times10^{-1}$ g/m$^2$.

The tabular grain used in the present invention preferably has an electron-capturing zone. The tabular grain is preferably contained in an emulsion, that contains tabular grains whose average aspect ratio is two or more, contained in the at least two emulsion sub-layers each having the highest speed.

The electron-capturing zone is a portion in which the concentration of an electron-capturing center compound to be an electron-capturing center (to be simply referred to as an "electron-capturing center" hereinafter) is $1\times10^{-5}$ to $1\times10^{-3}$ mol/mol local silver and which accounts for 5% to 30% of the grain volume. The concentration of the electron-capturing center is more preferably $5\times10^{-5}$ to $5\times10^{-4}$ mol/mol local silver. "Mol/mol local silver" used to define the concentration of an electron-capturing center is the concentration of an electron-capturing center with respect to a silver amount added simultaneously with the compound serving as the electron-capturing center.

The electron-capturing center concentration in the electron-capturing zone must be uniform. Uniform means that the electron-capturing center is introduced into a grain by a fixed amount per unit silver amount and that the electron-capturing center is introduced into a reaction vessel for grain formation at the same time silver nitrate used in grain formation is added. A halogen solution can also be simultaneously added. A compound serving as the electron-capturing center can be added as an aqueous solution. Alternatively, fine grains in which a compound serving as the electron-capturing center is doped or adsorbed can be prepared and added.

The electron-capturing zone can exist in any portion in a grain. Also, two or more electron-capturing zones can exist in a grain.

The electron-capturing center required to form the electron-capturing zone is represented by the following formulas:

$$[M(CN)_{x1}L_{(6-x1)}]^{n+} \quad \text{Formula I}$$

$$[M(CN)_{x2}L_{(4-x2)}]^{n+} \quad \text{Formula II}$$

$$[ML1_{x3}X_{(6-2x3)}]^{n+} \quad \text{Formula III}$$

$$[ML1_{(6-3i)\times1/3}L2_iX_{(6-3i)\times1/3}]^{n+} \quad \text{Formula IV}$$

wherein M represents an arbitrary metal or metal ion, and L represents a compound having chainlike or cyclic hydrocarbon as a parent body or a compound in which some carbon or hydrogen atoms of this parent structure are replaced by other atoms or atomic groups. L can be the same compound or different compounds. L1 represents an organic compound which bidentate-coordinates to a metal or metal ion, and L2 represents an organic compound which tridentate-coordinates to a metal or metal ion. X represents an arbitrary chemical species.

x1 represents an integer of 0 to 6, x2 represents an integer of 0 to 4, x3 represents 1, 2 or 3, and i represents 1 or 2.

When a six-coordinate octahedral complex is incorporated as a dopant in a silver halide grain, a portion of the silver halide grain is presumably replaced with the dopant by using $[AgX_6]^{5-}$ ($X^-$=halogen ion) in the grain as one unit, as described in many references such as J. Phys.: Condens. Matter 9 (1997) 3227–3240 and patent publications. Accordingly, if the molecular size of a complex to be doped is too large, this complex is probably unsuitable for a dopant. Also, as the electric charge of a complex to be doped deviates from −5, the complex presumably becomes disadvantageous for this replacement. From the consideration using a molecular model, when a complex to be doped has a 5- or 6-membered cyclic compound as a ligand, this complex presumably exceeds the size of a replacement unit in a silver halide grain, in the case of a silver chloride grain. However, it is considered that the complex is probably capable of being incorporated into a silver bromide grain because slight strain occurs in a lattice or in a complex molecule.

Preferable examples of a ligand are compounds such as pyrrole, pyrazole, imidazole, triazole, and tetrazole capable of having negative charge by removing $H^+$. The use of a derivative of such a compound as a ligand is also preferable. Examples of a substituent in the derivative are, preferably, a hydrogen atom, a substituted or nonsubstituted alkyl group (e.g., methyl, ethyl, n-propyl, isopropyl, n-butyl, t-butyl, hexyl, octyl, 2-ethylhexyl, dodecyl, hexadecyl, t-octyl, isodecyl, isostearyl, dodecyloxypropyl, trifluoromethyl, and methanesulfonylaminomethyl), an alkenyl group, an alkinyl group, an aralkyl group, a cycloalkyl group (e.g., cyclohexyl and 4-t-butylcyclohexyl), a substituted or nonsubstituted aryl group (phenyl, p-tolyl, p-anisyl, p-chlorophenyl, 4-t-butylphenyl, and 2,4-di-t-aminophenyl), halogen (fluorine, chlorine, bromine, and iodine), a cyano group, a nitro group, a mercapto group, a hydroxy group, an alkoxy group (e.g., methoxy, butoxy, methoxyethoxy, dodecyloxy, and 2-ethylhexyloxy), an aryloxy group (e.g., phenoxy, p-tolyloxy, p-chlorophenoxy, and 4-t-butylphenoxy), an alkylthio group, an arylthio group, an acyloxy group, a sulfonyloxy group, a substituted or nonsubstituted amino group (e.g., amino, methylamino, dimethylamino, anilino, and N-methylanilino), an ammonio group, a carbonamide group, a sulfonamide group, an oxycarbonylamino group, an oxysulfonylamino group, a substituted ureido group (e.g., 3-methylureido, 3-phenylureido, and 3,3-dibutylureido), a thioureido group, an acyl group (e.g., formyl and acetyl), an oxycarbonyl group, a substituted or nonsubstituted carbamoyl group (e.g., ethylcarbamoyl, dibutylcarbamoyl, dodecyloxypropylcarbamoyl, 3-(2,4-di-t-aminophenoxy) propylcarbamoyl, piperidinocarbonyl, and morpholinocarbonyl), a thiocarbonyl group, a thiocarbamoyl group, a sulfonyl group, a sulfinyl group, an oxysulfonyl group, a sulfamoyl group, a sulfino group, a sulfano group, carboxylic acid or its salt, sulfonic acid or its salt, and phosphonic acid or its salt.

A central metal of the electron-capturing center used in the present invention is not particularly restricted. However, a metal having a four-coordinate structure or a six-coordinate structure as a coordination structure around the metal is preferable. Also, a metal or metal ion having no unpaired electron or a metal all stabilized orbits of which are filled with electrons when the d orbit of the metal causes ligand field fission, is preferable. Plus divalent (+2) metal ions are preferred among other metal ions. It is particular preferable to use metal ions of alkali earth metals, iron(II), ruthenium(II), osmium(II), zinc, cadmium, and mercury. The use of metal ions of magnesium, iron(II), ruthenium(II), and zinc is most preferred.

Practical examples of a compound to be an electron-capturing center used in of the present invention will be presented below. However, compounds of the invention are not limited to these examples:

$[Fe(CN)_6]^{3-}$
$[Fe(CN)_4F_2]^{3-}$
$[Fe(CN)_4Cl_2]^{3-}$
$[Fe(CN)_5F]^{3-}$
$[Fe(CN)_5Cl]^{3-}$
$[Fe(CN)_5Br]^{3-}$
$[Fe(CN)_4Br_2]^{3-}$
$[Fe(CN)_5(SCN)]^{3-}$
$[Fe(CN)_5(H_2O)]^{2-}$
$[Fe(CN)_5F]^{4-}$
$[Fe(CN)_5Cl]^{4-}$
$[Fe(CN)_5Br]^{4-}$
$[Fe(CN)_5(SCN)]^{4-}$
$[Fe(CN)_5(NO)]^{4-}$
$[Fe(CN)_5(PZ)]^{3-}$
$[Fe(CN)_5(Im)]^{3-}$
$[Fe(CN)_5(trz)]^{3-}$
$[Ru(CN)_6]^{4-}$
$[Ru(CN)_4F_2]^{4-}$
$[Ru(CN)_4Cl_2]^{4-}$
$[Ru(CN)_4Br_2]^{4-}$
$[Ru(CN)_4I_2]^{4-}$
$[Ru(CN)_5(SCN)]^{4-}$
$[Ru(CN)_5(H_2O)]^{3-}$
$[Ru(CN)_5(PZ)]^{3-}$
$[Ru(CN)_5(Im)_2]^{3-}$
$[Ru(CN)_5(trz)]^{3-}$
$[Re(CN)_5F]^{4-}$
$[Re(CN)_5Cl]^{4-}$
$[Re(CN)_5Br]^{4-}$
$[Re(CN)_5I]^{4-}$
$[Re(CN)_4I_2]^{4-}$
$[Os(CN)_6]^{4-}$
$[Fe(CN)_5(SNC)]^{3-}$
$[Fe(CN)_5(NO)]^{3-}$
$[Fe(CN)_6]^{4-}$
$[Fe(CN)_4F_2]^{4-}$
$[Fe(CN)_4Cl_2]^{4-}$
$[Fe(CN)_4Br_2]^{4-}$
$[Fe(CN)_5(SCN)]^{4-}$
$[Fe(CN)_5(H_2O)]^{3-}$
$[Fe(CN)_4(PZ)_2]^{2-}$
$[Fe(CN)_4(Im)_2]^{2-}$
$[Fe(CN)_4(trz)_2]^{2-}$
$[Ru(CN)_5F]^{4-}$
$[Ru(CN)_5Cl]^{4-}$
$[Ru(CN)_5Br]^{4-}$
$[Ru(CN)_5I]^{4-}$
$[Ru(CN)_5(SCN)]^{4-}$
$[Ru(CN)_5(NO)]^{4-}$ $[Ru(CN)_4(PZ)_2]^{2-}$
$[Ru(CN)_4(Im)_2]^{2-}$
$[Ru(CN)_4(trz)_2]^{2-}$
$[Re(CN)_6]^{4-}$
$[Re(CN)_4F_2]^{4-}$
$[Re(CN)_4Cl_2]^{4-}$
$[Re(CN)_4Br_2]^{4-}$
$[Os(CN)_5F]^{4-}$
$[Os(CN)_4F_2]^{4-}$
$[Os(CN)_4Cl_2]^{4-}$
$[Os(CN)_4Br_2]^{4-}$
$[Os(CN)_4I_2]^{4-}$
$[Os(CN)_5(SCN)]^{4-}$
$[Os(CN)_5(H_2O)]^{3-}$
$[Os(CN)_5(PZ)]^{3-}$
$[Os(CN)_5(Im)]^{3-}$
$[Os(CN)_5(trz)]^{3-}$
$[Ir(CN)_5Cl]^{3-}$
$[Ir(CN)_5Br]^{3-}$
$[Ir(CN)_5I]^{3-}$
$[Ir(CN)_5(NO)]^{3-}$
$[Ir(CN)_5(H_2O)]^{2-}$
$[Pt(CN)_4]^{2-}$
$[Pt(CN)_4Br_2]^{2-}$
$[Au(CN)_4]^{-}$
$[Os(CN)_5Cl]^{4-}$
$[Os(CN)_5Br]^{4-}$
$[Os(CN)_5I]^{4-}$
$[Os(CN)_5(SCN)]^{4-}$
$[Os(CN)_5(NO)]^{4-}$
$[Os(CN)_4(PZ)_2]^{2-}$
$[Os(CN)_4(Im)_2]^{3-}$
$[Os(CN)_4(trz)]^{2-}$
$[Ir(CN)_6]^{3-}$
$[Ir(CN)_4Cl_2]^{3-}$
$[Ir(CN)_4Br_2]^{3-}$
$[Ir(CN)_4I_2]^{3-}$
$[Pt(CN)_4Cl_2]^{2-}$
$[Pt(CN)_4I_2]^{2-}$
$[Au(CN)_2Cl_2]^{2-}$ In the above metal complexes, PZ=pyrazole, Im=imidazole, and trz=triazole.

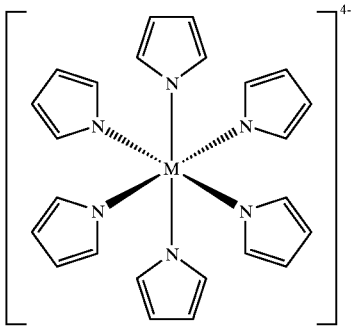

( M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)

-continued

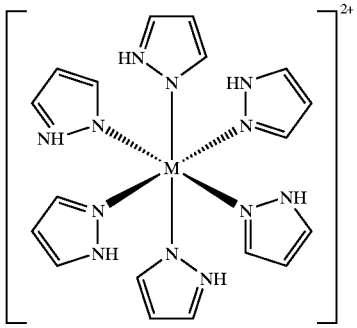

( M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)

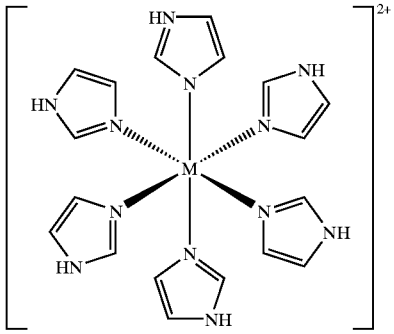

( M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)

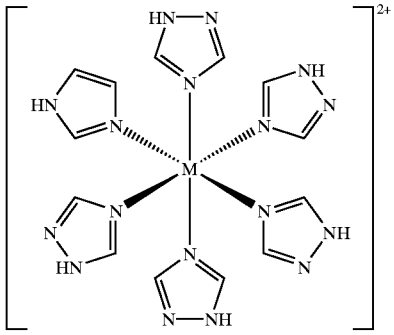

( M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)

-continued

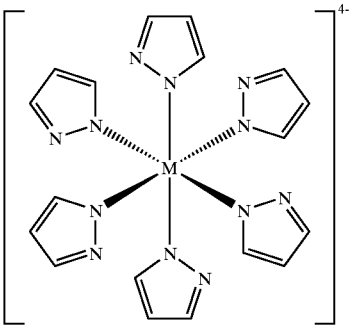

( M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)

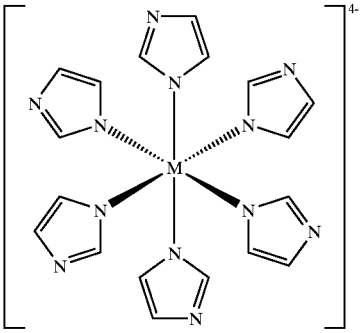

( M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)

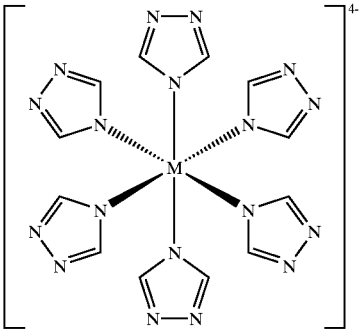

( M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)

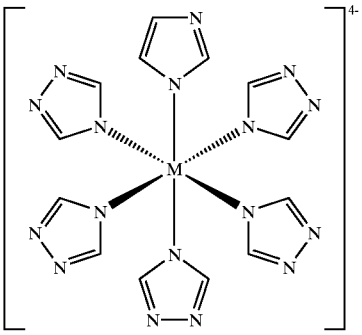

( M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)

-continued

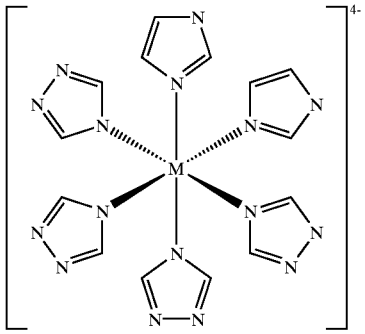

( M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)

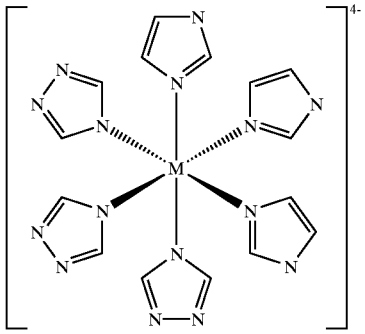

( M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)

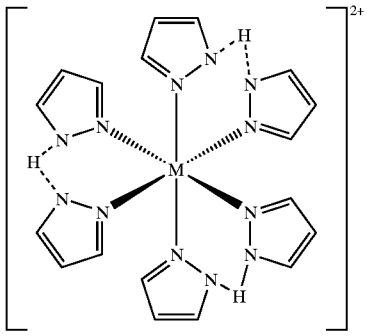

( M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)

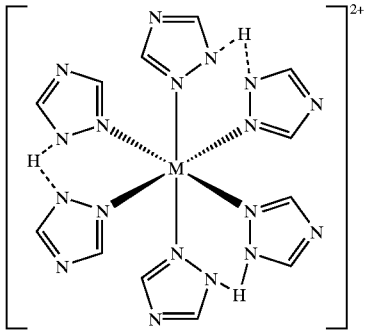

( M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)

-continued
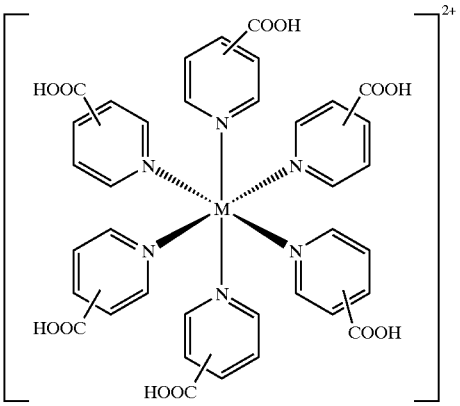
(M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)
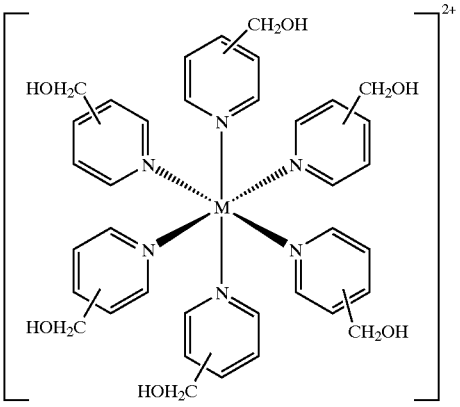
(M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)
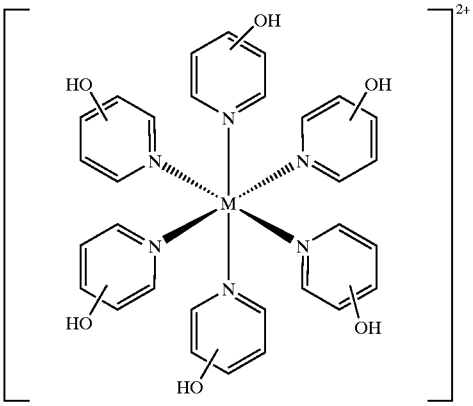
(M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)
-continued
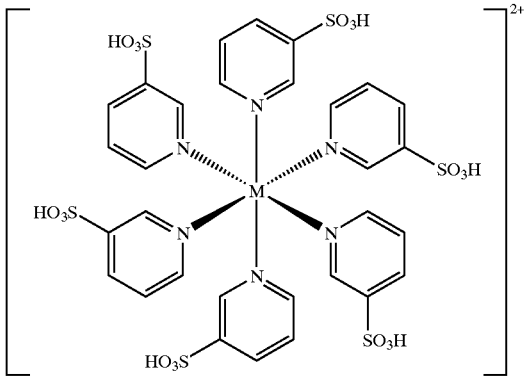
(M = $Mg^{2+}$, $Mn^{2+}$, $Fe^{2+}$, $Ru^{2+}$, $Co^{2+}$, $Ni^{2+}$, $Cu^{2+}$, $Zn^{2+}$, $Cd^{2+}$)
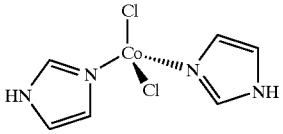
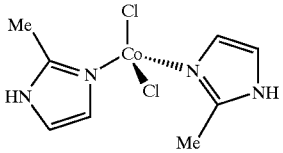
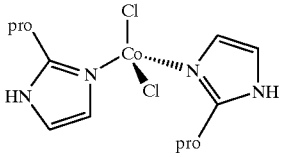
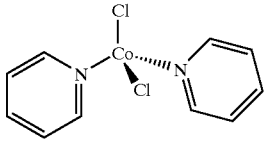
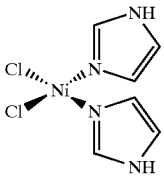
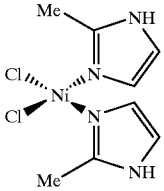
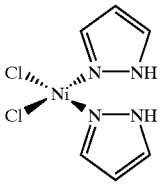
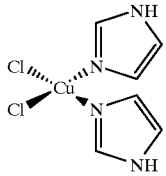
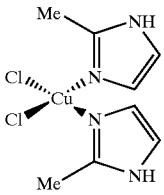
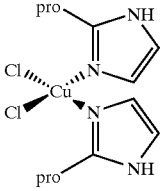

-continued
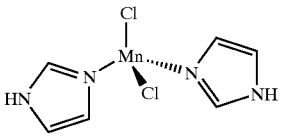
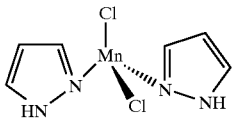
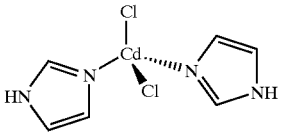
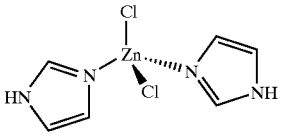
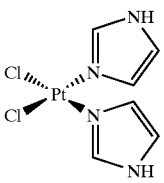
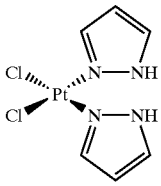
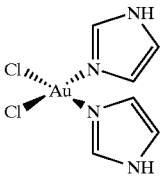
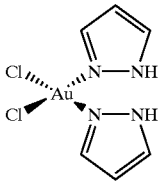
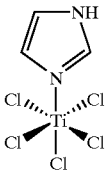
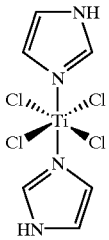
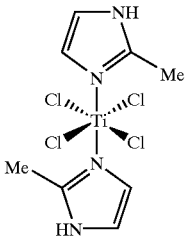
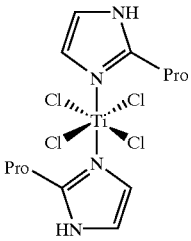
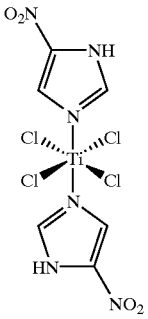
-continued
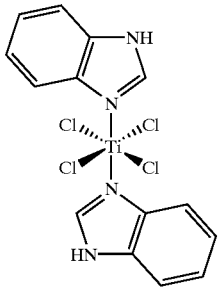
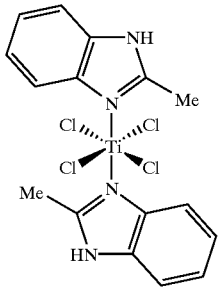
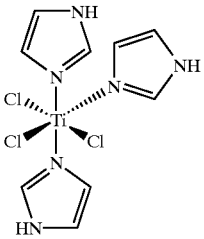
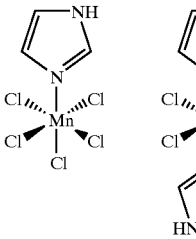
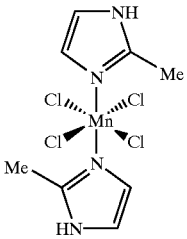
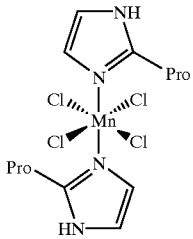
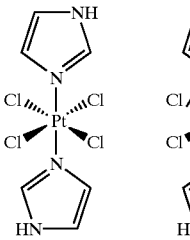
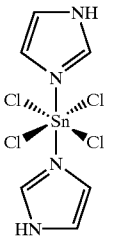
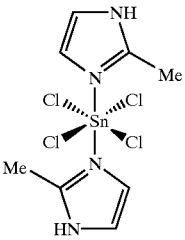
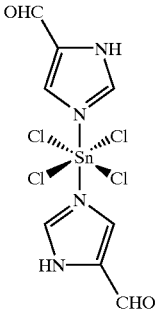
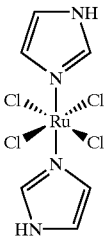
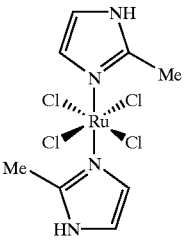
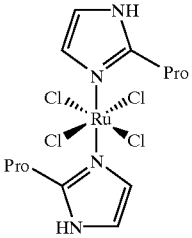
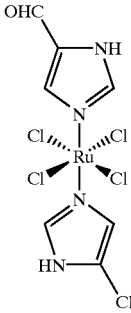
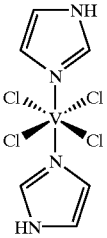

-continued

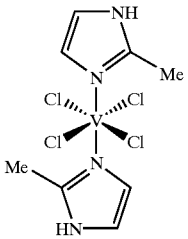

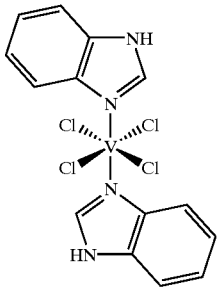

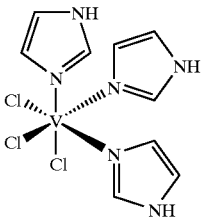

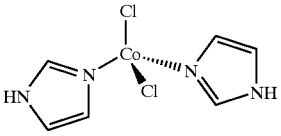

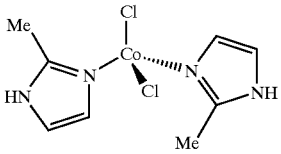

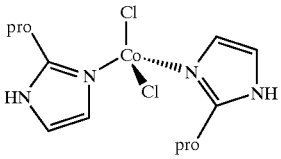

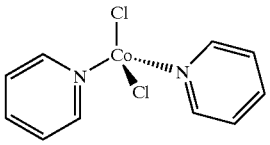

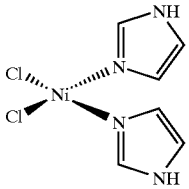

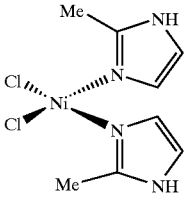

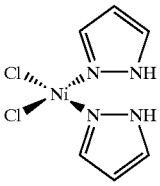

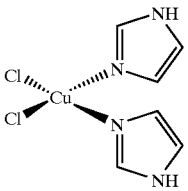

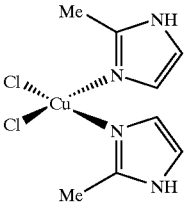

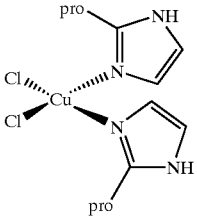

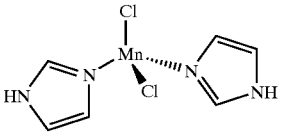

-continued

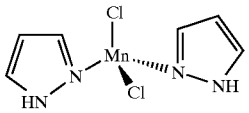

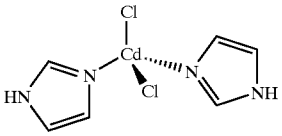

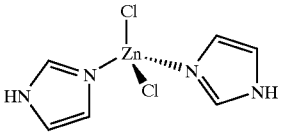

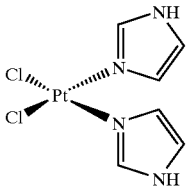

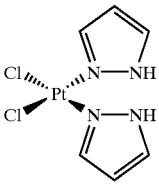

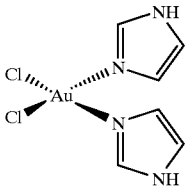

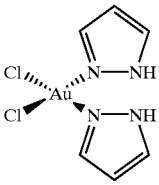

$[M(bpy)_3]^{2+}$

M = $Fe^{2+}$, $Ru^{2+}$, $Co^{2+}$
bpy = 2, 2′-bipyridine $[M(phenyl)_3]^{2+}$

M = $Fe^{2+}$, $Ru^{2+}$, $Co^{2+}$
phen = 1, 10-phenanthroline $[M(py)_3]^{2+}$ M = $Fe^{2+}$, $Ru^{2+}$, $Co^{2+}$
py = pyridine $[M(trpy)_2]^{2+}$ M = $Fe^{2+}$, $Ru^{2+}$, $Co^{2+}$
trpy = 2, 2′:5′, 2-terpyridine $[M(bpy)_2L_2]^{n+}$ M = $Fe^{2+}$, $Ru^{2+}$, $Co^{2+}$
bpy =2, 2′-bipyridine
n = 2, 1, 0
L = $Cl^-$, $CN^-$, $NH_3$, $H_2O$, CO, $H_2$, $CH_3CN$, 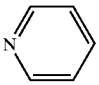

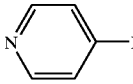

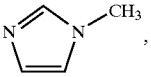

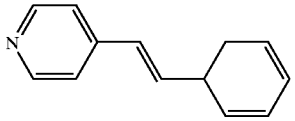

methyl-dipenyl-phosphine, butylamine

-continued
$[M(bpy)_2LL']^{n+}$
M = $Fe^{2+}$, $Ru^{2+}$, $Co^{2+}$
bpy =2, 2′-bipyridine
n = 2, 1, 0
L = $Cl^-$, 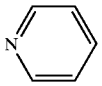
CN, 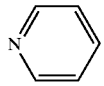
$CH_3CN$, $Cl^-$
CO, $Cl^-$
$H_2$, $Cl^-$
$[M(bpy)_2L]^{2+}$
M = $Fe^{2+}$, $Ru^{2+}$, $Co^{2+}$
bpy =2, 2′-bipyridine
L = 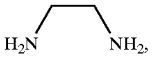 , 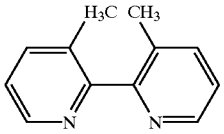 ,
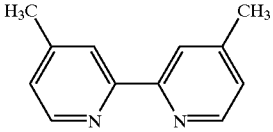
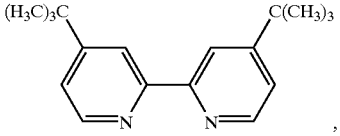 ,
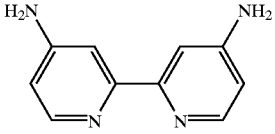
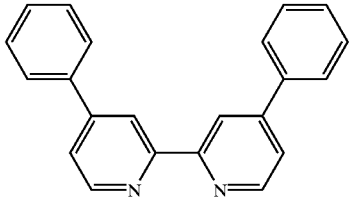 ,
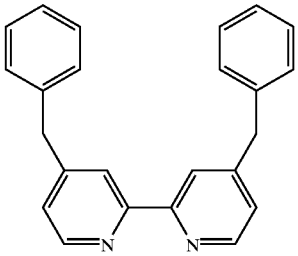
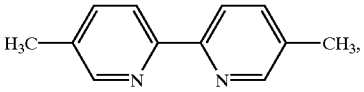 ,
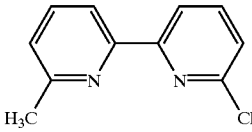
-continued
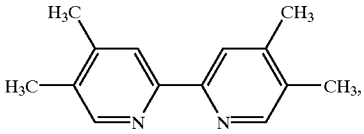 ,
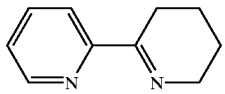
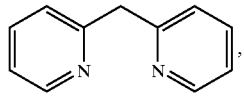 ,
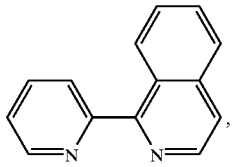 ,
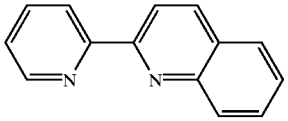
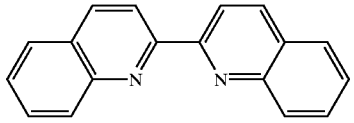 ,
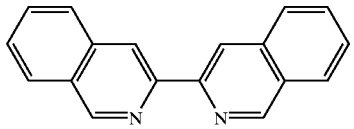 ,
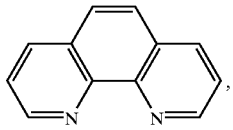 ,
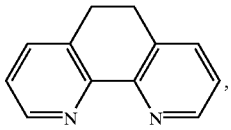 ,
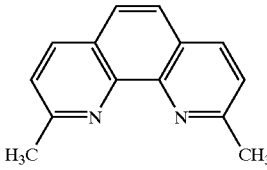 ,
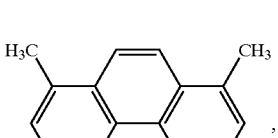
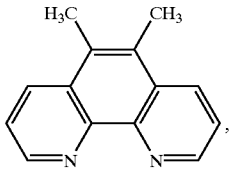 ,
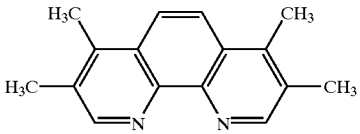
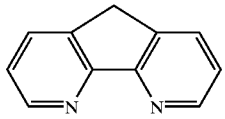 ,
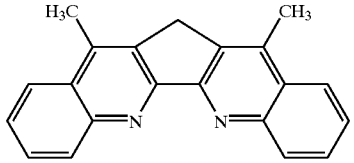
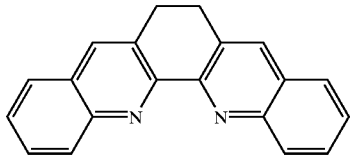 , -continued

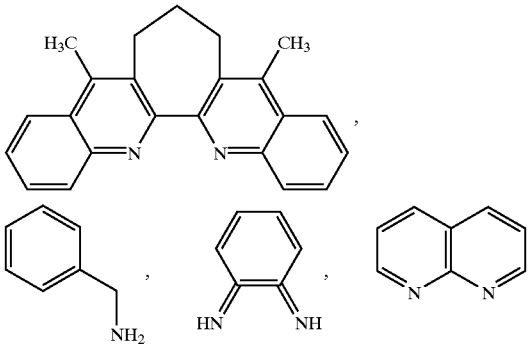

$[ML_2]^{2+}$

M = $Fe^{2+}$, $Ru^{2+}$, $Co^{2+}$

L = 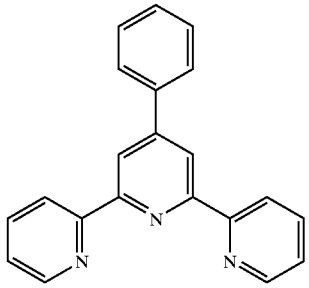

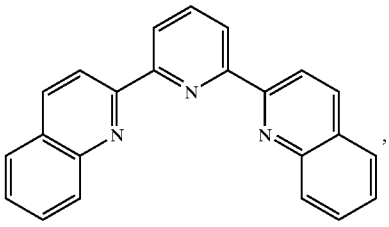

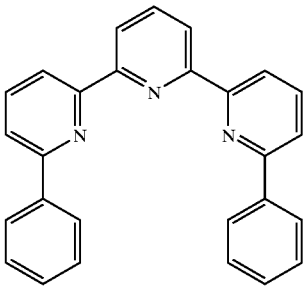

$[M(bpy)(phen)_2]^{2+}$

M = $Fe^{2+}$, $Ru^{2+}$, $Co^{2+}$
bpy = 2, 2′-bipyridine
phen = 1, 10-phenanthroline $[M(bpy)(phen)(py)]^{2+}$ M = $Fe^{2+}$, $Ru^{2+}$, $Co^{2+}$
bpy = 2, 2′-bipyridine
phen = 1, 10-phenanthroline
py = pyridine $[M(bpy)(py)(en)]^{2+}$ M = $Fe^{2+}$, $Ru^{2+}$, $Co^{2+}$
bpy = 2, 2′-bipyridine
py = pyridine
en = ehtylenediamine $[M(bpy)(py)(NH_3)]^{2+}$ M = $Fe^{2+}$, $Ru^{2+}$, $Co^{2+}$
bpy = 2, 2′-bipyridine
py = pyridine $[M(bpy)(trpy)L]^{2+}$ M = $Fe^{2+}$, $Ru^{2+}$, $Co^{2+}$
bpy = 2, 2′-bipyridine
trpy = 2, 2′:5′2″-terpyridine
L = $Cl^-$, $CN^-$, $NH_3$ In the present invention $H^+$ can be added to or removed from each ligand preferably used in the present invention.

In the present invention, a complex molecule completely dissociates from a counter ion and exists in the form of an anion or cation in an aqueous solution. Hence, a counter ion is not important for photographic properties. When a complex molecule becomes an anion and forms a salt together with a cation, this counter cation is preferably an alkali metal ion, such as sodium ion, potassium ion, rubidium ion, or cesium ion, ammonium ion, or alkyl ammonium ion represented by formula V below, each of which easily dissolves in water and is suited to precipitation of a silver halide emulsion.

$$[NR_1R_2R_3R_4]^+ \qquad \text{Formula V}$$

wherein each of $R_1$, $R_2$, $R_3$, and $R_4$ represents an arbitrary substituent selected from a methyl group, ethyl group, propyl group, iso-propyl group, and n-butyl group. In particular, tetramethylammonium ion, tetraethylammonium ion, tetrapropylammonium ion, and tetra(n-butyl) ammonium ion in which $R_1$, $R_2$, $R_3$, and $R_4$ are equal substituents are preferable. It is also preferable to use pyrazolium cation or imidazolium cation in which $H^+$ ion is added to a nitrogen atom not coordinated in a ligand as a counter cation.

When a complex molecule becomes a cation and forms a salt together with an anion, this counter anion is preferably a halogen ion, nitric acid ion, perchloric acid ion, tetrafluoroboric acid ion, hexafluorophosphoric acid ion, tetraphenylboric acid ion, hexafluorosilicic acid, or trifluoromethanesulfonic acid ion, each of which easily dissolves in water and suited to precipitation of a silver halide emulsion. If a strongly coordinating anion such as cyano ion, thiocyano ion, nitrous acid ion, or oxalic acid ion is used as a counter anion, it is highly likely that this counter anion causes a ligand exchange reaction with a halogen ion used as a ligand of a complex to make it impossible to hold the composition and structure of a complex of the present invention. Hence, the use of these anions is unpreferable.

A metal complex used in the present invention can be synthesized by several methods. For example, a magnesium complex, an iron complex, and a zinc complex having pyrazole or imidazole as a ligand can be obtained by reacting the pyrazole or imidazole as a ligand with perchlorate or tetrafluoroborate of each metal in a dehydrated solvent. As practical synthesis examples, synthesizing methods of these complexes are described in Rec. Trav. Chim., 1969, 88, 1451. Also, a ruthenium-triazole complex can be synthesized by referring to the reaction of a ruthenium-triazole complex described in Inorg. Chim. Acta 1983, 71, 155.

Compounds represented by general formula (VI) as follows can also be used as the electron-capturing center required to form the electron-capturing zone.

$$[L'_nM(L(ML'_m)_j)_k]^p \qquad \text{Formula VI}$$

wherein M represents an arbitrary metal or metal ion. M can be the same metal species or different metal species. L is a crosslinking ligand and represents an organic compound capable of crosslinking two or more metals or metal ions. L' represents a non-charge small molecule which is $H_2O$, $NH_3$, CO, $N_2$, $NO_2$, $CO_2$, $SO_2$, $SO_3$, $N_2H_4$, $O_2$, or $PH_3$, an arbitrary organic compound, or an arbitrary inorganic anion, all of which can be the same chemical species or different chemical species. Each of n and m represents an integer of 1 to 5; j represents a positive integer; k represents an integer of 1 or 5; and p represents a positive or negative arbitrary integer or O.

As indicated in, for example, Bulgarian Chem. Commun., 20 (1993) 350–368, Radiat. Eff. Defects Solids 135 (1995)

101–104 and J. Phys.: Condens. Matter, 9 (1997) 3227–3240, the doping with a 6-cyano complex introduces a shallow electron trap by Coulomb field in silver halide grains. Especially when a divalent metal ion of $d^6$ low spin such as $Fe^{2+}$ or $Ru^{2+}$ is used as a central metal, as indicated in ICPS, 1998, Final program and Proceedings, Vol. 1, p.89, ICPS, 1998, Final program and Proceedings, Vol. 1, p.92 and JP-A-8-286306, a photoelectron trap with an appropriate depth due to Coulomb field is introduced by introducing a +1 excess charge in an environment of grains composed of $Ag^+$ and a halide anion. As a result, the period from generation of photoelectrons caused by exposure to deactivation thereof is prolonged to thereby enable a striking increase of photographic sensitivity. During the period, cyanide ions employed as a ligand bring on a strong ligand field effect. That is, a π-bond is formed by donation (back donation) of an electron from the metal to the ligand. This π-bond brings on a further stabilization of $t_{2g}$-orbital, a reduction of the metal/ligand distance and an increase of effective positive charges of metal ions, thereby realizing exertion of an effect of extremely increasing the division of metal d-orbital. By virtue of this effect, the $e_g$-orbital of doped complex (being the lowest unoccupied orbital of complex) has an energy which is higher than that of the bottom of the conductive band of silver halide and thus assumes a level which has no relation to electron capture. In this situation, first, a shallow electron trap by Coulomb field can be created in the vicinity of the dopant. It is generally known that heterocyclic compounds, especially 1,10-phenanthroline and 2,2'-bipyridine, bring on a ligand field effect relatively close to that of a cyano complex at the time of complex formation. Thus, it is presumable that the doping with such a complex, like the 6-cyano complex, would enable placing the $e_g$-orbital composed of metal ion orbitals in an energy level which is higher than that of the bottom of the conductive band of silver halide. Further, in the use of these heterocyclic compounds, although it may occur that the π*-orbital of ligand assumes an energy level which is lower than that of the $e_g$-orbital of metal to thereby become the lowest unoccupied orbital, this energy level is also presumed as being higher than that of the bottom of the conductive band of silver halide.

With respect to the silver nucleus formation in silver halide grains, it can be presumed that, like the impurity band in semiconductors, freer movement of photoexcited electrons in a wide range leads to efficient silver nucleation. Actually in the experiment of ENDOR described in J. Phys.: Condens. Matter, 9 (1997) 3227–3240, with respect to the emulsion doped with yellow prussiate of potash, the yellow prussiate of potash doping concentration zone at which signals from electrons presumed as having been captured by an impurity band become observable agrees with the concentration zone at which a clear sensitivity enhancement is realized. The state of such a shallowly captured electron can be described by the effective mass approximation, and a hydrogen atom can be considered as a model. Therefore, it can be anticipated that an increase of the radius of field where the electron is bound (radius of the hydrogen atom model described by the effective mass approximation) will lead to a greater sensitivity increase. From this viewpoint, it is preferred that the size of the complex employed as the dopant be increased. In this respect, it is presumable that the use of a binuclear complex is preferred to the use of a mononuclear complex, and the use of a further polynuclear complex is more preferred thereto.

When complex molecules are incorporated in silver halide grains, as described in J. Phys.: Condens. Matter, 9 (1997) 3227–3240 and other literature and patents, it is contemplated that $[AgX_6]^{5-}$ (X=halide ion) constituting partial unit of silver halide grains is replaced by a complex molecule to thereby cause the central metal to occupy the lattice position of $Ag^+$ ion, with the lattice positions of halide ion occupied by the ligands thereof. Upon extension of this contemplation, it is anticipated that a binuclear or further polynuclear complex will replace silver halide units such as $[Ag_2X_{11}]^{9-}$, $[Ag_3X_{16}]^{13-}$, etc. Moreover, from a study based on a molecular model, it is assumed that the binuclear complex of iron $[(NC)_5Fe(m\text{-}4,4'\text{-bipyridine})Fe(CN)_5]^{6-}$ described in U.S. Pat. No. 5,360,712 will replace the $[X_5Ag—X—Ag—X—AgX_5]^{9-}$ unit in silver halide grains. Thus, it is expected from these that, when complex molecules are incorporated in a silver halide, a replacement with some flexibility will occur. However, using extremely large complex molecules as a dopant would not be advantageous from the viewpoint of replacement and hence is presumed to be unfavorable. Therefore, among the polynuclear complexes, one preferably employed in the doping would be a binuclear or trinuclear complex.

In the present invention, the terminology "organic compound" refers to a compound comprising a chain or cyclic hydrocarbon as a matrix structure, or a compound wherein carbon or hydrogen atoms constituting part of the matrix structure are replaced by other atoms or atom groups. The ligand for effecting metal-metal crosslinking is preferably an organic compound, especially a compound which bidentately coordinates with a metal or a compound which can accept d-electrons from a metal in the p*-orbital having, as a coordination atom, a N atom forming a double or triple bond or a N atom, P atom, S atom, etc. in an aromatic ring (capable of forming a back donating bond). That is, the crosslinking ligand is preferably a compound which can be strongly bonded to a metal ion, more preferably a compound which, at the bonding, exerts a strong ligand field effect.

Moreover, other ligands also preferably consist of the same organic compound as employed in the crosslinking ligand, especially a compound which bidentately coordinates with a metal or a compound which can form a back donating bond with a metal. Further, these ligands preferably have a negative charge. The reason would be that, in the contemplation of the incorporation of the complex in silver halide grains, the organic compound as a ligand replaces a halide ion inherently having a negative charge, thereby realizing a closeness, in respect of charge, to the replaced unit of silver halide. However, in the contemplation of the aforementioned electron capture in an extremely wide range, the use of a ligand having no charge contrarily is also preferable. For obtaining an appropriate shallow electron trap by means of a dopant, it would be preferable that the charge distribution in molecules used as the dopant be limited so as to avoid any electron localization in the electron trap. When, within the ligand, there are donor sites, other than the donor site to the central metal, by means of a hetero atom or a substituent, the possibility of polarization within the ligand is high, and hence the possibility of being unsuitable for the electron capture with a uniform loose binding force is presumable. Furthermore, it would also be preferable for the dopant ligand to be a chargeless compound, when the molecular size of ligand is increased so that the replacement of ligand portion extends to not only the halide ion position but also the silver ion neighboring thereto. Although currently both the use of an organic compound having a negative charge as a ligand and the use of a chargeless organic compound as a ligand greatly contribute to a sensitivity enhancement and it cannot be stated which is superior, it can fairly be stated that an organic compound, especially a complex having an aromatic compound or a heterocyclic compound as a ligand, more especially, taking a ligand field effect into account, a compound which bidentately or tridentately coordinates with a metal ion, is preferred as a sensitivity increasing dopant.

In the present invention, the crosslinking ligand preferably consists of, for example, any of compounds comprising a saturated or unsaturated hydrocarbon as a fundamental skeleton, such as oxalic acid, malonic acid, succinic acid, glutaric acid, adipic acid, tartaric acid, meso-2,3-dimercaptosuccinic acid, 1,2,3,4-cyclobutanetetracarboxylic acid, oxamide, oxamic acid, malonamide, succinamide, adipamide, dithiooxamide, 1,1,3,3-propanetetracarbonitrile, tetracyanoethylene, diaminomalonitrile, 1,2,4,5-benzenetetramine and 1,2,4,5-benzenetetracarboxylic acid. Of these, small molecules such as oxalic acid, malonic acid, oxamide and oxamic acid are more preferred. It is also preferred that $H^+$ be eliminated from the group OH of an alcohol or phenol to thereby cause the moiety $—O^-$ to crosslink two metals or metal ions.

On the other hand, the heterocyclic compound employed as the crosslinking ligand is preferably selected from pyrazole, imidazole, triazole, tetrazole, oxazole, isoxazole, thiazole, thiadiazole, thiatriazole, tetrathiafulvalene, 4,4'-bipyridine, 4-hydroxypyridine, isonicotinic acid, 4-cyanopyridine, pyridazine, pyrimidine, pyrazine, 2,3-bis(2-pyridyl)pyrazine, 2,5-bis(2-pyridyl)pyrazine, triazine, 2,2'-bipyrimidine, 2,2'-imidazole, 2,2'-benzimidazole and derivatives thereof containing these as backbones. Of these heterocyclic compounds, pyrazole, 4,4'-bipyridine, pyrazine, 2,3-bis(2-pyridyl)pyrazine, 2,5-bis(2-pyridyl)pyrazine, 2,2'-bipyrimidine, 2,2'-imidazole and 2,2'-benzimidazole are more preferred.

It is preferred from the viewpoint of the degree of a ligand field effect as mentioned above that the other ligands consist of an aromatic compound or a heterocyclic compound. The aromatic compound is preferably one having respective substituents, which provide coordination sites, at two neighboring carbon atoms thereof. Specifically, the aromatic compound can be, for example, any of veratrol, catechol, (+/−)-hydrobenzoin, 1,2-benzenedithiol, 2-aminophenol, o-anisidine, 1,2-phenylenediamine, 2-nitronaphthol, 2-nitroaniline and 1,2-dinitrobenzene. Instead of the above compound having respective substituents, which provide coordination sites, bonded to two neighboring carbon atoms thereof, an aromatic compound having two substituents, which provide coordination sites, arranged with such a distance that the two substituents can coordinate with a single metal can also preferably be employed. This aromatic compound can be, for example, any of benzyl, 1,8-dinitronaphthalene and 1,8-naphthalenediol.

With respect to the heterocyclic compound capable of monodentate coordination, it is preferred that, as a hetero atom, an oxygen atom, a sulfur atom, a selenium atom, a tellurium atom or a nitrogen atom be contained in the ligand. It is also preferred that a phosphorus atom be contained in the ligand. The monodentate ligand can preferably be, for example, any of furan, thiophenine, 2H-pyrrole, pyran, pyridine and derivatives thereof. The heterocyclic compound capable of bidentately or tridentately coordinating with a metal or a metal ion is preferably a multiple-ring heterocyclic compound comprising heterocyclic compounds capable of monodentate coordination linked to each other. For example, it is preferably any of the compounds obtained by linking of the above-mentioned preferred monodentate ligands. In particular, the bidentate ligand is preferably 2,2'-bithiophene, 2,2'-bipyridine or a derivative thereof. The tridentate ligand is preferably 2,2':5',2"-terthiophene, 2,2':5',2"-terpyridine or a derivative thereof. Further, preferred use is made of 2,2'-biquinoline, 1,10-phenanthlorine or a derivative thereof, comprising a skeleton of the above bidentate ligands accompanied by a condensed ring. Still further, compounds capable of bonding with metal ions at more than tridentate coordination sites are preferably used as the ligand other than the crosslinking ligand. For example, crown ethers such as 18-crown-6 and 1,4,8,11-tetrazacyclotetradecane are preferably employed.

Substituents of these derivatives are preferably selected from a hydrogen atom, a substituted or unsubstituted alkyl group (for example, methyl, ethyl, n-propyl, isopropyl, n-butyl, t-butyl, hexyl, octyl, 2-ethylhexyl, dodecyl, hexadecyl, t-octyl, isodecyl, isostearyl, dodecyloxypropyl, trifluoromethyl or methanesulfonylaminomethyl), an alkenyl group, an alkynyl group, an aralkyl group, a cycloalkyl group (for example, cyclohexyl or 4-t-butylcyclohexyl), a substituted or unsubstituted aryl group (for example, phenyl, p-tolyl, p-anisyl, p-chlorophenyl, 4-t-butylphenyl or 2,4-di-t-aminophenyl), a halogen (fluoro, chloro, bromo or iodo), a cyano group, a nitro group, a mercapto group, a hydroxy group, a alkoxy group (for example, methoxy, butoxy, methoxyethoxy, dodecyloxy or 2-ethylhexyloxy), an aryloxy group (for example, phenoxy, p-tolyloxy, p-chlorophenoxy or 4-t-butylphenoxy), an alkylthio group, an arylhtio group, an acyloxy group, a sulfonyloxy group, a substituted or unsubstituted amino group (for example, amino, methylamino, dimethylamino, anilino or N-methylanilino), an ammonio group, a carbonamido group, a sulfonamido group, an oxycarbonylamino group, an oxysulfonylamino group, a substituted ureido group (for example, 3-methylureido, 3-phenylureido or 3,3-dibuytlureido), a thioureido group, an acyl group (for example, formyl or acetyl), an oxycarbonyl group, a substituted or unsubstituted carbamoyl group (for example, ethylcarbamoyl, dibutylcarbamoyl, dodecyloxypropylcarbamoyl, 3-(2,4-di-t-aminophenoxy) propylcarbamoyl, piperidinocarbonyl or morpholinocarbonyl), a thiocarbonyl group, a thiocarbamoyl group, a sulfonyl group, a sulfinyl group, an oxysulfonyl group, a sulfamoyl group, a sulfino group, a sulfano group, a carboxylic acid or a salt thereof, a sulfonic acid or a salt thereof and a phosphonic acid or a salt thereof. It is also preferable that $R_2$ and $R_3$ are cyclized to thereby form a saturated carbon ring, an aromatic carbon ring or a hetero aromatic ring.

Although the central metal is not particularly limited in the present invention, as described in J. Phys.: Condens. Matter, 9 (1997) 3227–3240 and many other documents and patents, those central metals which cause the coordinate structure around a metal to be a planar four-coordinate structure or six-coordinate structure are preferred from the viewpoint that, when a six-coordinate octahedral complex is incorporated as a dopant in silver halide grains, replacement of part of the grains by the dopant is carried out with one unit constituted by the $[AgX_6]^{5-}$ ($X^-$=halide ion) in silver halide grains. More preferably, use is made of those central metals wherein the metal or metal ion has no unpaired electron, or wherein, when the d-orbital of metal has undergone a ligand field division, all stabilized orbitals are filled with electrons. For example, preferred central atoms are metal ions of alkaline earth metals, iron, ruthenium, manganese, cobalt, rhodium, iridium, copper, nickel, palladium, platinum, gold, zinc, titanium, chromium, osmium, cadmium and mercury. More preferred central atoms are iron, ruthenium, manganese, cobalt, rhodium, iridium, titanium, chromium and osmium. Most preferred central atoms are ions of iron, ruthenium and cobalt.
Specific examples of the complexes according to the present invention will be indicated below, which, however, in no way limit the compounds of the present invention.
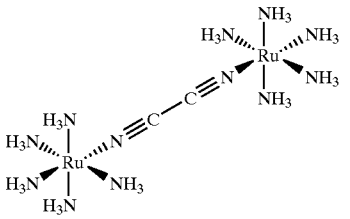
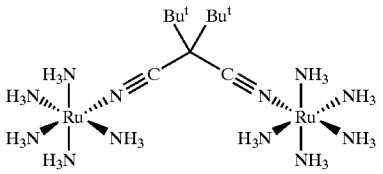
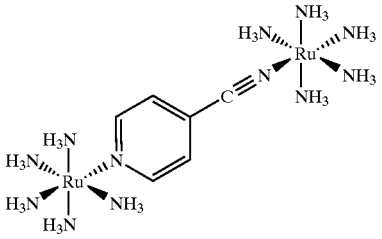
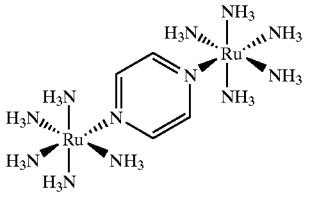
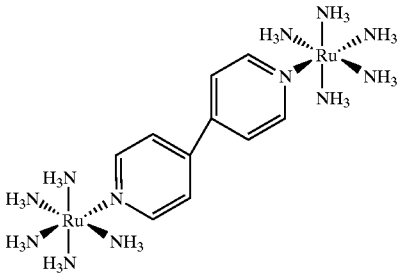
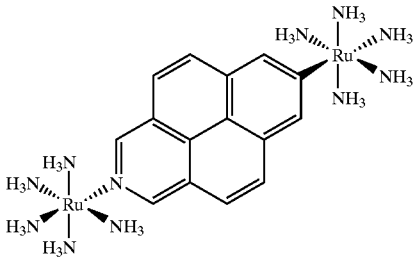
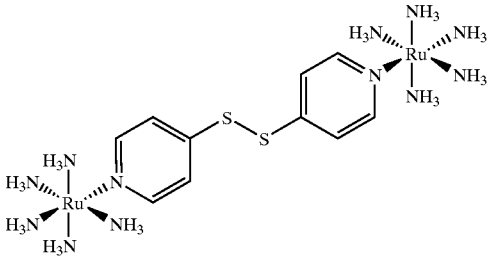
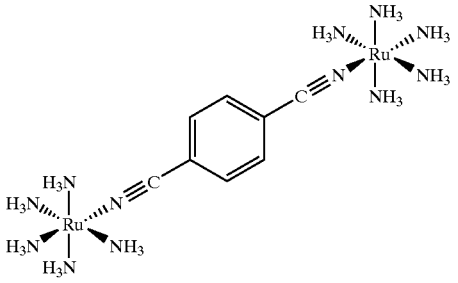
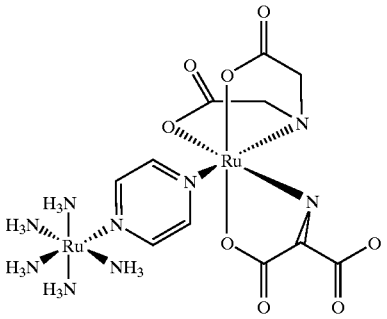
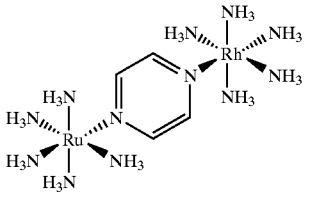
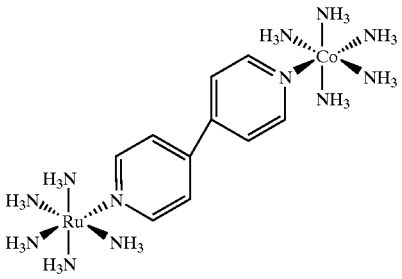
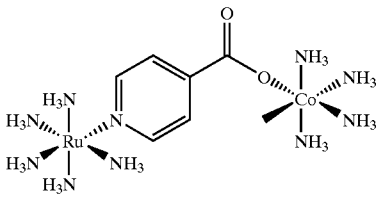

-continued
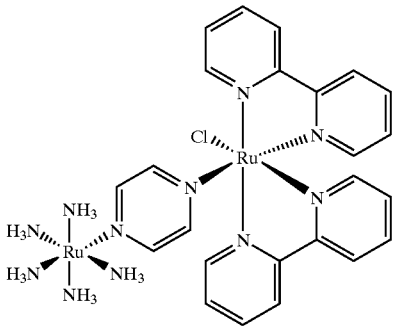
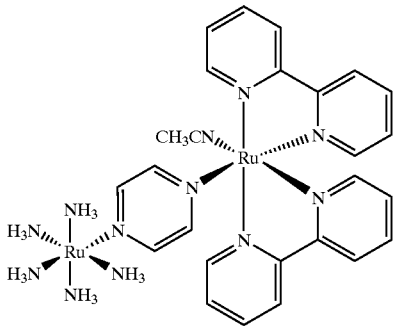
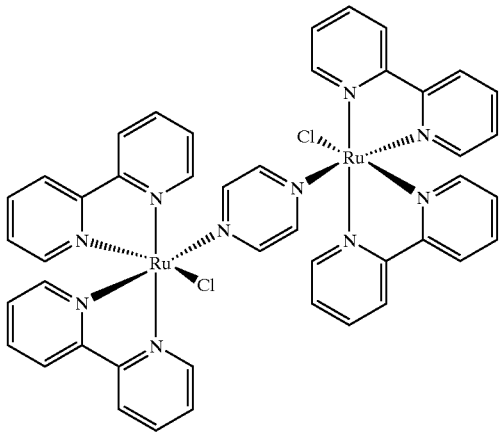
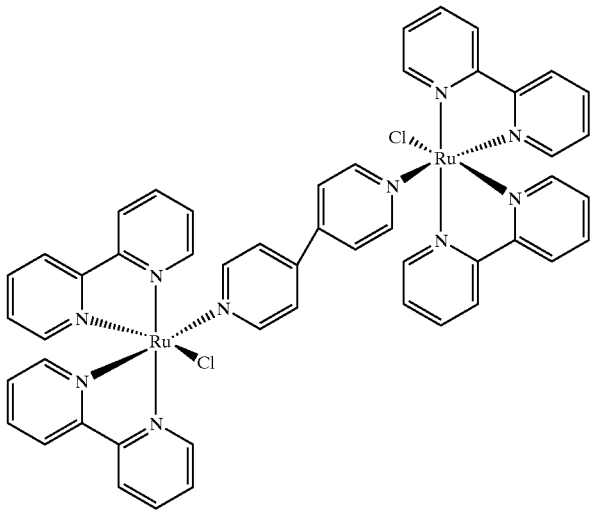

-continued
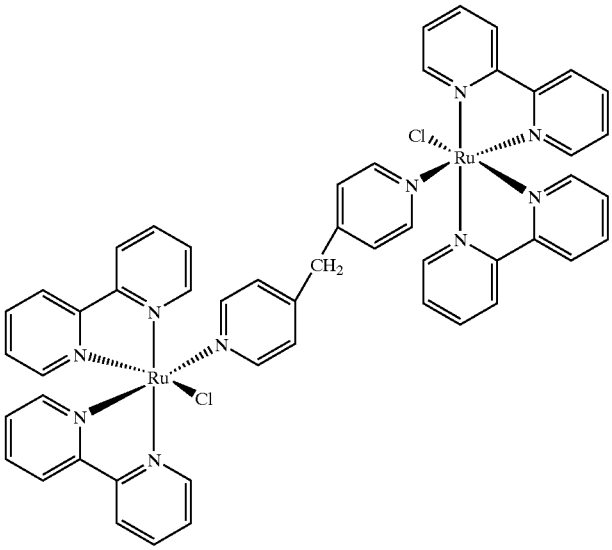
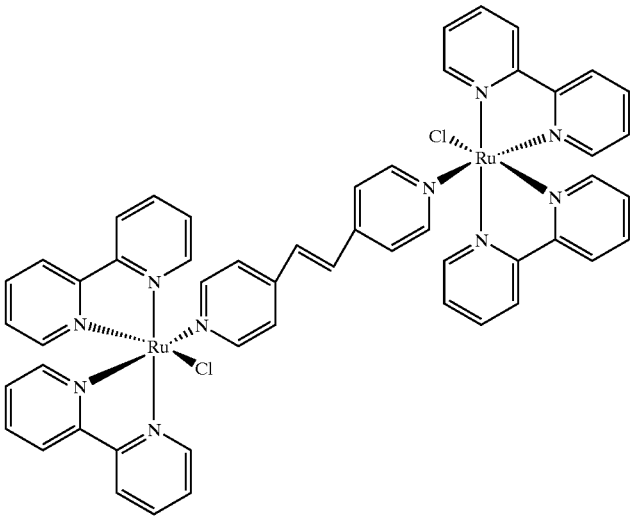
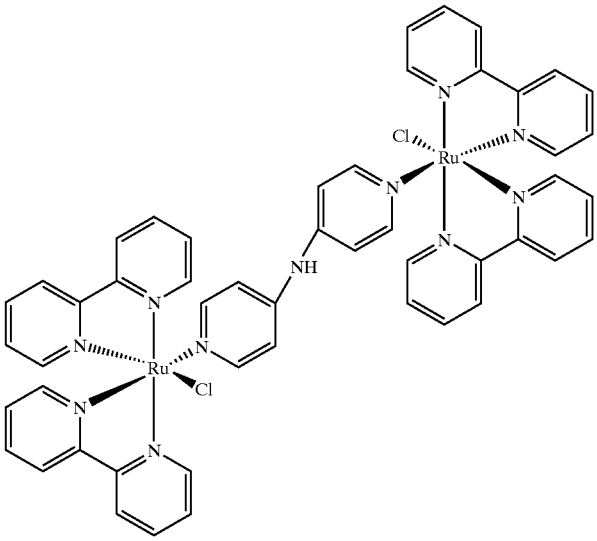

-continued
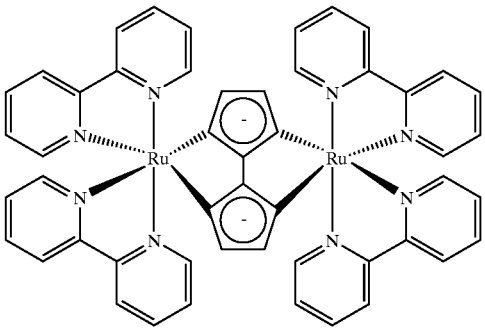
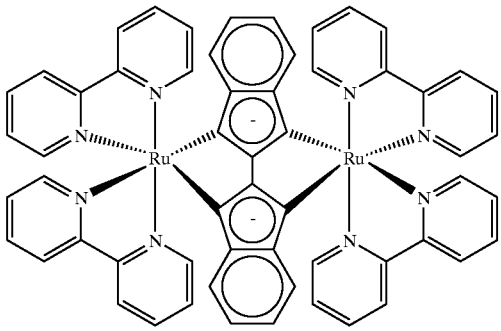
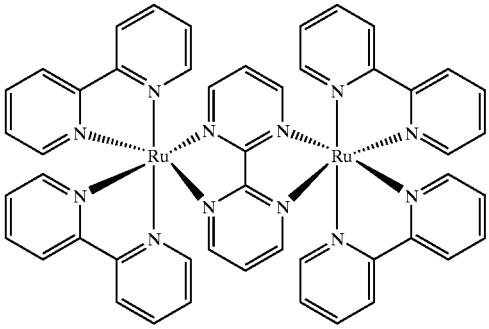
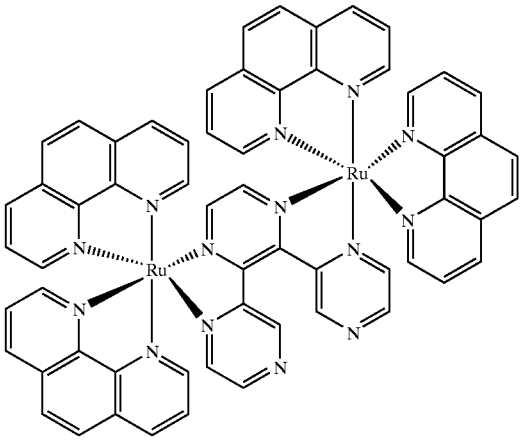
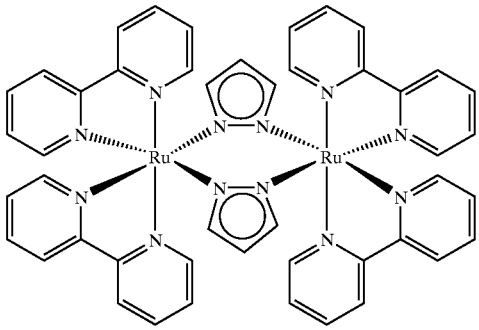
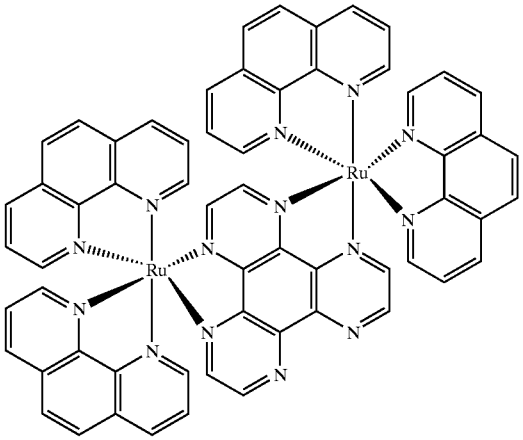
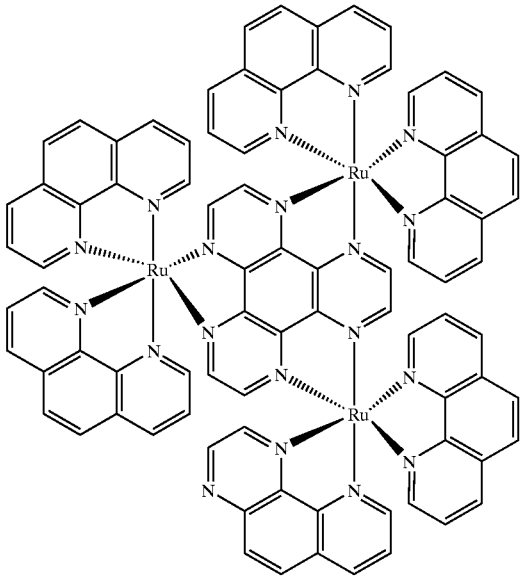

-continued
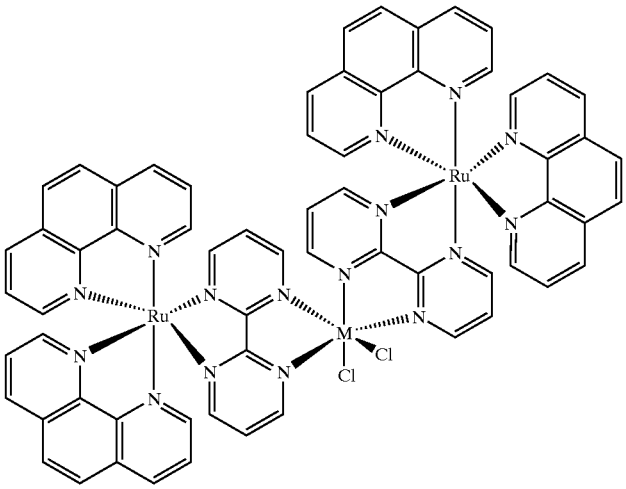
M = $Rh^{3+}$, $Ir^{3+}$
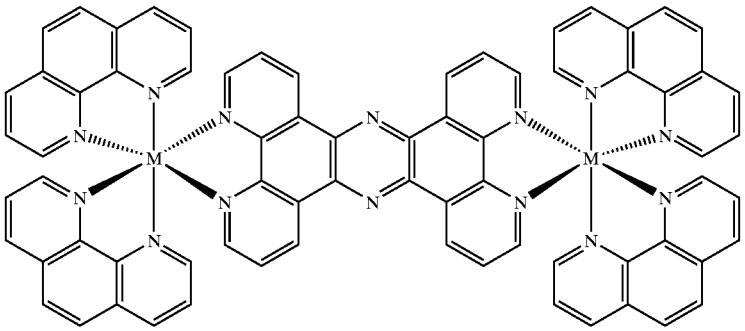
M′, M″ = Ru, Ru
Os, Os
Ru, Os
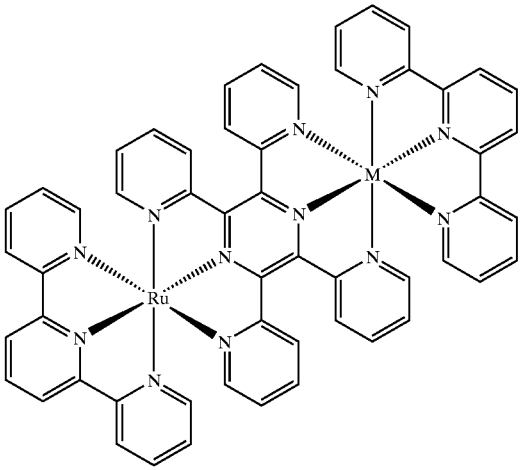
M = $Ru^{2+}$, $Os^{2+}$
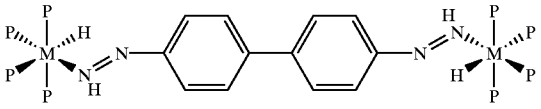
M = $Fe^{2+}$, $Ru^{2+}$; P = $P(OMe)_3$, $P(OEt)_3$

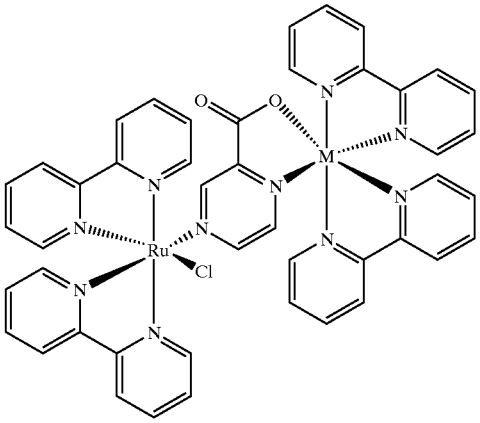
M = $Ru^{2+}$, $Os^{2+}$
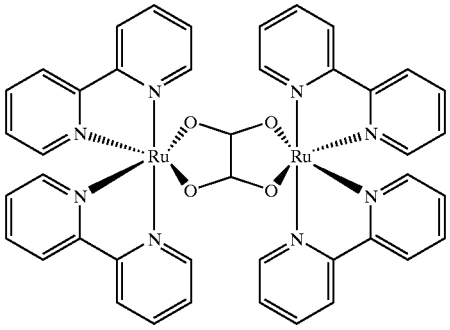
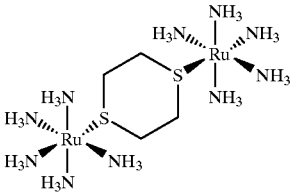
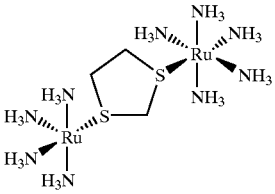
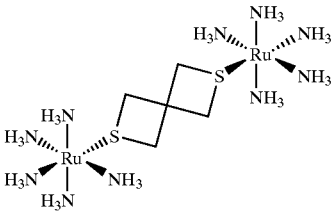
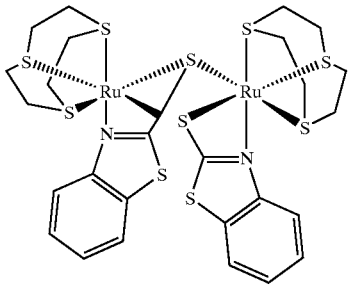
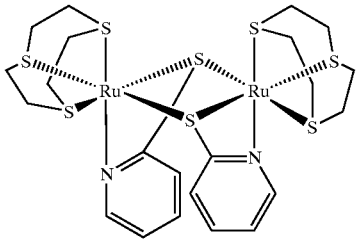
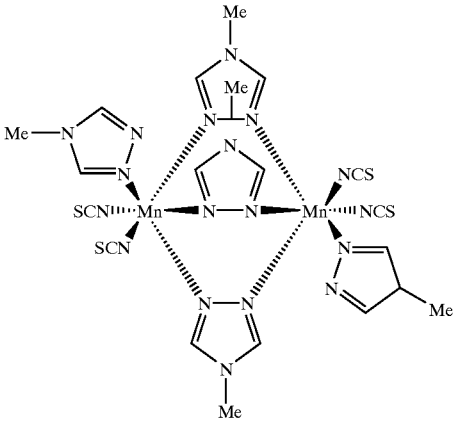
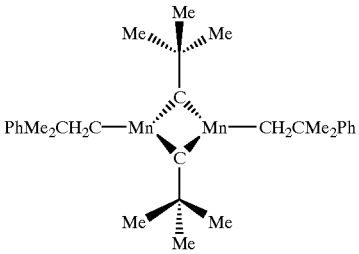
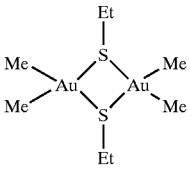

-continued

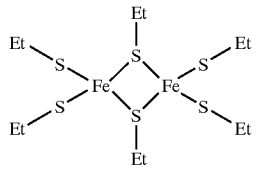

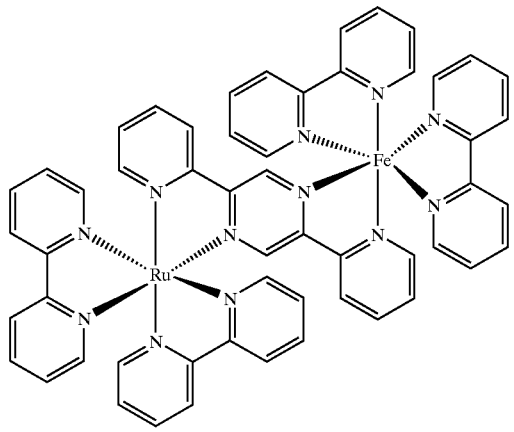

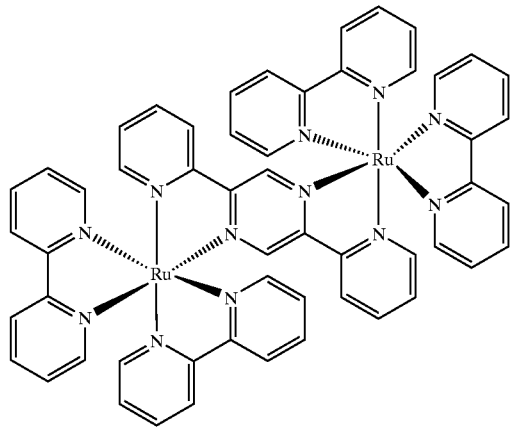

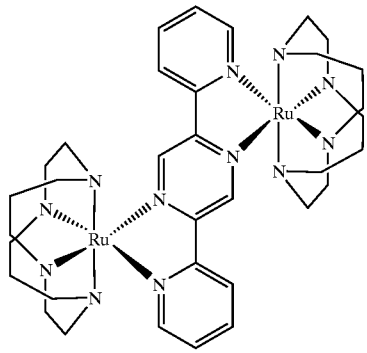

The complex of the invention can be synthesized by several methods. For example, Coord. Chem. Rev. 84, 85–277 (1988) provides a well organized general remarks concerning a ruthenium complex, and many complexes can be synthesized based on the reference articles enumerated therein. Other complexes can be synthesized based on the synthetic methods enumerated in the general remarks of every metal which are featured specially once in several years in Coord. Chem. Rev.

The complex of the present invention can preferably be added into silver halide grains by directly adding the complexes to a reaction solution during silver halide grain formation. Alternatively, the complex can preferably be added into silver halide grains by adding the complexes to a halide solution for forming silver halide grains or other solution and subsequently, adding the solution to a reaction solution for grain formation. Further, doping of the complex into silver halide grains can be performed by combining these methods.

When the complex of the invention is doped into silver halide grains, the complex can be present uniformly in the grain. Alternatively, the complex can be doped in grain surface layer as disclosed in JP-A's-4-208936, 2-125245, and 3-188437, the disclosures of which is incorporated herewith by reference, or doping can be made only at the interior portion of the grain and a grain surface layer without doping can be provided thereon. In the present invention, it is preferable to dope the complex in grain surface layer. Grain surface phase can be modified by physical ripening with fine grains to which the complex is doped, as disclosed in U.S. Pat. Nos. 5,252,451 and 5,256,530, the disclosures of which are incorporated herewith by reference. It is also a preferable method of doping the complex into silver halide grains by preparing fine grains to which the complex is doped and adding the fine grains to thereby perform physical ripening. Further, the above doping method can be combined.

The doping amount of the complex is suitably, $1\times10^{-9}$ to $1\times10^{-2}$ mol per mol of silver halide, preferably, $1\times10^{-7}$ to $1\times10^{-3}$ mol per mol of silver halide. The inter-grain distribution doping amount of the complex is preferably narrow.

The emulsion for use in the present invention is preferably doped with hexacyanoiron (II) complex or hexacyanoruthenium complex (hereinafter also referred to simply as "metal complex"). The addition amount of the metal complex is preferably in the range of $10^{-7}$ to $10^{-3}$ mol per mol of silver halide, more preferably $1.0\times10^{-5}$ to $5\times10^{-4}$ mol per mol of silver halide.

The addition and incorporation of the metal complex for use in the present invention may be performed at any stage through the process of preparing silver halide grains which consists of nucleation, growth, physical ripening, before chemical sensitization and after chemical sensitization. Also, the addition and incorporation may be performed in some divisions. However, it is preferred that at least 50% of the total content of metal complex contained in each silver halide grain be contained in a layer underlying the outermost surface of silver halide grain where ½ or less of the silver content from the surface is present. The layer containing the metal complex may be overlaid with a layer which does not contain any metal complex.

The incorporation of the above metal complex is preferably accomplished by dissolving the metal complex in water or a suitable solvent and directly adding the solution to the reaction mixture during the formation of silver halide grains, or by adding the metal complex solution to the aqueous solution of halide, aqueous solution of silver salt or other solution for preparation of silver halide grains and thereafter conducting grain formation. Alternatively, the incorporation of metal complex is also preferably accomplished by adding silver halide grains in which the metal complex has been introduced in advance, dissolving them and depositing them on other silver halide grains.

With respect to the hydrogen ion concentration of the reaction mixture to which the metal complex is added, the pH value is preferably in the range of 1 to 10, more preferably 3 to 7.

In the lightsensitive material of the present invention, at least one red-sensitive layer, at least one green-sensitive layer and at least one blue-sensitive layer are provided on a support. Each of these color sensitive layers comprises a lightsensitive unit layer constituted by a plurality of silver halide emulsion sub-layers which have substantially the same color sensitivity but have different speeds. In the silver halide color photographic lightsensitive material of the present invention, the unit lightsensitive layers are generally arranged in the order of red-, green- and blue-sensitive layers from a support side. However, according to the intended use, this arrangement order may be reversed, or an arrangement order can be employed in which a different lightsensitive layer is interposed between the layers of the same color sensitivity. Nonlightsensitive layers can be formed between the silver halide lightsensitive layers and as the uppermost layer and the lowermost layer. These may contain, e.g., couplers, DIR compounds and color mixing inhibitors described later. As a plurality of silver halide emulsion sub-layers constituting each unit lightsensitive layer, a two-layered structure of high- and low-speed emulsion sub-layers is preferably arranged so that the sensitivity is sequentially decreased toward a support as described in DE No. 1,121,470 or GB No. 923,045, the disclosures of which are incorporated herein by reference. Also, as described in JP-A's-57-112751, 62-200350, 62-206541 and 62-206543, the disclosures of which are incorporated herewith by reference, sub-layers can be arranged so that a low-speed emulsion sub-layer is formed on a side apart from a support while a high-speed emulsion sub-layer is formed on a side close to the support.

Specifically, layers can be arranged, from the farthest side from a support, in the order of low-speed blue-sensitive sub-layer (BL)/high-speed blue-sensitive sub-layer (BH)/high-speed green-sensitive sub-layer (GH)/low-speed green-sensitive sub-layer (GL)/high-speed red-sensitive sub-layer (RH)/low-speed red-sensitive sub-layer (RL), the order of BH/BL/GL/GH/RH/RL or the order of BH/BL/GH/GL/RL/RH.

In addition, as described in JP-B-55-34932, the disclosure of which is incorporated herewith by reference, layers can be arranged, from the farthest side from a support, in the order of blue-sensitive sub-layer/GH/RH/GL/RL. Furthermore, as described in JP-A's-56-25738 and 62-63936, sub-layers can be arranged, from the farthest side from a support, in the order of blue-sensitive sub-layer/GL/RL/GH/RH.

As described in JP-B-49-15495, the disclosure of which is incorporated herewith by reference, three sub-layers can be arranged so that a silver halide emulsion sub-layer having the highest sensitivity is arranged as an upper layer, a silver halide emulsion sub-layer having sensitivity lower than that of the upper layer is arranged as an interlayer, and a silver halide emulsion sub-layer having sensitivity lower than that of the interlayer is arranged as a lower layer; i.e., three sub-layers having different sensitivities can be arranged so that the sensitivity is sequentially decreased toward the support. Even when a init layer structure is constituted by three sub-layers having different sensitivities as mentioned above, these sub-layers can be arranged in the order of medium-speed emulsion sub-layer/high-speed emulsion sub-layer/low-speed emulsion sub-layer from the farthest side from a support in a unit layer sensitive to one color as described in JP-A-59-202464, the disclosure of which in incorporated herein by reference.

In addition, the order of high-speed emulsion sub-layer/low-speed emulsion sub-layer/medium-speed emulsion sub-layer or low-speed emulsion sub-layer/medium-speed emulsion sub-layer/high-speed emulsion sub-layer can be adopted. In the case where a unit layer structure is constituted by four or more layers, the layer arrangement can be varied as mentioned above.

When the silver halide photographic lightsensitive material of the present invention comprises at least one blue-sensitive silver halide emulsion layer containing a yellow coupler, at least one green-sensitive silver halide emulsion layer containing a magenta couple, and at least one red-sensitive silver halide emulsion layer containing a cyan coupler, and at least one non-lightsensitive layer on a support, and the material has an ISO speed of 640 or more, it is preferred that the spectral sensitivity $S_R(580)$ of the red-sensitive silver halide emulsion layer at a wavelength of 580 nm has a relationship with a spectral sensitivity $S_R(\max)$ of the red-sensitive layer at a wavelength giving a maximum sensitivity:

$$0.6 \leqq S_R(\max) - S_R(580) \leqq 0.9$$

It is preferable that the weight-average sensitivity wavelength ($\lambda_{-R}$) of spectral sensitivity distribution of interlayer effect exerted on the red-sensitive silver halide emulsion layer from other silver halide emulsion layers at 500 nm to 600 nm meets the relationship: 500 nm$<\lambda_{-R} \leqq 560$ nm; that the weight-average sensitivity wavelength ($\lambda_G$) of spectral sensitivity distribution of the green-sensitive silver halide emulsion layer meets the relationship: 520 nm$\leqq \lambda_G$580 nm, and that the weight-average sensitivity wavelength, $\lambda_G$ and $\lambda_{-R'}$ meet the relationship: $\lambda_G - \lambda_{-R} \geqq 5$ nm. When the red-sensitive unit layer comprises two or more red-sensitive sub-layers, the relationship of $\lambda_{-R}$ is met to the unit layer as a whole. When the green-sensitive unit layer comprises two or more green-sensitive sub-layers, the relationship of $\lambda_G$ is met to the unit layer as a whole.

The spectral sensitizer and solid disperse dye used herein can be those described in JP-A-11-305396, the disclosure of which is incorporated herein by reference. The above ISO speed, and the weight-average sensitivity wavelength of spectral sensitivity distribution of interlayer effect exerted on the red-sensitive silver halide emulsion layer from other layer can be obtained by the methods described in JP-A-11-305396.

Spectral sensitivity of the red-sensitive layer $S_R(580)$ and the spectral sensitivity of the green-sensitive layer $S_G(580)$ of the silver halide photographic lightsensitive material of the invention are preferably within the following ranges:

$$0.6 \leqq S_R(\max) - S_{R(580)} \leqq 0.9$$

$$0.6 \leqq S_{G(max)} - S_{G(580)} \leqq 1.1$$

wherein $S_G(580)$ is a spectral sensitivity defined by a logarithm value of reciprocal of an exposure amount required to give a density of a minimum magenta color density plus 1.0 at the wavelength; and $S_{R(580)}$ is a spectral sensitivity defined by a logarithm value of reciprocal of an exposure amount required to give a density of a minimum cyan color density plus 1.0 at the wavelength.

Further, the wavelength giving a maximum sensitivity of the red-sensitive layer is within the range of 610 nm to 640 nm, preferably 620 nm to 635 nm. In addition, the spectral sensitivity $S_{R(650)}$ of the red-sensitive layer at a wavelength of 650 nm preferably meets the following relationship:

$$S_{R(650)} \leqq S_{R(max)} - 0.7$$

wherein the definition of the spectral sensitivity is the same as above.

Further, the wavelength giving a maximum sensitivity of the green-sensitive layer is within the range of 520 to 580 nm, preferably 540 to 565 nm. In addition, the spectral sensitivity $S_{R(525)}$ of the green-sensitive layer at a wavelength of 525 nm preferably meets the following relationship:

$$0.1 \leqq S_{G(max)} - S_{G(525)} - 0.3$$

It is preferable to utilize an interlayer inhibitory effect as means for improving a color reproduction. It is especially preferred that the weight-average sensitivity wavelength of spectral sensitivity distribution of the green-sensitive silver halide emulsion layer ($\lambda_G$) satisfy the relationship: 520 nm$<\lambda_G \leqq$580 nm; and the weight-average sensitivity wavelength of spectral sensitivity distribution of interlayer effect exerted on the red-sensitive silver halide emulsion layer from other silver halide emulsion layers at 500 nm to 600 nm ($\lambda_{-R}$) satisfy the relationship: 500 nm$<\lambda_{-R}<$560 nm; and $\lambda_G - \lambda_{-R}$ is at least 5 nm, preferably at least 10 nm.

For imparting the above interlayer effect to the red-sensitive layer in a specified wavelength region, it is preferred to dispose a separate interlayer effect donor layer containing silver halide grains, subjected to given spectral sensitization. For realizing the spectral sensitivity desired in the present invention, the interlayer sensitivity wavelength of the interlayer effect donor layer is set at 510 to 540 nm.

Herein, the weight-average sensitivity wavelength ($\lambda_{-R}$) of spectral sensitivity distribution of interlayer effect exerted on the red-sensitive silver halide emulsion layer from other layer at a wavelength range of 500 to 600 nm can be obtained by the method described in JP-A-11-305396. Also, when $\lambda_{-B}$ is obtained in the similar manner as $\lambda_{-R}$, the interlayer effect given by the interlayer effect donor layer is required to meet the condition (Formula (2)) described in JP-A-11-305396, the disclosure of which is incorporated herein by reference.

Compounds which react with a developing agent in an oxidized form obtained by development to thereby release a development inhibitor or a precursor thereof are used as the material for exerting the interlayer effect. For example, use can be made of DIR (development inhibitor releasing) couplers, DIR hydroquinone and couplers capable of releasing DIR hydroquinone or a precursor thereof. When the development inhibitor has a high diffusivity, the development inhibiting effect can be exerted irrespective of the position of the donor layer in the layred multilayer structure. However, there also occurs a development inhibiting effect in nonintended directions. Therefore, for correcting this, it is preferred that the donor layer be colored (for example, coloring is made in the same color as that of the layer on which undesirable development inhibitor effect is exerted). From the viewpoint that the lightsensitive material of the present invention obtains desirable spectral sensitivity, it is preferred that the donor layer capable of exerting the interlayer effect realize magenta coloring.

Although, for example, the size and configuration of silver halide grains for use in the layer capable of exerting an interlayer effect on the red-sensitive layer are not particularly limited, it is preferred to use so-called tabular grains of high aspect ratio, a monodisperse emulsion having uniform grain size, or silver iodobromide grains having an iodine layer structure. Further, for extending an exposure latitude, it is preferred to mix a plurality of emulsions whose grain sizes are different from each other.

Although the donor layer capable of exerting the interlayer effect on the red-sensitive layer may be provided by coating on any position on the support, it is preferred that the donor layer be provided by coating at a position which is closer to the support than the blue-sensitive layer and which is more remote from the support than the red-sensitive layer. It is further preferred that the donor layer be positioned closer to the support than the yellow filter layer.

It is more preferred that the donor layer capable of exerting the interlayer effect on the red-sensitive layer be provided at a position which is closer to the support than the green-sensitive layer and which is more remote from the support than the red-sensitive layer. The donor layer is most preferably arranged at a position neighboring to a side of the green-sensitive layer close to the support. The terminology "neighboring" used herein means that an intermediate layer or any other thing is interposed therebetween.

There may be a plurality of layers capable of exerting the interlayer effect on the red-sensitive layer. These layers may be positioned so that they neighbor to each other or are apart from each other.

The emulsion for use in the lightsensitive material of the present invention may be any of the surface latent image type in which latent images are mainly formed in the surface, the internal latent image type in which latent images are formed in the internal portion of grains and the type in which latent images exist in both the surface and the internal portion of grains. However, it is requisite that the emulsion be a negative type. The emulsion of the internal latent image type may specifically be, for example, a core/shell internal-latent-image type emulsion described in JP-A-63-264740, the disclosure of which is incorporated herein by reference, whose productive process is described in JP-A-59-133542. The thickness of the shell of this emulsion, although varied depending on development processing, etc., is preferably in the range of 3 to 40 nm, more preferably 5to 20 nm.

The silver halide emulsion is generally subjected to physical ripening, chemical sensitization and spectral sensitization before use. Additives employed in these steps are described in RD Nos. 17643, 18716 and 307105. Positions where the description is made are listed in the following table.

With respect to the lightsensitive material of the present invention, at least two emulsions which are different from each other in at least one of the characteristics, specifically the grain size, grain size distribution, halogen composition, grain configuration and sensitivity of lightsensitive silver halide emulsion, can be mixed together and used in one layer.

It is preferred that silver halide grains having a grain surface fogged as described in U.S. Pat. No. 4,082,553, silver halide grains having a grain internal portion fogged as described in U.S. Pat. No. 4,626,498 and JP-A-59-214852, the disclosures of which are incorporated herein by reference, and colloidal silver be used in lightsensitive silver halide emulsion layers and/or substantially nonlightsensitive hydrophilic colloid layers. The expression "silver halide grains having a grain surface or grain internal portion fogged" refers to silver halide grains which can be developed uniformly (nonimagewise) irrespective of the nonexposed or exposed zone of lightsensitive material. The process for producing them is described in U.S. Pat. No. 4,626,498 and JP-A-59-214852. The silver halides constituting internal nuclei of core/shell silver halide grains having a grain internal portion fogged may have different halogen composition. Any of silver chloride, silver chlorobromide, silver iodobromide and silver chloroiodobromide can be used as the silver halide having a grain surface or grain internal portion fogged. The average grain size of these fogged silver halide grains is preferably in the range of 0.01 to 0.75 μm, more preferably 0.05 to 0.6 μm. With respect to grain configuration, although both regular grains and a polydisperse emulsion can be used, monodispersity (at least 95% of the weight or number of silver halide grains have grain sizes falling within ±40% of the average grain size) is preferred.

In the present invention, it is preferred to use nonlightsensitive fine grain silver halide. The expression "nonlightsensitive fine grain silver halide" refers to silver halide fine grains which are not sensitive at the time of imagewise exposure for obtaining dye image and which are substantially not developed at the time of development processing thereof. Those not fogged in advance are preferred. The fine grain silver halide has a silver bromide content of 0 to 100 mol %, and, if necessary, may contain silver chloride and/or silver iodide. Preferably, silver iodide is contained in an amount of 0.5 to 10 mol %. The average grain size (average of equivalent circular diameter of projected area) of fine grain silver halide is preferably in the range of 0.01 to 0.5 μm, more preferably 0.02 to 0.2 μm.

The fine grain silver halide can be prepared by the same process as used in the preparation of common lightsensitive silver halide. It is not needed to optically sensitize the surface of silver halide grains. Further, a spectral sensitization thereof is also not needed. However, it is preferred to add known stabilizers such as triazoles, azaindenes, benzothiazoliums and mercapto compounds and zinc compounds thereto prior to the addition thereof to a coating liquid. Colloidal silver can be contained in the fine grain silver halide containing layer.

The above various additives can be used in the lightsensitive material according to the present technology, to which other various additives can also be added in conformity with the object.

These additives are described in detail in Research Disclosure Item 17643 (December 1978), Item 18716 (November 1979) and Item 308119 (December 1989), the disclosures of which are incorporated herein by reference. A summary of the locations where they are described will be listed in the following table.

| Types of additives | RD17643 | RD18716 | RD308119 |
|---|---|---|---|
| 1 Chemical-sensitizers | page 23 | page 648 right column | page 996 |
| 2 Sensitivity increasing agents | | page 648 right column | |
| 3 Spectral sensitizers, super-sensitizers | pages 23–24 | page 648, right column to page 649, right column | page 996, right column to page 998, right column |
| 4 Brighteners | page 24 | | page 998 right column |
| 5 Antifoggants, and stabilizers | pages 24–25 | page 649 right column | page 998, right column to page 1000, right column |
| 6 Light absorbents, filter dyes, ultraviolet absorbents | pages 25–26 | page 649, right column to page 650, left column | page 1003, left column to page 1003, right column |
| 7 Stain preventing agents | page 25, right column | page 650, left to right columns | page 1002, right column |
| 8 Dye image stabilizers | page 25 | | page 1002, right column |
| 9 Film hardeners | page 26 | page 651, left column | page 1004, right column to page 1005, left column |
| 10 Binders | page 26 | page 651, left column | page 1003, right column to page 1004, right column |
| 11 plasticizers, lubricants | page 27 | page 650, right column | page 1006, left to right columns |
| 12 Coating aids, surfactants | pages 26–27 | page 650, right column | page 1005, left column to page 1006, left column |
| 13 Antistatic agents | page 27 | page 650, right column | page 1006, right column to page 1007, left column |
| 14 Matting agents | | | page 1008, left column to page 1009, left column. |

With respect to the layer arrangement and related techniques, silver halide emulsions, dye forming couplers, DIR couplers and other functional couplers, various additives and development processing which can be used in the photographic lightsensitive material of the present invention and the emulsions suitable for use in the lightsensitive material, reference can be made to EP 0565096A1 (published on Oct. 13, 1993), the disclosure of which is incorporated herein by reference, and patents cited therein. Individual particulars and the locations where they are described will be listed below.

1. Layer arrangement: page 61 lines 23 to 35, page 61 line 41 to page 62 line 14,
2. Interlayers: page 61 lines 36 to 40,
3. Interlayer effect imparting layers: page 62 lines 15 to 18,
4. Silver halide halogen compositions: page 62 lines 21 to 25,
5. Silver halide grain crystal habits: page 62 lines 26 to 30,
6. Silver halide grain sizes: page 62 lines 31 to 34,
7. Emulsion production methods: page 62 lines 35 to 40,
8. Silver halide grain size distributions: page 62 lines 41 to 42,
9. Tabular grains: page 62 lines 43 to 46,
10. Internal structures of grains: page 62 lines 47 to 53,
11. Latent image forming types of emulsions: page 62 line 54 to page 63 to line 5, 12. Physical ripening and chemical sensitization of emulsion: page 63 lines 6 to 9,
13. Emulsion mixing: page 63 lines 10 to 13,
14. Fogging emulsions: page 63 lines 14 to 31,
15. Nonlightsensitive emulsions: page 63 lines 32 to 43,
16. Silver coating amounts: page 63 lines 49 to 50,
17. Formaldehyde scavengers: page 64 lines 54 to 57,
18. Mercapto antifoggants: page 65 lines 1 to 2,
19. Fogging agent, etc. releasing agents: page 65 lines 3 to 7,
20. Dyes: page 65, lines 7 to 10,
21. Color coupler summary: page 65 lines 11 to 13,
22. Yellow, magenta and cyan couplers: page 65 lines 14 to 25,
23. Polymer couplers: page 65 lines 26 to 28,
24. Diffusive dye-forming couplers: page 65 lines 29 to 31,
25. Colored couplers: page 65 lines 32 to 38,
26. Functional coupler summary: page 65 lines 39 to 44,
27. Bleaching accelerator-releasing couplers: page 65 lines 4 5to 48,
28. Development accelerator release couplers: page 65 lines 49 to 53,
29. Other DIR couplers: page 65 line 54 to page 66 to line 4,
30. Method of dispersing couplers: page 66 lines 5 to 28,
31. Antiseptic and mildewproofing agents: page 66 lines 29 to 33,
32. Types of sensitive materials: page 66 lines 34 to 36,
33. Thickness of lightsensitive layer and swell speed: page 66 line 40 to page 67 line 1,
34. Back layers: page 67 lines 3 to 8,
35. Development processing summary: page 67 lines 9 to 11,
36. Developers and developing agents: page 67 lines 12 to 30,
37. Developer additives: page 67 lines 31 to 44,
38. Reversal processing: page 67 lines 45 to 56,
39. Processing solution open ratio: page 67 line 57 to page 68 line 12,
40. Development time: page 68 lines 13 to 15,
41. Bleach-fix, bleaching and fixing: page 68 line 16 to page 69 line 31,
42. Automatic processor: page 69 lines 32 to 40,
43. Washing, rinse and stabilization: page 69 line 41 to page 70 line 18,
44. Processing solution replenishment and recycling: page 70 lines 19 to 23,
45. Developing agent buil-in sensitive material: page 70 lines 24 to 33,
46. Development processing temperature: page 70 lines 34 to 38, and
47. Application to film with lens: page 70 lines 39 to 41.

Moreover, preferred use can be made of a bleaching solution containing 2-pyridinecarboxylic acid or 2,6-pyridinedicarboxylic acid, a ferric salt such as ferric nitrate and a persulfate as described in EP No. 602,600, the disclosure of which is incorporated herein by reference. When this bleaching solution is used, it is preferred that the steps of stop and water washing be conducted between the steps of color development and bleaching. An organic acid such as acetic acid, succinic acid or maleic acid is preferably used as a stop solution. For pH adjustment and bleaching fog, it is preferred that the bleaching solution contain an organic acid such as acetic acid, succinic acid, maleic acid, glutaric acid or adipic acid in an amount of 0.1 to 2 mol/liter (hereinafter liter referred to as "L").

The magnetic recording layer preferably used in the present invention will be described below.

The magnetic recording layer preferably used in the present invention is obtained by coating a support with a water-base or organic solvent coating liquid having magnetic material grains dispersed in a binder.

The magnetic material grains for use in the present invention can be composed of any of ferromagnetic iron oxides such as $\gamma Fe_2O_3$, Co coated $\gamma Fe_2O_3$, Co coated magnetite, Co containing magnetite, ferromagnetic chromium dioxide, ferromagnetic metals, ferromagnetic alloys, Ba ferrite of hexagonal system, Sr ferrite, Pb ferrite and Ca ferrite. Of these, Co coated ferromagnetic iron oxides such as Co coated $\gamma Fe_2O_3$ are preferred. The configuration thereof may be any of acicular, rice grain, spherical, cubic and plate shapes. The specific surface area is preferably at least 20 $m^2/g$, more preferably at least 30 $m^2/g$ in terms of $S_{BET}$.

The saturation magnetization (σs) of the ferromagnetic material preferably ranges from $3.0\times10^4$ to $3.0'10^5$ A/m, more preferably from $4.0\times10^4$ to $2.5\times10^5$ A/m. The ferromagnetic material grains may have their surface treated with silica and/or alumina or an organic material. Further, the magnetic material grains may have their surface treated with a silane coupling agent or a titanium coupling agent as described in JP-A-6-1-61032. Still further, use can be made of magnetic material grains having their surface coated with an organic or inorganic material as described in JP-A's-4-259911 and 5-81652.

The binder for use in the magnetic material grains can be composed of any of natural polymers (e.g., cellulose derivatives and sugar derivatives), acid-, alkali- or bio-degradable polymers, reactive resins, radiation curable resins, thermosetting resins and thermoplastic resins listed in JP-A-4-219569 and mixtures thereof. The Tg of each of the above resins ranges from −40 to 300° C. and the weight average molecular weight thereof ranges from 2 thousand to 1 million. For example, vinyl copolymers, cellulose derivatives such as cellulose diacetate, cellulose triacetate, cellulose acetate propionate, cellulose acetate butyrate and cellulose tripropionate, acrylic resins and polyvinylacetal resins can be mentioned as suitable binder resins. Gelatin is also a suitable binder resin. Of these, cellulose di(tri)acetate is especially preferred. The binder can be cured by adding an epoxy, aziridine or isocyanate crosslinking agent. Suitable isocyanate crosslinking agents include, for example, isocyanates such as tolylene diisocyanate, 4,4'-diphenylmethane diisocyanate, hexamethylene diisocyanate and xylylene diisocyanate, reaction products of these isocyanates and polyhydric alcohols (e.g., reaction product of 3 mol of tolylene diisocyanate and 1 mol of trimethylolpropane), and polyisocyanates produced by condensation of these isocyanates, as described in, for example, JP-A-6-59357.

The method of dispersing the magnetic material in the above binder preferably comprises using a kneader, a pin type mill and an annular type mill either individually or in combination as described in JP-A-6-35092. Dispersants listed in JP-A-5-088283 and other common dispersants can be used. The thickness of the magnetic recording layer ranges from 0.1 to 10 μm, preferably 0.2 to 5 μm, and more preferably from 0.3 to 3 μm. The weight ratio of magnetic material grains to binder is preferably in the range of 0.5:100 to 60:100, more preferably 1:100 to 30:100. The coating amount of magnetic material grains ranges from 0.005 to 3 $g/m^2$, preferably from 0.01 to 2 $g/m^2$, and more preferably from 0.02 to 0.5 g/m$^2$. The transmission yellow density of the magnetic recording layer is preferably in the range of 0.01 to 0.50, more preferably 0.03 to 0.20, and most preferably 0.04 to 0.15. The magnetic recording layer can be applied to the back of a photographic support in its entirety or in striped pattern by coating or printing. The magnetic recording layer can be applied by the use of, for example, an air doctor, a blade, an air knife, a squeeze, an immersion, reverse rolls, transfer rolls, a gravure, a kiss, a cast, a spray, a dip, a bar or an extrusion. Coating liquids set forth in JP-A-5-341436 are preferably used.

The magnetic recording layer may also be provided with, for example, lubricity enhancing, curl regulating, antistatic, sticking preventive and head polishing functions, or other functional layers may be disposed to impart these functions. An abrasive of grains whose at least one member is nonspherical inorganic grains having a Mohs hardness of at least 5 is preferred. The nonspherical inorganic grains are preferably composed of fine grains of any of oxides such as aluminum oxide, chromium oxide, silicon dioxide and titanium dioxide; carbides such as silicon carbide and titanium carbide; and diamond. These abrasives may have their surface treated with a silane coupling agent or a titanium coupling agent. The above grains may be added to the magnetic recording layer, or the magnetic recording layer may be overcoated with the grains (e.g., as a protective layer or a lubricant layer). The binder which is used in this instance can be the same as mentioned above and, preferably, the same as the that of the magnetic recording layer. The lightsensitive material having the magnetic recording layer is described in U.S. Pat. Nos. 5,336,589, 5,250,404, 5,229,259 and 5,215,874 and EP No. 466,130.

The polyester support preferably used in the present invention will be described below. Particulars thereof together with the below mentioned lightsensitive material, processing, cartridge and working examples are specified in JIII Journal of Technical Disclosure No. 94-6023 (issued by Japan Institute of Invention and Innovation on Mar. 15, 1994). The polyester for use in the present invention is prepared from a diol and an aromatic dicarboxylic acid as essential components. Examples of suitable aromatic dicarboxylic acids include 2,6-, 1,5-, 1,4- and 2,7-naphthalenedicarboxylic acids, terephthalic acid, isophthalic acid and phthalic acid, and examples of suitable diols include diethylene glycol, triethylene glycol, cyclohexanedimethanol, bisphenol A and other bisphenols. The resultant polymers include homopolymers such as polyethylene terephthalate, polyethylene naphthalate and polycyclohexanedimethanol terephthalate. Polyesters containing 2,6-naphthalenedicarboxylic acid in an amount of 50 to 100 mol.% are especially preferred. Polyethylene 2,6-naphthalate is most preferred. The average molecular weight thereof ranges from approximately 5,000 to 200,000. The Tg of the polyester for use in the present invention is at least 50° C., preferably at least 90° C.

The polyester support is subjected to heat treatment at a temperature of from 40° C. to less than Tg, preferably from Tg minus 20° C. to less than Tg, in order to suppress curling. This heat treatment may be conducted at a temperature held constant within the above temperature range or may be conducted while cooling. The period of heat treatment ranges from 0.1 to 1500 hr, preferably 0.5 to 200 hr. The support may be heat treated either in the form of a roll or while being carried in the form of a web. The surface form of the support may be improved by rendering the surface irregular (e.g., coating with conductive inorganic fine grains of $SnO_2$, $Sb_2O_5$, etc.). Moreover, a scheme is desired such that edges of the support are knurled so as to render only the edges slightly high, thereby preventing photographing of core sections. The above heat treatment may be carried out in any of stages after support film formation, after surface treatment, after back layer application (e.g., application of an antistatic agent or a lubricant) and after undercoating application. The heat treatment is preferably performed after antistatic agent application.

An ultraviolet absorber may be milled into the polyester. Light piping can be prevented by milling, into the polyester, dyes and pigments commercially available as polyester additives, such as Diaresin produced by Mitsubishi Chemical Industries, Ltd. and Kayaset produced by NIPPON KAYAKU CO., LTD.

In the present invention, a surface treatment is preferably conducted for bonding a support and a lightsensitive material constituting layer to each other. The surface treatment is, for example, a surface activating treatment such as chemical treatment, mechanical treatment, corona discharge treatment, flame treatment, ultraviolet treatment, high frequency treatment, glow discharge treatment, active plasma treatment, laser treatment, mixed acid treatment or ozone oxidation treatment. Of these surface treatments, ultraviolet irradiation treatment, flame treatment, corona treatment and glow treatment are preferred.

The subbing method will be described below. The substratum may be composed of either a single layer or at least two layers. As the binder for the substratum, there can be mentioned not only copolymers prepared from monomers, as starting materials, selected from among vinyl chloride, vinylidene chloride, butadiene, methacrylic acid, acrylic acid, itaconic acid and maleic anhydride but also polyethyleneimine, an epoxy resin, a grafted gelatin, nitrocellulose and gelatin. Resorcin or p-chlorophenol is used as a support swelling compound. A gelatin hardener such as a chromium salt (e.g., chrome alum), an aldehyde (e.g., formaldehyde or glutaraldehyde), an isocyanate, an active halogen compound (e.g., 2,4-dichloro-6-hydroxy-S-triazine), an epichlorohydrin resin or an active vinyl sulfone compound can be used in the subbing layer. Also, $SiO_2$, $TiO_2$, inorganic fine grains or polymethyl methacrylate copolymer fine grains (0.01 to 10 $\mu$m) may be incorporated therein as a matting agent.

Further, an antistatic agent is preferably used in the present invention. Examples of suitable antistatic agents include carboxylic acids and carboxylic salts, sulfonic acid salt containing polymers, cationic polymers and ionic surfactant compounds.

Most preferred as the antistatic agent are fine grains of at least one crystalline metal oxide selected from among ZnO, $TiO_2$, $SnO_2$, $Al_2O_3$, $In_2O_3$, $SiO_2$, MgO, BaO, $MoO_3$ and $V_2O_5$having a volume resistivity of $10^7$ Ω·cm or less, preferably $10^5$ Ω·cm or less, and having a grain size of 0.001 to 1.0 $\mu$m or a composite oxide thereof (Sb, P, B, In, S, Si, C, etc.) and fine grains of sol form metal oxides or composite oxides thereof.

The content thereof in the lightsensitive material is preferably in the range of 5to 500 mg/m$^2$, more preferably 10 to 350 mg/m. The ratio of amount of conductive crystalline oxide or composite oxide thereof to binder is preferably in the range of 1/300 to 100/1, more preferably 1/100 to 100/5.

It is preferred that the lightsensitive material of the present invention have lubricity. The lubricant containing layer is preferably provided on both the lightsensitive layer side and the back side. Preferred lubricity ranges from 0.25 to 0.01 in terms of dynamic friction coefficient. The measured lubricity is a value obtained by conducting a carriage on a stainless steel ball of 5 mm in diameter at 60 cm/min (25° C., 60% RH). In this evaluation, value of approximately the same level is obtained even when the opposite material is replaced by the lightsensitive layer side.

The lubricant which can be used in the present invention is, for example, a polyorganosiloxane, a higher fatty acid amide, a higher fatty acid metal salt or an ester of higher fatty acid and higher alcohol. Examples of suitable polyorganosiloxanes include polydimethylsiloxane, polydiethylsiloxane, polystyrylmethylsiloxane and polymethylphenylsiloxane. The lubricant is preferably added to the back layer or the outermost layer of the emulsion layer. Especially, polydimethylsiloxane and an ester having a long chain alkyl group are preferred.

A matting agent is preferably used in the lightsensitive material of the present invention. Although the matting agent may be used on the emulsion side or the back side indiscriminately, it is especially preferred that the matting agent be added to the outermost layer of the emulsion side. The matting agent may be soluble in the processing solution or insoluble in the processing solution, and it is preferred to use the soluble and insoluble matting agents in combination. For example, polymethyl methacrylate, poly(methyl methacrylate/methacrylic acid) (9/1 or 5/5 in molar ratio) and polystyrene grains are preferred. The grain size thereof preferably ranges from 0.8 to 10 $\mu$m. Narrow grain size distribution thereof is preferred, and it is desired that at least 90% of the whole number of grains be included in the range of 0.9 to 1.1 times the average grain size. Moreover, for enhancing the mat properties, it is preferred that fine grains of 0.8 $\mu$m or less be simultaneously added, which include, for example, fine grains of polymethyl methacrylate (0.2 $\mu$m), poly(methyl methacrylate/methacrylic acid) (9/1 in molar ratio, 0.3 $\mu$m), polystyrene (0.25 $\mu$m) and colloidal silica (0.03 $\mu$m).

The film patrone employed in the present invention will be described below. The main material composing the patrone for use in the present invention may be a metal or a synthetic plastic.

Examples of preferable plastic materials include polystyrene, polyethylene, polypropylene and polyphenyl ether. The patrone for use in the present invention may contain various types of antistatic agents and can preferably contain, for example, carbon black, metal oxide grains, nonionic, anionic, cationic or betaine type surfactants and polymers. Such an antistatic patrone is described in JP-A's-1-312537 and 1-312538. The resistance thereof at 25° C. in 25% RH is preferably $10^{12}\Omega$ or less. The plastic patrone is generally molded from a plastic having carbon black or a pigment milled thereinto for imparting light shielding properties. The patrone size may be the same as the current size 135, or for miniaturization of cameras, it is advantageous to decrease the diameter of the 25 mm cartridge of the current size 135 to 22 mm or less. The volume of the case of the patrone is preferably 30 $cm^3$ or less, more preferably 25 $cm^3$ or less. The weight of the plastic used in each patrone or patrone case preferably ranges from 5 to 15 g.

The patrone for use in the present invention may be one capable of feeding a film out by rotating a spool. Further, the patrone may be so structured that a film front edge is accommodated in the main frame of the patrone and that the film front edge is fed from a port part of the patrone to the outside by rotating a spool shaft in a film feeding out direction. These are disclosed in U.S. Pat. Nos. 4,834,306 and 5,226,613. The photographic film for use in the present invention may be a generally so termed raw stock having not yet been developed or a developed photographic film. The raw stock and the developed photographic film may be accommodated in the same new patrone or in different patrones.

The color photographic lightsensitive material of the present invention is suitably used as a negative film for Advanced Photo System (hereinafter referred to as "AP system"). It is, for example, one obtained by working the film into AP system format and accommodating the same in a special purpose cartridge, such as NEXIA A, NEXIA F or NEXIA H (sequentially, ISO 200/100/400) produced by Fuji Photo Film Co., Ltd. (hereinafter referred to as "Fuji Film"). This cartridge film for AP system is charged in a camera for AP system such as Epion series, e.g., Epion 300Z, produced by Fuji Film and put to practical use. Moreover, the color photographic lightsensitive material of the present invention is suitable to a lens equipped film, such as Fuji Color Utsurundesu Super Slim (Quick Snap) produced by Fuji Film.

The thus photographed film is printed through the following steps in a minilabo system:

(1) acceptance (receiving an exposed cartridge film from a customer), (2) deattaching (transferring the film from the above cartridge to an intermediate cartridge for development), (3) film development, (4) rear touching (returning the developed negative film to the original cartridge), (5) printing (continuous automatic printing of C/H/P three type print and index print on color paper (preferably, Super FA8 produced by Fuji Film)), and (6) collation and delivery (collating the cartridge and index print with ID number and delivering the same with prints).

The above system is preferably Fuji Film Minilabo Champion Super FA-298/FA-278/FA-258/FA-238 or Fuji Film Digital Labo System Frontier. Film processor of the Minilabo Champion is, for example, FP922AL/FP562B/FP562B, AL/FP362B/FP362B, AL, and recommended processing chemical is Fuji Color Just It CN-16L or CN-16Q. Printer processor is, for example, PP3008AR/PP3008A/PP1828AR/PP1828A/PP1258AR/PP1258A/PP72 8AR/PP728A, and recommended processing chemical thereof is Fuji Color Just It CP-47L or CP-40FAII. In the Frontier System, use is made of scanner & image processor SP-1000 and laser printer & paper processor LP-1000P or Laser Printer LP-1000W. Fuji Film DT200/DT100 and AT200/AT100 are preferably used as detacher in the detaching step and as rear toucher in the rear touching step, respectively.

The AP system can be enjoyed by photo joy system whose center unit is Fuji Film digital image work station Aladdin 1000. For example, developed AP system cartridge film is directly charged in Aladdin 1000, or negative film, positive film or print image information is inputted with the use of 35 mm film scanner FE-550 or flat head scanner PE-550 therein, and obtained digital image data can easily be worked and edited. The resultant data can be outputted as prints by current labo equipment, for example, by means of digital color printer NC-550AL based on photofixing type thermal color printing system or Pictrography 3000 based on laser exposure thermal development transfer system or through a film recorder. Moreover, Aladdin 1000 is capable of directly outputting digital information to a floppy disk or Zip disk or outputting it through a CD writer to CD-R.

On the other hand, at home, photography can be enjoyed on TV only by charging the developed AP system cartridge film in photoplayer AP-1 manufactured by Fuji Film. Charging it in Photoscanner AS-1 manufactured by Fuji Film enables continuously feeding image information into a personal computer at a high speed. Further, Photovision FV-10/FV-5 manufactured by Fuji Film can be utilized for inputting a film, print or three-dimensional object in the personal computer. Still further, image information recorded on a floppy disk, Zip disk, CD-R or a hard disk can be enjoyed by conducting various workings on the personal computer by the use of Fuji Film Application Soft Photofactory. Digital color printer NC-2/NC-2D based on photofixing type thermal color printing system, manufactured by Fuji Film, is suitable for outputting high-quality prints from the personal computer.

Fuji Color Pocket Album AP-5 Pop L, AP-1 Pop L or AP-1 Pop KG or Cartridge File 16 is preferably employed for storing the developed AP system cartridge film.

EXAMPLE

Examples of the present invention will be described below, which, however, in no way limit the scope of the present invention.

Example 1

Preparation of Sample 001 (Present Invention)

Silver halide emulsions Em-A to Em-O were prepared by the following processes.

(Preparation of Em-A)

1200 milliliters (hereinafter referred to as "mL") of an aqueous solution containing 1.0 g of a low-molecular-weight gelatin whose molecular weight was 15,000 and 1.0 g of KBr was vigorously agitated while maintaining the temperature at 35° C. 30 mL of an aqueous solution containing 1.9 g of $AgNO_3$ and 30 mL of an aqueous solution containing 1.5 g of KBr and 0.7 g of a low-molecular-weight gelatin whose molecular weight was 15,000 were added by the double jet method over a period of 30 sec to thereby effect a nucleation. During the period, KBr excess concentration was held constant. 6 g of KBr was added and heated to 75° C., and the mixture was ripened. After the completion of ripening, 35 g of succinated gelatin was added. The pH was adjusted to 5.5. An aqueous solution of KBr and 150 mL of an aqueous solution containing 30 g of $AgNO_3$ were added by the double jet method over a period of 16 min. During this period, the silver potential was maintained at −25 mV against saturated calomel electrode. Further, an aqueous solution containing 110 g of $AgNO_3$ and an aqueous solution of KBr were added by the double jet method over a period of 15 min while increasing the flow rate so that the final flow rate was 1.2 times the initial flow rate. During this period, a 0.03 $\mu$m (grain size) AgI fine grain emulsion was simultaneously added while conducting a flow rate increase so that the silver iodide content was 3.8 mol %, and the silver potential was maintained at −25 mv.

Still further, an aqueous solution of KBr and 132 mL of an aqueous solution containing 35 g of $AgNO_3$ were added by the double jet method over a period of 7 min. The addition of the aqueous solution of KBr was regulated so that the potential at the completion of the addition was −20 mV. The temperature was regulated to 40° C., and 5.6 g, in terms of KI, of the following compound 1 was added. Further, 64 mL of a 0.8 M aqueous sodium sulfite solution was added. Still further, an aqueous solution of NaOH was added to thereby increase the pH to 9.0, and held undisturbed for 4 min so that iodide ions were rapidly formed. The pH was returned to 5.5 and the temperature to 55° C., and 1 mg of sodium benzenethiosulfonate was added. Further, 13 g of lime-processed gelatin having a calcium concentration of 1 ppm was added. After the completion of the addition, an aqueous solution of KBr and 250 mL of an aqueous solution containing 70 g of $AgNO_3$ were added over a period of 20 min while maintaining the potential at 60 mv. During this period, yellow prussiate of potash was added in an amount of $1.0\times10^{-5}$ mol per mol of silver. The mixture was washed with water, and 80 g of lime-processed gelatin having a calcium concentration of 1 ppm was added. The pH and pAg were adjusted at 40° C. to 5.8 and 8.7, respectively.

Compound 1

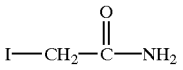

The calcium, magnesium and strontium contents of the thus obtained emulsion were measured by ICP emission spectrochemical analysis. The contents thereof were 15, 2 and 1 ppm, respectively.

The emulsion was heated to 56° C. First, 1 g, in terms of Ag, of an emulsion of 0.05 $\mu$m (grain size) pure AgBr fine grains was added to thereby effect shell covering. Subsequently, the following sensitizing dyes 1, 2 and 3 in the form of solid fine dispersion were added in respective amounts of $5.85\times10^{-4}$ mol, $3.06\times10^{-4}$ mol and $9.00\times10^{-6}$ mol per mol of silver. Under the preparative conditions specified in Table 1, inorganic salts were dissolved in ion-exchanged water, and the sensitizing dye was added. The sensitizing dye was dispersed at 60° C. for 20 min under agitation at 2000 rpm by means of a dissolver blade. Thus, the solid fine dispersions of sensitizing dyes 1, 2 and 3 were obtained. When, after the addition of the sensitizing dyes, the sensitizing dye adsorption reached 90% of the equilibrium-state adsorption, calcium nitrate was added so that the calcium concentration became 250 ppm. The adsorption amount of the sensitizing dyes was determined by separating the mixture into a solid layer and a liquid layer (supernatant) by centrifugal precipitation and measuring the difference between the amount of initially added sensitizing dyes and the amount of sensitizing dyes present in the supernatant to thereby calculate the amount of adsorbed sensitizing dyes. After the addition of calcium nitrate, potassium thiocyanate, chloroauric acid, sodium thiosulfate, N,N-dimethylselenourea and compound 4 were added to thereby effect the optimum chemical sensitization. N,N-dimethylselenourea was added in an amount of $3.40\times10^{-6}$ mol per mol of silver. Upon the completion of the chemical sensitization, the following compounds 2 and 3 were added to thereby obtain emulsion Em-A.

TABLE 1

| Sensitizing dye | Amount of the sensitizing dye (parts by weight) | $NaNO_3/Na_2SO_4$ (parts by weight) | Water (parts by weight) | Dispersing time | Dispersing temperature |
|---|---|---|---|---|---|
| 1 | 3 | 0.8/3.2 | 43 | 20 min | 60° C. |
| 2/3 | 4/0.12 | 0.6/2.4 | 42.8 | 20 min | 60° C. |

Sensitizing dye 1

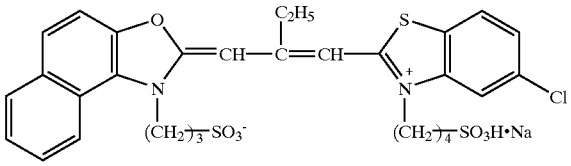

Sensitizing dye 2

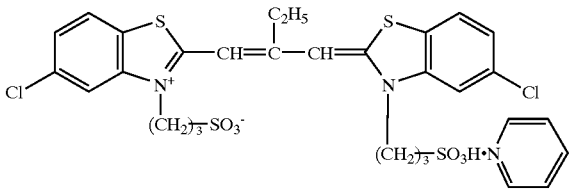

Sensitizing dye 3

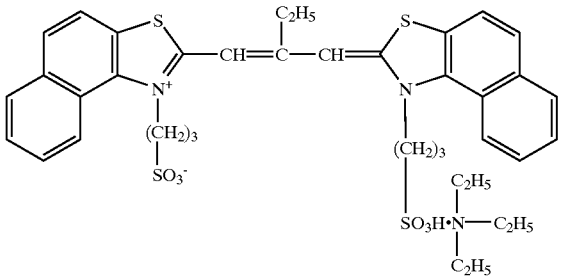

Compound 2

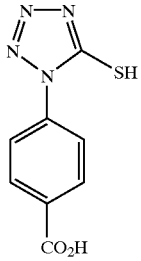

-continued

Compound 3

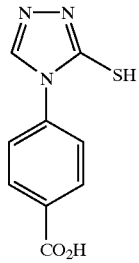

Compound 4

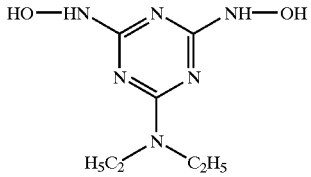

(Preparation of Em-B)

Emulsion Em-B was prepared in the same manner as the emulsion Em-A, except that the amount of KBr added after nucleation was changed to 5 g, that the succinated gelatin was changed to a trimellitated gelatin whose trimellitation ratio was 98%, the gelatin containing methionine in an amount of 35 $\mu$mol per g and having a molecular weight of 100,000, that the compound 1 was changed to the following compound 6 whose addition amount in terms of KI was 8.0 g, that the amounts of sensitizing dyes 1, 2 and 3 added prior to the chemical sensitization were changed to $6.50\times10^{-4}$ mol, $3.40\times10^{-4}$ mol and $1.00\times10^{-5}$ mol, respectively, and that the amount of N,N-dimethylselenourea added at the time of chemical sensitization was changed to $4.00\times10^{-6}$ mol.

Compound 6

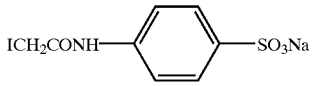

(Preparation of Em-C)

Emulsion Em-C was prepared in the same manner as the emulsion Em-A, except that the amount of KBr added after nucleation was changed to 1.5 g, that the succinated gelatin was changed to a phthalated gelatin whose phthalation ratio was 97%, the gelatin containing methionine in an amount of 35 $\mu$mol per g and having a molecular weight of 100,000, that the compound 1 was changed to the following compound 7 whose addition amount in terms of KI was 7.1 g, that the amounts of sensitizing dyes 1, 2 and 3 added prior to the chemical sensitization were changed to $7.80\times10^{-4}$ mol, $4.08\times10^{-4}$ mol and $1.20\times10^{-5}$ mol, respectively, and that the amount of N,N-dimethylselenourea added at the time of chemical sensitization was changed to $5.00\times10^{-6}$ mol.

Compound 7

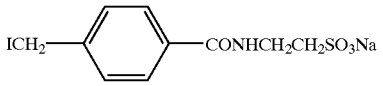

(Preparation of Em-E)

1200 mL of an aqueous solution containing 1.0 g of a low-molecular-weight gelatin whose molecular weight was 15,000 and 1.0 g of KBr was vigorously agitated while maintaining the temperature at 35° C. 30 mL of an aqueous solution containing 1.9 g of $AgNO_3$ and 30 mL of an aqueous solution containing 1.5 g of KBr and 0.7 g of a low-molecular-weight gelatin whose molecular weight was 15,000 were added by the double jet method over a period of 30 sec to thereby effect a nucleation. During the period, KBr excess concentration was held constant. 6 g of KBr was added and heated to 75° C., and the mixture was ripened. After the completion of ripening, 15 g of succinated gelatin and 20 g of the above trimellitated gelatin were added. The pH was adjusted to 5.5. An aqueous solution of KBr and 150 mL of an aqueous solution containing 30 g of $AgNO_3$ were added by the double jet method over a period of 16 min. During this period, the silver potential was maintained at −25 mV against saturated calomel electrode. Further, an aqueous solution containing 110 g of $AgNO_3$ and an aqueous solution of KBr were added by the double jet method over a period of 15 min while increasing the flow rate so that the final flow rate was 1.2 times the initial flow rate. During this period, a 0.03 μm (grain size) AgI fine grain emulsion was simultaneously added while conducting a flow rate increase so that the silver iodide content was 3.8 mol %, and the silver potential was maintained at −25 mV.

Still further, an aqueous solution of KBr and 132 mL of an aqueous solution containing 35 g of $AgNO_3$ were added by the double jet method over a period of 7 min. The addition of the aqueous solution of KBr was regulated so that the potential at the completion of the addition was −20 mV. KBr was added so that the potential became −60 mV. Thereafter, 1 mg of sodium benzenethiosulfonate was added, and, further, 13 g of lime-processed gelatin having a calcium concentration of 1 ppm was added. After the completion of the addition, while continuously adding 8.0 g, in terms of KI, of AgI fine grain emulsion of 0.008 μm grain size (equivalent sphere diameter) (prepared by, just prior to addition, mixing together an aqueous solution of a low-molecular-weight gelatin whose molecular weight was 15,000, an aqueous solution of $AgNO_3$ and an aqueous solution of KI in a separate chamber furnished with a magnetic coupling induction type agitator as described in JP-A-10-43570), an aqueous solution of KBr and 250 mL of an aqueous solution containing 70 g of $AgNO_3$ were added over a period of 20 min with the potential maintained at −60 mV. During this period, yellow prussiate of potash was added in an amount of $1.0\times10^{-5}$ mol per mol of silver. The mixture was washed with water, and 80g of lime-processed gelatin having a calcium concentration of 1 ppm was added. The pH and pAg were adjusted at 40° C. to 5.8 and 8.7, respectively.

The calcium, magnesium and strontium contents of the thus obtained emulsion were measured by ICP emission spectrochemical analysis. The contents thereof were 15, 2 and 1 ppm, respectively.

The chemical sensitization was performed in the same manner as in the preparation of the emulsion Em-A, except that the sensitizing dyes 1, 2 and 3 were changed to the following sensitizing dyes 4, 5 and 6, respectively, whose addition amounts $7.73\times10^{-4}$ mol, $1.65\times10^{-4}$ mol and $6.20\times10^{-5}$ mol, respectively. Thus, Emulsion Em-E was obtained.

Sensitizing dye 4

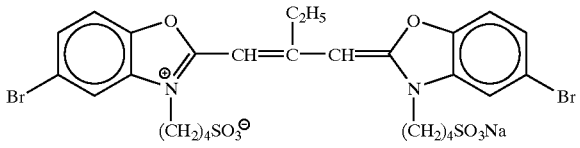

Sensitizing dye 5

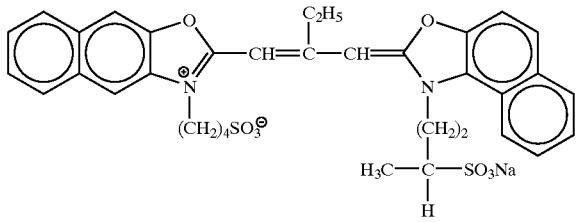

Sensitizing dye 6

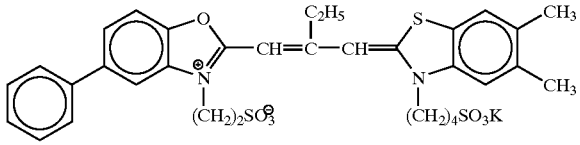

(Preparation of Em-F)

1200 mL of an aqueous solution containing 1.0 g of a low-molecular-weight gelatin whose molecular weight was 15,000 and 1.0 g of KBr was vigorously agitated while maintaining the temperature at 35° C. 30 mL of an aqueous solution containing 1.9 g of $AgNO_3$ and 30 mL of an aqueous solution containing 1.5 g of KBr and 0.7 g of a low-molecular-weight gelatin whose molecular weight was 15,000 were added by the double jet method over a period of 30 sec to thereby effect a nucleation. During the period, KBr excess concentration was held constant. 5 g of KBr was added and heated to 75° C., and the mixture was ripened. After the completion of ripening, 20 g of succinated gelatin and 15 g of gelatin phthalate were added. The pH was adjusted to 5.5. An aqueous solution of KBr and 150 mL of an aqueous solution containing 30 g of $AgNO_3$ were added by the double jet method over a period of 16 min. During this period, the silver potential was maintained at −25 mV against saturated calomel electrode. Further, an aqueous solution containing 110 g of $AgNO_3$ and an aqueous solution of KBr were added by the double jet method over a period of 15 min while increasing the flow rate so that the final flow rate was 1.2 times the initial flow rate. During this period, a 0.03 μm (grain size) AgI fine grain emulsion was simultaneously added while conducting a flow rate increase so that the silver iodide content was 3.8 mol %, and the silver potential was maintained at −25 mV.

Still further, an aqueous solution of KBr and 132 mL of an aqueous solution containing 35 g of $AgNO_3$ were added by the double jet method over a period of 7 min. An aqueous solution of KBr was added so as to regulate the potential to −60 mV. Thereafter, 9.2 g, in terms of KI, of a 0.03 μm (grain size) AgI fine grain emulsion was added. 1 mg of sodium benzenethiosulfonate was added, and, further, 13 g of lime-processed gelatin having a calcium concentration of 1 ppm was added. After the completion of the addition, an aqueous solution of KBr and 250 mL of an aqueous solution containing 70 g of $AgNO_3$ were added over a period of 20 min while maintaining the potential at 60 mV. During this period, yellow prussiate of potash was added in an amount of $1.0\times10^{-5}$ mol per mol of silver. The mixture was washed with water, and 80 g of lime-processed gelatin having a calcium concentration of 1 ppm was added. The pH and pAg were adjusted at 40° C. to 5.8 and 8.7, respectively.

The calcium, magnesium and strontium contents of the thus obtained emulsion were measured by ICP emission spectrochemical analysis. The contents thereof were 15, 2 and 1 ppm, respectively.

The chemical sensitization was performed in the same manner as in the preparation of the emulsion Em-B, except that the sensitizing dyes 1, 2 and 3 were changed to the sensitizing dyes 4, 5 and 6, respectively, whose addition amounts were $8.50\times10^{-4}$ mol, $1.82\times10^{-4}$ mol and $6.82\times10^{-5}$ mol, respectively. Thus, Emulsion Em-F was obtained.

(Preparation of Em-G)

1200 mL of an aqueous solution containing 1.0 g of a low-molecular-weight gelatin whose molecular weight was 15,000 and 1.0 g of KBr was vigorously agitated while maintaining the temperature at 35° C. 30 mL of an aqueous solution containing 1.9 g of $AgNO_3$ and 30 mL of an aqueous solution containing 1.5 g of KBr and 0.7 g of a low-molecular-weight gelatin whose molecular weight was 15,000 were added by the double jet method over a period of 30 sec to thereby effect a nucleation. During the period, KBr excess concentration was held constant. 1.5 g of KBr was added and heated to 75° C., and the mixture was ripened. After the completion of ripening, 15 g of the above trimellitated gelatin and 20 g of the above gelatin phthalate were added. The pH was adjusted to 5.5. An aqueous solution of KBr and 150 mL of an aqueous solution containing 30 g of $AgNO_3$ were added by the double jet method over a period of 16 min. During this period, the silver potential was maintained at −25 mV against saturated calomel electrode. Further, an aqueous solution containing 110 g of $AgNO_3$ and an aqueous solution of KBr were added by the double jet method over a period of 15 min while increasing the flow rate so that the final flow rate was 1.2 times the initial flow rate. During this period, a 0.03 μm (grain size) AgI fine grain emulsion was simultaneously added while conducting a flow rate increase so that the silver iodide content was 3.8 mol %, and the silver potential was maintained at −25 mV.

Still further, an aqueous solution of KBr and 132 mL of an aqueous solution containing 35 g of $AgNO_3$ were added by the double jet method over a period of 7 min. The addition of the aqueous solution of KBr was regulated so that the potential became −60 mV. Thereafter, 7.1 g, in terms of KI, of a 0.03 μm (grain size) AgI fine grain emulsion was added. 1 mg of sodium benzenethiosulfonate was added, and, further, 13 g of lime-processed gelatin having a calcium concentration of 1 ppm was added. After the completion of the addition, an aqueous solution of KBr and 250 mL of an aqueous solution containing 70 g of $AgNO_3$ were added over a period of 20 min while maintaining the potential at 60 mV. During this period, yellow prussiate of potash was added in an amount of $1.0\times10^{-5}$ mol per mol of silver. The mixture was washed with water, and 80 g of lime-processed gelatin having a calcium concentration of 1 ppm was added. The pH and pAg were adjusted at 40° C. to 5.8 and 8.7, respectively.

The calcium, magnesium and strontium contents of the thus obtained emulsion were measured by ICP emission spectrochemical analysis. The contents thereof were 15, 2 and 1 ppm, respectively.

The chemical sensitization was performed in the same manner as in the preparation of the emulsion Em-C, except that the sensitizing dyes 1, 2 and 3 were changed to the sensitizing dyes 4, 5 and 6, respectively, whose addition amounts were $1.00\times10^{-3}$ mol, $2.15\times10^{-4}$ mol and $8.06\times10^{-5}$ mol, respectively. Thus, Emulsion Em-G was obtained.

(Preparation of Em-J)

Emulsion Em-J was prepared in the same manner as the emulsion Em-B, except that the sensitizing dyes added prior to the chemical sensitization were changed to the following sensitizing dyes 7 and 8 whose addition amounts were $7.65\times10^{-4}$ mol and $2.74\times10^{-4}$ mol, respectively.

Sensitizing dye 7

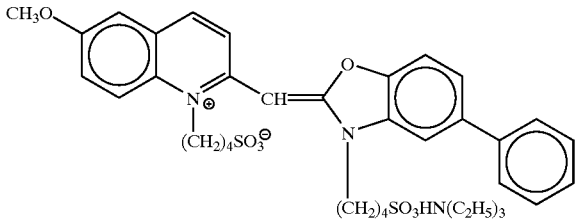

Sensitizing dye 8

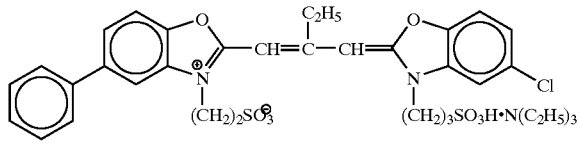

(Preparation of Em-L)

(Preparation of Silver Bromide Seed Crystal Emulsion)

A silver bromide tabular emulsion having an average equivalent sphere diameter of 0.6 μm and an aspect ratio of 9.0 and containing 1. 16 mol of silver and 66 g of gelatin per kg of emulsion was prepared.

(Growth Step 1)

0.3 g of a modified silicone oil was added to 1250 g of an aqueous solution containing 1.2 g of potassium bromide and a succinated gelatin whose succination ratio was 98%. The above silver bromide tabular emulsion was added in an amount containing 0.086 mol of silver and, while maintaining the temperature at 78° C., agitated. Further, an aqueous solution containing 18.1 g of silver nitrate and 5.4 mol, per added silver, of the above 0.037 μm silver iodide fine grains were added. During this period, also, an aqueous solution of potassium bromide was added by double jet while regulating the addition so that the pAg was 8.1.

(Growth Step 2)

2 mg of sodium benzenethiosulfonate was added, and thereafter 0.45 g of disodium salt of 3,5-disulfocatechol and 2.5 mg of thiourea dioxide were added.

Further, an aqueous solution containing 95.7 g of silver nitrate and an aqueous solution of potassium bromide were added by double jet while increasing the flow rate over a period of 66 min. During this period, 7.0 mol %, per added silver, of the above 0.037 μm silver iodide fine grains were added. The amount of potassium bromide added by double jet was regulated so that the pAg was 8.1. After the completion of the addition, 2 mg of sodium benzenethiosulfonate was added.

(Growth Step 3)

An aqueous solution containing 19. 5 g of silver nitrate and an aqueous solution of potassium bromide were added by double jet over a period of 16 min. During this period, the amount of the aqueous solution of potassium bromide was regulated so that the pAg was 7.9.

(Addition of Sparingly Soluble Silver Halide Emulsion 4)

The above host grains were adjusted to 9.3 in pAg with the use of an aqueous solution of potassium bromide. Thereafter, 25 g of the above 0.037 μm silver iodide fine grain emulsion was rapidly added within a period of 20 sec.

(Formation of Outermost Shell Layer 5)

Further, an aqueous solution containing 34.9 g of silver nitrate was added over a period of 22 min.

The obtained emulsion consisted of tabular grains having an average aspect ratio of 9.8 and an average equivalent sphere diameter of 1.4 μm, wherein the average silver iodide content was 5.5 mol %.

(Chemical Sensitization)

The emulsion was washed, and a succinated gelatin whose succination ratio was 98% and calcium nitrate were added. At 40° C., the pH and pAg were adjusted to 5.8 and 8.7, respectively. The temperature was raised to 60° C., and $5\times10^{-3}$ mol of 0.07 μm silver bromide fine grain emulsion was added. 20 min later, the following sensitizing dyes 9, 10 and 11 were added. Thereafter, potassium thiocyanate, chloroauric acid, sodium thiosulfate, N,N-dimethylselenourea and compound 4 were added to thereby effect the optimum chemical sensitization. Compound 3 was added 20 min before the completion of the chemical sensitization, and compound 5 was added at the completion of the chemical sensitization. The terminology "optimum chemical sensitization" used herein means that the sensitizing dyes and compounds are added in an amount selected from among the range of $10^{-1}$ to $10^{-8}$ mol per mol of silver halide so that the speed exhibited when exposure is conducted at 1/100 becomes the maximum.

Sensitizing dye 9

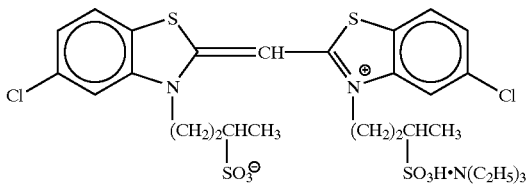

Sensitizing dye 10

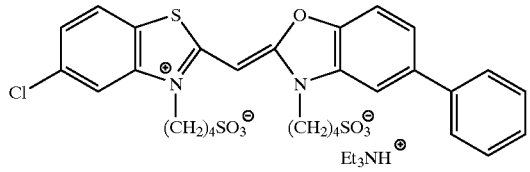

Sensitizing dye 11

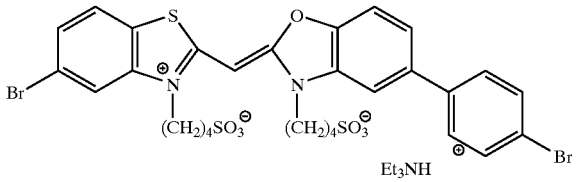

Compound 4

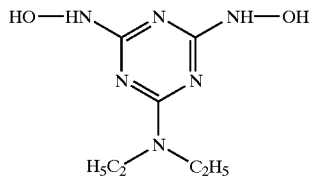

Compound 5

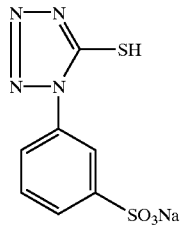

(Preparation of Em-O)

An aqueous solution of gelatin (1250 mL of distilled water, 48 g of deionized gelatin and 0.75 g of KBr) was placed in a reaction vessel equipped with an agitator. The temperature of the aqueous solution was maintained at 70° C. 276 mL of an aqueous solution of $AgNO_3$ (containing 12.0 g of $AgNO_3$) and an equimolar-concentration aqueous solution of KBr were added thereto by the controlled double jet addition method over a period of 7 min while maintaining the pAg at 7.26. The mixture was cooled to 68° C., and 7.6 mL of thiourea dioxide ( 0.05% by weight) was added.

Subsequently, 592.9 mL of an aqueous solution of $AgNO_3$ (containing 108.0 g of $AgNO_3$) and an equimolar-concentration aqueous solution of a mixture of KBr and KI (2.0 mol % KI) were added by the controlled double jet addition method over a period of 18 min 30 sec while maintaining the pAg at 7.30. Further, 18.0 mL of thiosulfonic acid (0.1% by weight) was added 5 min before the completion of the addition.

The obtained grains consisted of cubic grains having an equivalent sphere diameter of 0.19 μm and an average silver iodide content of 1.8 mol %.

The obtained emulsion Em-O was desalted and washed by the customary flocculation method, and re-dispersed. At 40° C., the pH and pAg were adjusted to 6.2 and 7.6, respectively.

The resultant emulsion Em-O was subjected to the following spectral and chemical sensitization.

Based on silver, $3.37\times10^{-4}$ mol/mol of each of sensitizing dye 10, sensitizing dye 11 and sensitizing dye 12, $8.82\times10^{-4}$ mol/mol of KBr, $8.83\times10^{-5}$ mol/mol of sodium thiosulfate, $5.95\times10^{-4}$ mol/mol of water-soluble potassium thiocyanate and $3.07\times10^{-5}$ mol/mol of potassium chloroaurate were added. Ripening thereof was performed at 68° C. for a period, which period was regulated so that the speed exhibited when exposure was conducted at 1/100 became the maximum.

Sensitizing dye 12

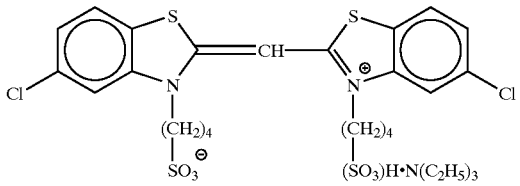

(Em-D, H, I, K, M, N)

In the preparation of tabular grains, a low-molecular-weight gelatin was used in conformity with Examples of JP-A-1-158426. Gold sensitization, sulfur sensitization and selenium sensitization were carried out in the presence of spectral sensitizing dye listed in Table 2 and sodium thiocyanate in conformity with Examples of JP-A-3-237450. Emulsions D, H, I and K contained the optimum amount of Ir and Fe. For the emulsions M and N, reduction sensitization was carried out with the use of thiourea dioxide and thiosulfonic acid at the time of grain preparation in conformity with Examples of JP-A-2-191938.

TABLE 2

| Emulsion | Sensitizing dye | Addition amount (mol/mol silver) |
|---|---|---|
| Em-D | Sensitizing dye 1 | $5.44\times10^{-4}$ |
| | Sensitizing dye 2 | $2.35\times10^{-4}$ |
| | Sensitizing dye 3 | $7.26\times10^{-6}$ |
| Em-H | Sensitizing dye 8 | $6.52\times10^{-4}$ |
| | Sensitizing dye 13 | $1.35\times10^{-4}$ |
| | Sensitizing dye 6 | $2.48\times10^{-5}$ |
| Em-I | Sensitizing dye 8 | $6.09\times10^{-4}$ |
| | Sensitizing dye 13 | $1.26\times10^{-4}$ |
| | Sensitizing dye 6 | $2.32\times10^{-5}$ |
| Em-K | Sensitizing dye 7 | $6.27\times10^{-4}$ |
| | Sensitizing dye 8 | $2.24\times10^{-4}$ |
| Em-M | Sensitizing dye 9 | $2.43\times10^{-4}$ |
| | Sensitizing dye 10 | $2.43\times10^{-4}$ |
| | Sensitizing dye 11 | $2.43\times10^{-4}$ |
| Em-N | Sensitizing dye 9 | $3.28\times10^{-4}$ |
| | Sensitizing dye 10 | $3.28\times10^{-4}$ |
| | Sensitizing dye 11 | $3.28\times10^{-4}$ |

Sensitizing dye 13

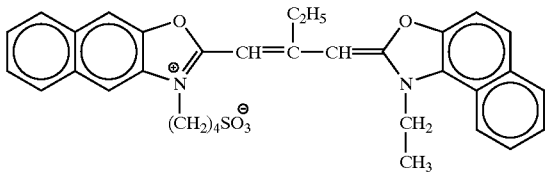

TABLE 3

| Emulsion | Average iodide content (mol %) | Equivalent-sphere diameter (μm) | Aspect ratio | Equivalent-circle diameter (μm) | Grain thickness (μm) | shape |
|---|---|---|---|---|---|---|
| A | 4 | 0.92 | 14 | 2 | 0.14 | Tabular |
| B | 5 | 0.8 | 12 | 1.6 | 0.13 | Tabular |
| C | 4.7 | 0.51 | 7 | 0.85 | 0.12 | Tabular |
| D | 3.9 | 0.37 | 2.7 | 0.4 | 0.15 | Tabular |
| E | 5 | 0.92 | 14 | 2 | 0.14 | Tabular |
| F | 5.5 | 0.8 | 12 | 1.6 | 0.13 | Tabular |
| G | 4.7 | 0.51 | 7 | 0.85 | 0.12 | Tabular |
| H | 3.7 | 0.49 | 3.2 | 0.58 | 0.18 | Tabular |
| I | 2.8 | 0.29 | 1.2 | 0.27 | 0.23 | Tabular |
| J | 5 | 0.8 | 12 | 1.6 | 0.13 | Tabular |
| K | 3.7 | 0.47 | 3 | 0.53 | 0.18 | Tabular |
| L | 5.5 | 1.4 | 9.8 | 2.62 | 0.27 | Tabular |
| M | 8.8 | 0.64 | 5.2 | 0.85 | 0.16 | Tabular |
| N | 3.7 | 0.37 | 4.6 | 0.55 | 0.12 | Tabular |
| O | 1.8 | 0.19 | — | — | — | Cubic |

Referring to Table 3, dislocation lines as described in JP-A-3-237450 were observed in the tabular grains when the observation was conducted through a high-voltage electron microscope.

1) Support

The support employed in this Example was prepared by the following procedure.

1) First layer and subbing layer:

Both major surfaces of a 90 μm thick polyethylene naphthalate support were treated with glow discharge under such conditions that the treating ambient pressure was 0.2 Torr, the $H_2O$ partial pressure of ambient gas 75%, the discharge frequency 30 kHz, the output 2500 W, and the treating strength 0.5 kV.A.min/$m^2$. This support was coated, in a coating amount of 5 mL/m , with a coating liquid of the following composition to provide the 1 st layer in accordance with the bar coating method described in JP-B-58-4589 (U.S. Pat. No. 4,263, 870).

| | |
|---|---|
| Conductive fine grain dispersion ($SnO_2/Sb_2O_5$ grain conc. 10% water dispersion, secondary agglomerate of 0.005 μm diam. primary grains which has an av. grain size of 0.05 μm) | 50 pts.wt. |
| Gelatin | 0.5 pt.wt. |
| Water | 49 pts.wt. |
| Polyglycerol polyglycidyl ether | 0.16 pt.wt. |
| Polyoxyethylene sorbitan monolaurate (polymn. degree 20) | 0.1 pt.wt. |

The support furnished with the first coating layer was wound round a stainless steel core of 20 cm diameter and heated at 110° C. (Tg of PEN support: 119° C.) for 48 hr to thereby effect heat history annealing. The other side of the support opposite to the first layer was coated, in a coating amount of 10 mL/$m^2$, with a coating liquid of the following composition to provide a subbing layer for emulsion in accordance with the bar coating method.

Gelatin 1.01 pts.wt.

Salicylic acid 0.30 pt.wt.

Resorcin 0.40 pt.wt.

Polyoxyethylene nonylphenyl ether (polymn. degree 10) 0.11 pt.wt.

Water 3.53 pts.wt.

Methanol 84.57 pts.wt.

n-Propanol 10.08 pts.wt.

Furthermore, the following second layer and third layer were superimposed in this sequence on the first layer by coating. Finally, multilayer coating of a color negative lightsensitive material of the composition indicated below was performed on the opposite side. Thus, a transparent magnetic recording medium with silver halide emulsion layers was obtained.

2) Second layer (transparent magnetic recording layer):

(1) Dispersion of magnetic substance:

1100 parts by weight of Co-coated γ-$Fe_2O_3$ magnetic substance (average major axis length: 0.25 μm, SBET: 39 $m^2$/g, Hc: 831, Oe, σS: 77.1 emu/g, and σr: 37.4 emu/g), 220 parts by weight of water and 165 parts by weight of silane coupling agent (3-(poly(polymerization degree: 10)oxyethyl)oxypropyltrimethoxysilane) were fed into an open kneader, and blended well for 3 hr. The resultant coarsely dispersed viscous liquid was dried at 70° C. round the clock to thereby remove water, and heated at 110° C. for 1 hr. Thus, surface treated magnetic grains were obtained.

Further, in accordance with the following recipe, a composition was prepared by blending by means of the open kneader once more for 4 hr:

Thus obtained surface treated magnetic grains 855 g

Diacetylcellulose 25.3 g

Methyl ethyl ketone 136.3 g

Cyclohexanone 136.3 g

Still further, in accordance with the following recipe, a composition was prepared by carrying out fine dispersion by means of a sand mill (1/4G sand mill) at 2000 rpm for 4 hr. Glass beads of 1 mm diameter were used as medium.

Thus obtained blend liquid 5 g

Diacetylcellulose 23.7 g

Methyl ethyl ketone 127.7 g

Cyclohexanone 127.7 g

Moreover, in accordance with the following recipe, a magnetic substance containing intermediate liquid was prepared.

(2) Preparation of magnetic substance containing intermediate liquid:

Thus obtained fine dispersion of magnetic substance 674 g

Diacetylcellulose soln. (solid content 4.34%, solvent: methyl ethyl ketone/cyclohexanone=1/1) 24,280 g Cyclohexanone 46 g These were mixed together and agitated by means of a disperser to thereby obtain a "magnetic substance containing intermediate liquid".

An α-alumina abrasive dispersion of the present invention was produced in accordance with the following recipe.

(a) Preparation of Sumicorundum AA-1.5 (average primary grain diameter: 1.5 μm, specific surface area: 1.3 $m^2$/g) grain dispersion Sumicorundum AA-1.5 152 g Silane coupling agent KBM903 (produced by Shin- Etsu Silicone) 0.48 g Diacetylcellulose soln. (solid content 4.5%, solvent: methyl ethyl ketone/cyclohexanone=1/1) 227.52 g In accordance with the above recipe, fine dispersion was carried out by means of a ceramic-coated sand mill (1/4G sand mill) at 800 rpm for 4 hr. Zirconia beads of 1 mm diameter were used as medium.

(b) Colloidal silica grain dispersion (fine grains)

Use was made of "MEK-ST" produced by Nissan Chemical Industries, Ltd.

This is a dispersion of colloidal silica of 0.015 μm average primary grain diameter in methyl ethyl ketone as a dispersion medium, wherein the solid content is 30%.

(3) Preparation of a coating liquid for second layer:

Thus obtained magnetic substance containing intermediate liquid 19.053 g

Diacetylcellulose soln. (solid content 4.5%, solvent: methyl ethyl ketone/cyclohexanone=1/1) 264 g Colloidal silica dispersion "MEK-ST" (dispersion b, solid content: 30%) 128 g AA-1.5 dispersion (dispersion a) 12 g Millionate MR-400 (produced by Nippon Polyurethane) diluent (solid content 20%, dilution solvent: methyl ethyl ketone/cyclohexanone=1/1) 203 g Methyl ethyl ketone 170 g Cyclohexanone 170 g A coating liquid obtained by mixing and agitating these was applied in a coating amount of 29.3 mL/$m^2$ with the use of a wire bar. Drying was performed at 110° C. The thickness of magnetic layer after drying was 1.0 μm.

3) Third layer (higher fatty acid ester sliding agent containing layer)

(1) Preparation of raw dispersion of sliding agent

The following liquid A was heated at 100° C. to thereby effect dissolution, added to liquid B and dispersed by means of a high-pressure homogenizer, thereby obtaining a raw dispersion of sliding agent.

Liquid A:

Compd. of the formula: $C_6H_{13}CH(OH)(CH_2)_{10}COOC_{50}H_{101}$ 399 pts.wt.

Compd. of the formula: n—$C_{50}H_{101}O(CH_2CH_2O)_{16}H$ 171 pts.wt.

Cyclohexanone 830 pts.wt.

Liquid B:

Cyclohexanone 8600 pts.wt.

(2) Preparation of spherical inorganic grain dispersion

Spherical inorganic grain dispersion (c1) was prepared in accordance with the following recipe.

Isopropyl alcohol 93.54 pts.wt.

Silane coupling agent KBM903 (produced by ShinEtsu Silicone) Compd. 1-1: $(CH_3O)_3Si—(CH_2)_3—NH_2$) 5.53 pts.wt.

Compd. 2-1 2.93 pts.wt.

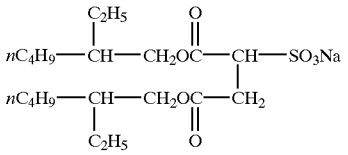

Seahostar KEP50 (amorphous spherical silica, av. grain size 0.5 μm, produced by Nippon Shokubai Kagaku Kogyo 88.00 pts.wt.

This composition was agitated for 10 min, and further the following was added.

Diacetone alcohol 252.93 pts.wt.

The resultant liquid was dispersed by means of ultrasonic homogenizer "Sonifier 450 (manufactured by Branson)" for 3 hr while cooling with ice and stirring, thereby finishing spherical inorganic grain dispersion c1.

(3) Preparation of spherical organic polymer grain dispersion

Spherical organic polymer grain dispersion (c2) was prepared in accordance with the following recipe.

XC99-A8808 (produced by Toshiba Silicone Co., Ltd., spherical crosslinked polysiloxane grain, av. grain size 0.9 μm) 60 pts.wt.

Methyl ethyl ketone 120 pts.wt.

Cyclohexanone 120 pts.wt. (solid content 20%, solvent: methyl ethyl ketone/cyclohexanone=1/1)

This mixture was dispersed by means of ultrasonic homogenizer "Sonifier 450 (manufactured by Branson)" for 2 hr while cooling with ice and stirring, thereby finishing spherical organic polymer grain dispersion c2.

(4) Preparation of coating liquid for 3rd layer

A coating liquid for 3rd layer was prepared by adding the following components to 542 g of the aforementioned raw dispersion of sliding agent:

Diacetone alcohol 5950 g

Cyclohexanone 176 g

Ethyl acetate 1700 g

Above Seahostar KEP50 dispersion (c1) 53.1 g

Above spherical organic polymer grain dispersion (c2) 300 g

FC431 (produced by 3M, solid content 50%, solvent: ethyl acetate) 2.65 g

BYK310 (produced by BYK Chemijapan, solid content 25%) 5.3 g.

The above 3rd-layer coating liquid was applied to the 2 nd layer in a coating amount of 10.35 mL/m$^2$, dried at 110° C. and further postdried at 97° C. for 3 min.

4) Application of lightsensitive layer by coating:

The thus obtained back layers on its side opposite to the support were coated with a plurality of layers of the following respective compositions, thereby obtaining a color negative film.

(Composition of lightsensitive layer)

Main materials used in each of the layers are classified as follows:

ExC: cyan coupler, UV: ultraviolet absorber,

ExM: magenta coupler, HBS: high b.p. org. solvent,

ExY: yellow coupler, H: gelatin hardener.

(For each specific compound, in the following description, numeral is assigned after the character, and the formula is shown later).

The numeric value given beside the description of each component is for the coating amount expressed in the unit of g/m$^2$. With respect to the silver halide, the coating amount is in terms of silver quantity.

1st layer (First antihalation layer)

| | | |
|---|---|---|
| Black colloidal silver | silver | 0.122 |
| 0.07 μm silver iodobromide emulsion | silver | 0.01 |
| Gelatin | | 0.919 |
| ExC-1 | | 0.002 |
| ExC-3 | | 0.002 |
| Cpd-2 | | 0.001 |
| HBS-1 | | 0.005 |
| HBS-2 | | 0.002 |

2nd layer (Second antihalation layer)

| | | |
|---|---|---|
| Black colloidal silver | silver | 0.055 |
| Gelatin | | 0.425 |
| ExF-1 | | 0.002 |
| Solid disperse dye ExF-9 | | 0.120 |
| HBS-1 | | 0.074 |

3rd layer (Low-speed red-sensitive emulsion layer)

| | | |
|---|---|---|
| Em-D | silver | 0.577 |
| Em-C | silver | 0.347 |
| ExC-1 | | 0.188 |
| ExC-2 | | 0.011 |
| ExC-3 | | 0.075 |
| ExC-4 | | 0.121 |
| ExC-5 | | 0.010 |
| ExC-6 | | 0.007 |
| Cpd-2 | | 0.025 |
| Cpd-4 | | 0.025 |
| Cpd-7 | | 0.050 |
| Cpd-8 | | 0.050 |
| HBS-1 | | 0.114 |

-continued

| | | |
|---|---|---|
| HBS-5 | | 0.038 |
| Gelatin | | 1.474 |

4th layer (Medium-speed red-sensitive emulsion layer)

| | | |
|---|---|---|
| Em-B | silver | 0.431 |
| Em-C | silver | 0.432 |
| ExC-1 | | 0.154 |
| ExC-2 | | 0.068 |
| ExC-3 | | 0.018 |
| ExC-4 | | 0.103 |
| ExC-5 | | 0.023 |
| ExC-6 | | 0.010 |
| Cpd-2 | | 0.036 |
| Cpd-4 | | 0.028 |
| Cpd-7 | | 0.010 |
| Cpd-8 | | 0.010 |
| HBS-1 | | 0.129 |
| Gelatin | | 1.086 |

5th layer (High-speed red-sensitive emulsion layer)

| | | |
|---|---|---|
| Em-A | silver | 1.108 |
| ExC-1 | | 0.180 |
| ExC-3 | | 0.035 |
| ExC-6 | | 0.029 |
| Cpd-2 | | 0.064 |
| Cpd-4 | | 0.077 |
| Cpd-7 | | 0.040 |
| Cpd-8 | | 0.040 |
| HBS-1 | | 0.329 |
| HBS-2 | | 0.120 |
| Gelatin | | 1.245 |

6th layer (Interlayer)

| | |
|---|---|
| Cpd-1 | 0.094 |
| Cpd-9 | 0.369 |
| Solid disperse dye ExF-4 | 0.030 |
| HBS-1 | 0.049 |
| Polyethyl acrylate latex | 0.088 |
| Gelatin | 0.886 |

7th layer (Layer capable of exerting interlayer effect

| | | |
|---|---|---|
| Em-J | silver | 0.293 |
| Em-K | silver | 0.293 |
| Cpd-4 | | 0.030 |
| ExM-2 | | 0.120 |
| ExM-3 | | 0.016 |
| ExY-1 | | 0.016 |
| ExY-6 | | 0.036 |
| Cpd-6 | | 0.011 |
| HBS-1 | | 0.090 |
| HBS-3 | | 0.003 |
| HBS-5 | | 0.030 |
| Gelatin | | 0.610 |

8th layer (Low-speed green-sensitive emulsion layer)

| | | |
|---|---|---|
| Em-H | silver | 0.329 |
| Em-G | silver | 0.333 |
| Em-I | silver | 0.088 |
| ExM-2 | | 0.378 |
| ExM-3 | | 0.047 |
| ExY-1 | | 0.017 |
| HBS-1 | | 0.098 |
| HBS-3 | | 0.010 |
| HBS-4 | | 0.077 |
| HBS-5 | | 0.548 |
| Cpd-5 | | 0.010 |
| Gelatin | | 1.470 |

9th layer (Medium-speed green-sensitive emulsion layer)

| | | |
|---|---|---|
| Em-F | silver | 0.457 |
| ExM-2 | | 0.032 |
| ExM-3 | | 0.029 |
| ExM-4 | | 0.029 |
| ExY-1 | | 0.007 |
| ExC-6 | | 0.010 |
| HBS-1 | | 0.065 |
| HBS-3 | | 0.002 |
| HBS-5 | | 0.020 |
| Cpd-5 | | 0.004 |
| Gelatin | | 0.446 |

10th layer (High-speed green-sensitive emulsion layer)

| | | |
|---|---|---|
| Em-E | silver | 0.794 |
| ExC-6 | | 0.002 |
| ExM-1 | | 0.013 |
| ExM-2 | | 0.011 |
| ExM-3 | | 0.030 |
| ExM-4 | | 0.017 |
| ExY-5 | | 0.003 |
| Cpd-3 | | 0.004 |
| Cpd-4 | | 0.007 |
| Cpd-5 | | 0.010 |
| HBS-1 | | 0.148 |
| HBS-5 | | 0.037 |
| Polyethyl acrylate latex | | 0.099 |
| Gelatin | | 0.939 |

11th layer (Yellow filter layer)

| | |
|---|---|
| Cpd-1 | 0.094 |
| Solid disperse dye ExF-2 | 0.150 |
| Solid disperse dye ExF-5 | 0.010 |
| Oil soluble dye ExF-7 | 0.010 |
| HBS-1 | 0.049 |
| Gelatin | 0.630 |

12th layer (Low-speed blue-sensitive emulsion layer)

| | | |
|---|---|---|
| Em-O | silver | 0.112 |
| Em-M | silver | 0.320 |
| Em-N | silver | 0.240 |
| ExC-1 | | 0.027 |
| ExY-1 | | 0.027 |
| ExY-2 | | 0.890 |
| ExY-6 | | 0.120 |
| Cpd-2 | | 0.100 |
| Cpd-3 | | 0.004 |
| HBS-1 | | 0.222 |

-continued

| | | |
|---|---|---|
| HBS-5 | | 0.074 |
| Gelatin | | 2.058 |

13th layer (High-speed blue-sensitive emulsion layer)

| | | |
|---|---|---|
| Em-L | silver | 0.714 |
| ExY-2 | | 0.211 |
| Cpd-2 | | 0.075 |
| Cpd-3 | | 0.001 |
| HBS-1 | | 0.071 |
| Gelatin | | 0.678 |

14th layer (1st protective layer)

| | | |
|---|---|---|
| | silver | 0.301 |
| UV-1 | | 0.211 |
| UV-2 | | 0.132 |
| UV-3 | | 0.198 |
| UV-4 | | 0.026 |
| F-18 | | 0.009 |
| S-1 | | 0.086 |
| HBS-1 | | 0.175 |
| HBS-4 | | 0.050 |
| Gelatin | | 1.984 |

15th layer (2nd protective layer)

| | |
|---|---|
| H-1 | 0.400 |
| B-1 (diameter 1.7 μm) | 0.050 |
| B-2 (diameter 1.7 μm) | 0.150 |
| B-3 | 0.050 |

-continued

| | |
|---|---|
| S-1 | 0.200 |
| Gelatin | 0.750 |

In addition to the above components, W-1 to W-6, B-4 to B-6, F-1 to F-17, a lead salt, a platinum salt, an iridium salt and a rhodium salt were appropriately added to the individual layers in order to improve the storage life, processability, resistance to pressure, antiseptic and mildew-proofing properties, antistatic properties and coating property thereof.

Preparation of dispersion of organic solid disperse dye:

The ExF-2 of the 11th layer was dispersed by the following method. Specifically, Wet cake of ExF-2 (contg. 17.6 wt.% water) 2.800 kg Sodium octylphenyldiethoxymethanesulfonate (31 wt. % aq. soln.) 0.376 kg F-15 (7% aq. soln.) 0.011 kg Water 4.020 kg Total 7.210 kg (adjusted to pH=7.2 with NaOH).

Slurry of the above composition was agitated by means of a dissolver to thereby effect a preliminary dispersion, and further dispersed by means of agitator mill LMK-4 under such conditions that the peripheral speed, delivery rate and packing ratio of 0.3 mm-diameter zirconia beads were 10 m/s, 0.6 kg/min and 80%, respectively, until the absorbance ratio of the dispersion became 0.29. Thus, a solid particulate dispersion was obtained, wherein the average particle diameter of dye particulate was 0.29 μm.

Solid dispersions of ExF-4 and ExF-9 were obtained in the same manner. The average particle diameters of these dye particulates were 0.28 μm and 0.49 μm, respectively. ExF-5 was dispersed by the microprecipitation dispersion method described in Example 1 of EP. No. 549,489A. The average particle diameter thereof was 0.06 μm.

The compounds used in the preparation of each of the layers will be listed below.

ExC-1

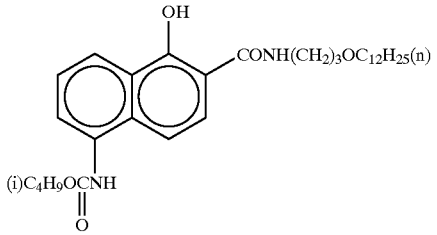

ExC-6

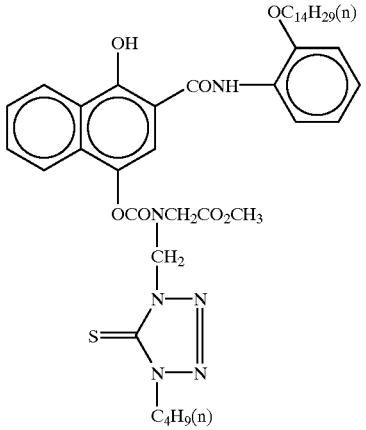

-continued
ExC-2
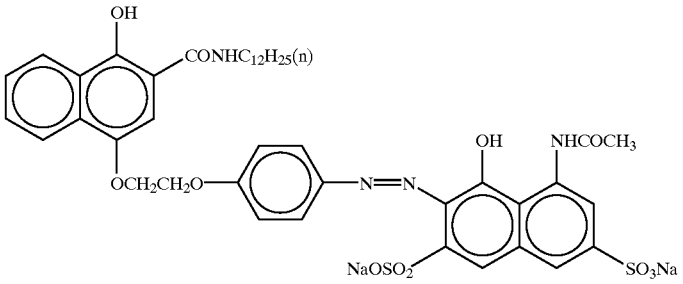
ExC-3
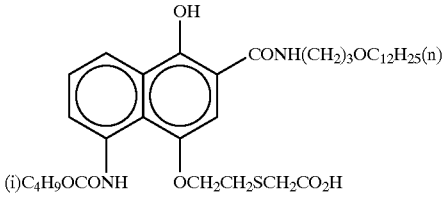
ExC-4
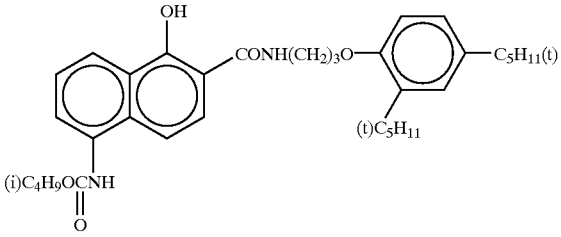
ExC-5
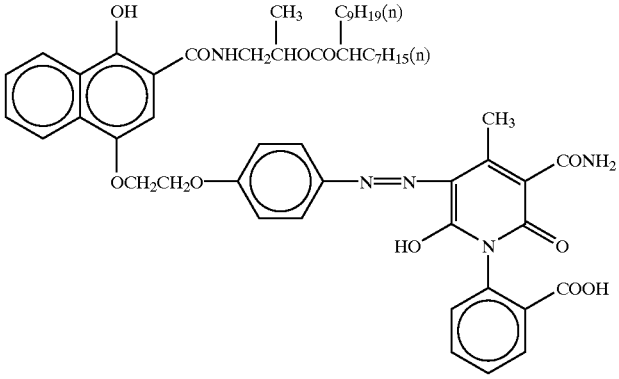
ExM-1
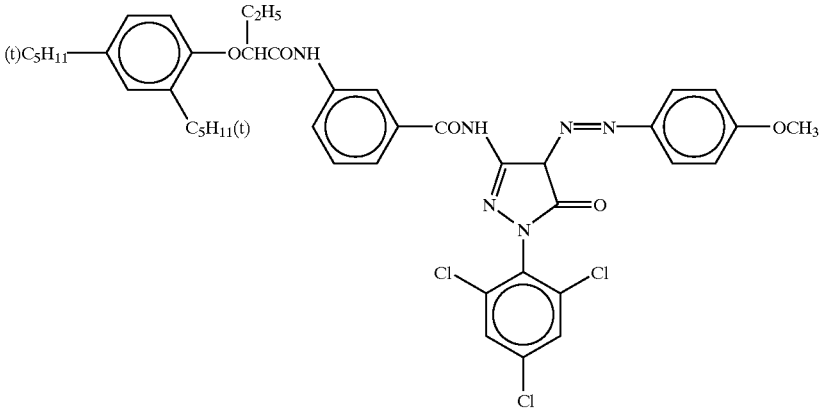

-continued
ExM-2
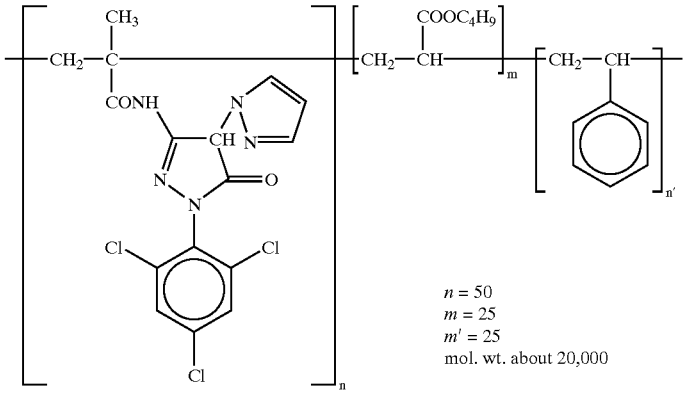
ExM-3
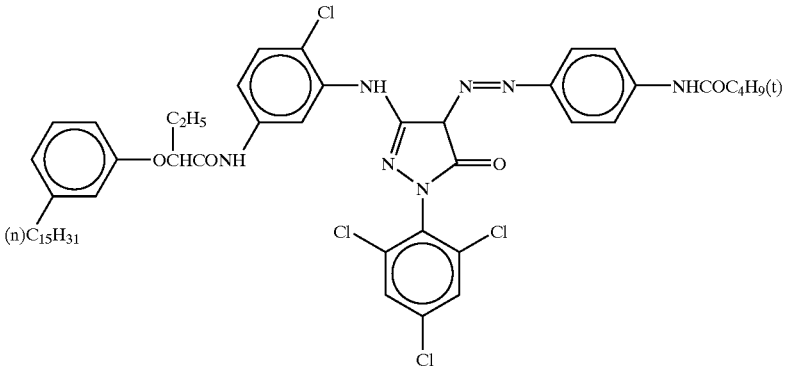
ExM-4
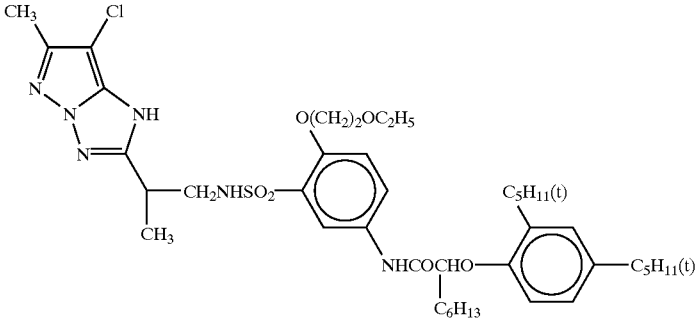
ExY-1
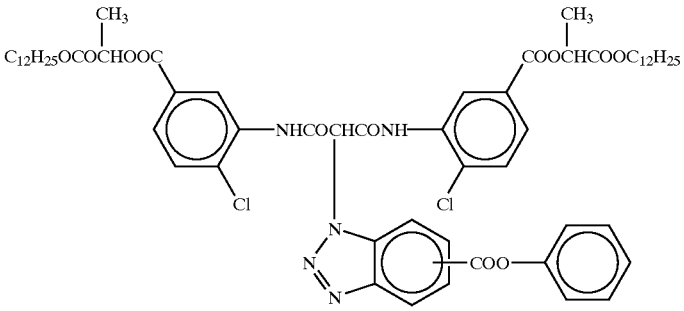

-continued
ExY-2
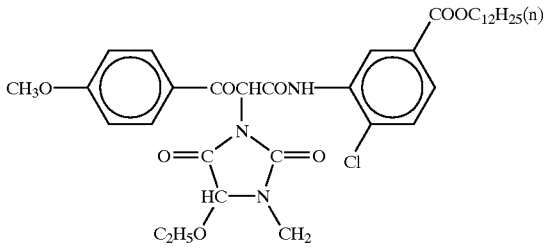
ExY-5
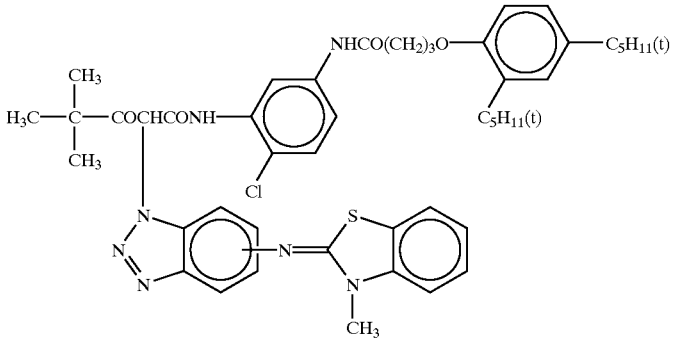
ExY-6
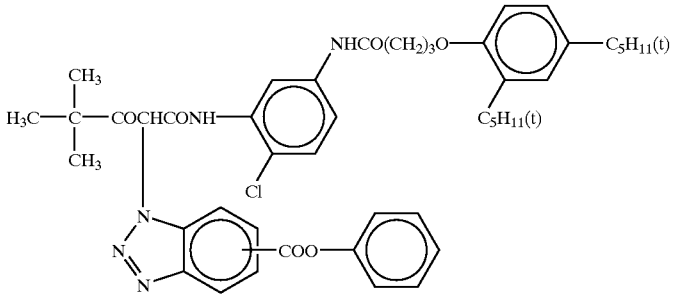
Cpd-1
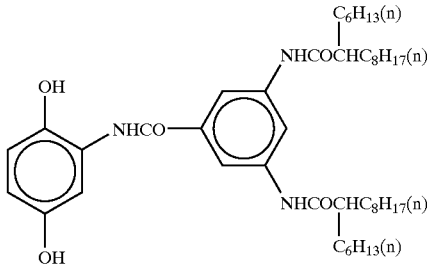
Cpd-2
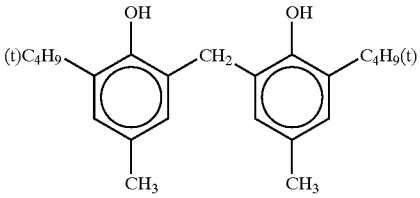
Cpd-3
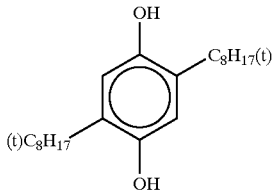
Cpd-4
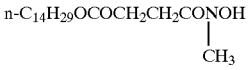
Cpd-5
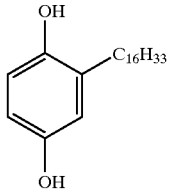
UV-1
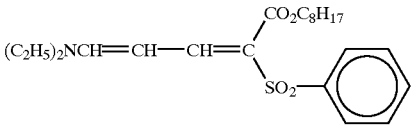

-continued
UV-2
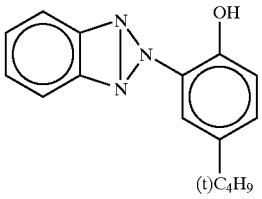
UV-3
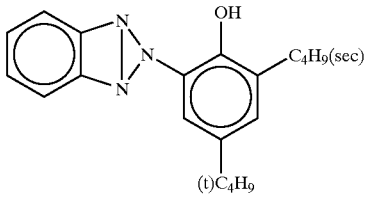
UV-4
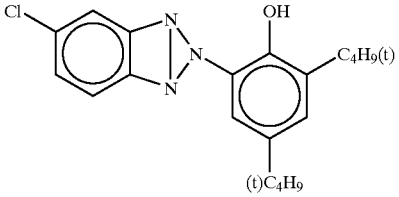
B-1
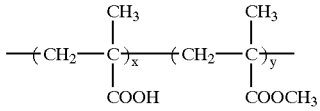
x/y = 10/90 (Weight ratio)
Average mol. wt.: about 35,000
B-2
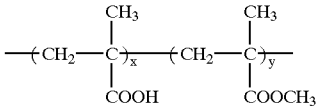
x/y = 40/60 (Weight ratio)
Average mol. wt.: about 20,000
B-3
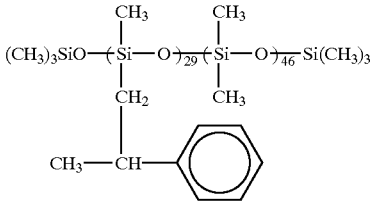
(molar ratio)
Average mol. wt.: about 8,000
H-1
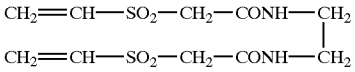
S-1
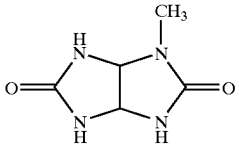
HBS-1 Tricresyl phosphate
HBS-2 Di-n-butyl phthalate
HBS-3
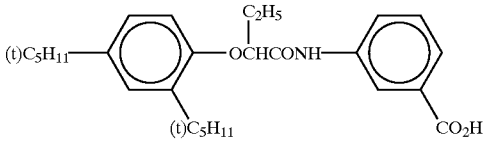
HBS-4 Tri(2-ethylhexyl)phosphate
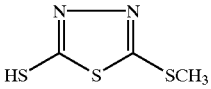
F-1
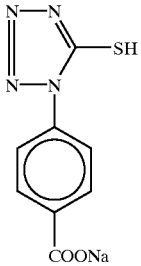
F-2

-continued
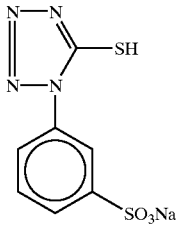
F-3
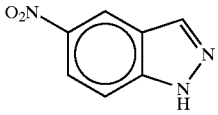
F-4
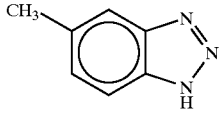
F-5
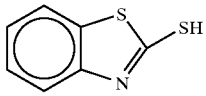
F-6
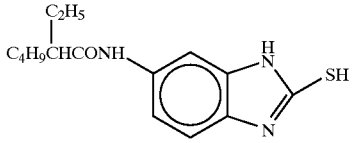
F-7
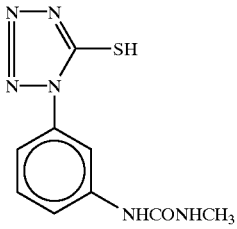
F-8
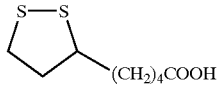
F-9
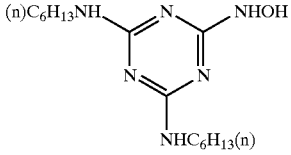
F-10
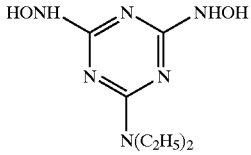
F-11
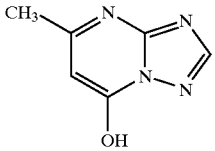
F-12
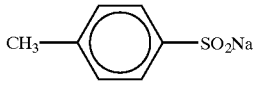
F-13
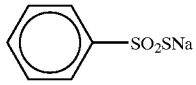
F-14
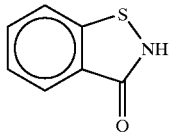
F-15
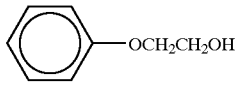
F-16
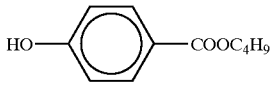
F-17
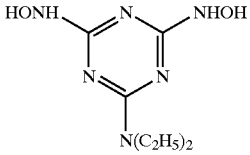
F-18
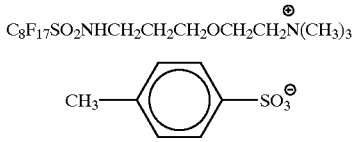
W-1
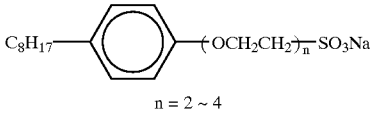
W-2

-continued
W-3
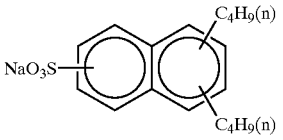
W-4
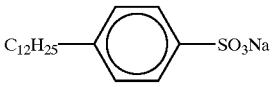
W-5
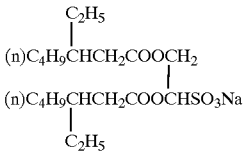
B-4
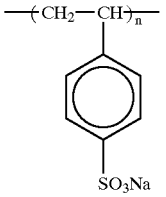
Average mol. wt.: about 750,000
B-5
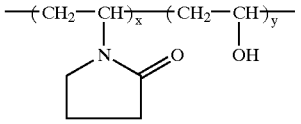
x/y = 70/30 (Weight ratio)
Average mol. wt.: about 17,000
B-6
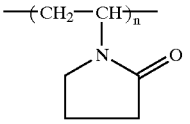
Average mol. wt.: about 10,000
W-6
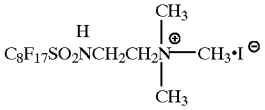
Cpd-6
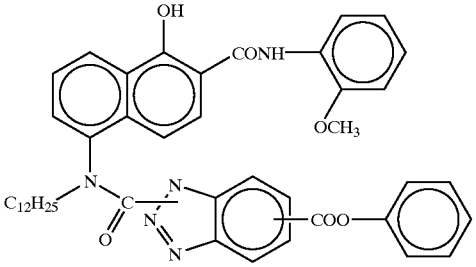
Cpd-7
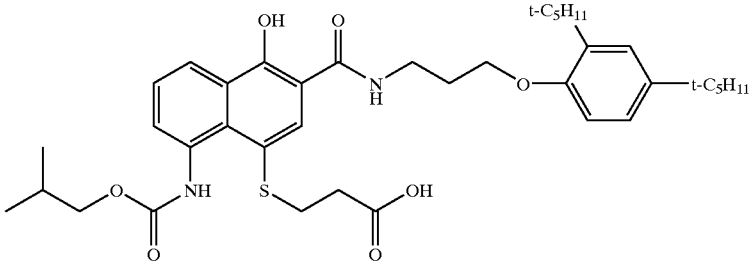
Cpd-8
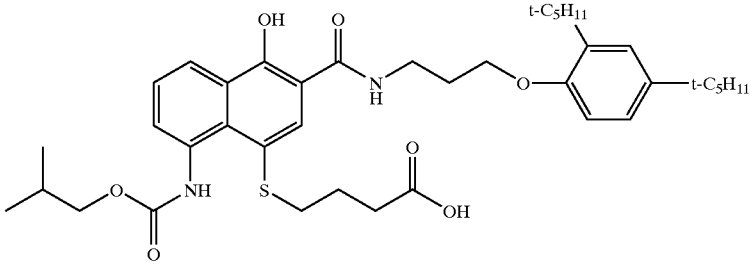

-continued

Cpd-9

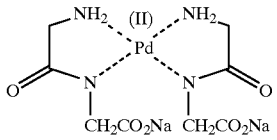

HBS-5

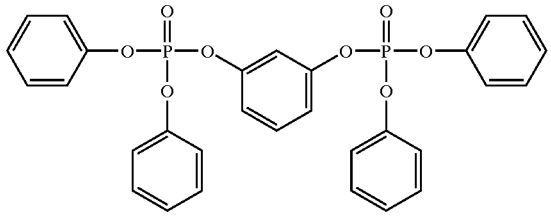

ExF-1

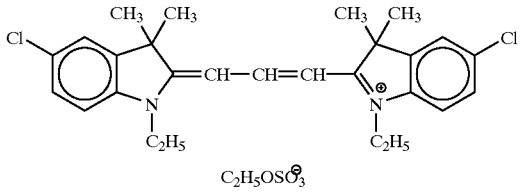

ExF-2

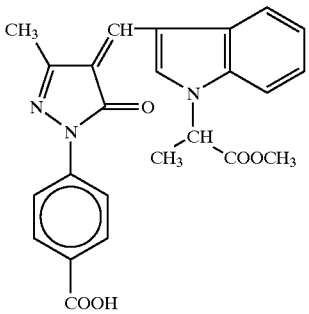

ExF-4

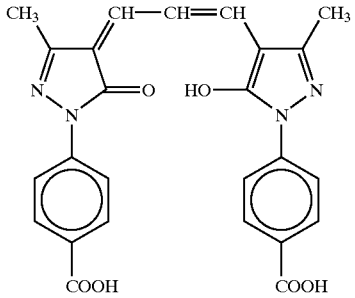

ExF-5

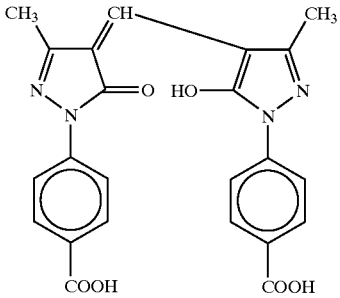

ExF-7

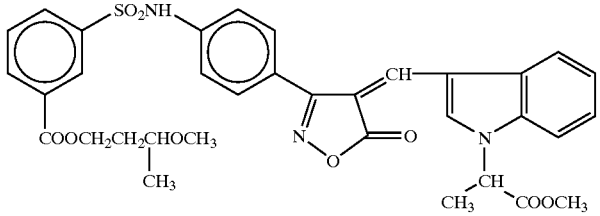

ExF-9

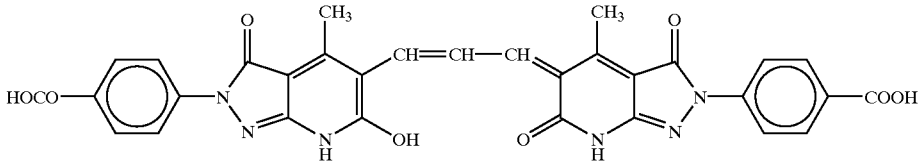

The thus prepared color negative lightsensitive material is designated sample 001.

Preparation of Sample 002 (Present Invention)

Sample 002 was prepared in the same manner as the sample 001, except that the following change was effected.

(Preparation of Em-A')

Em-A' was prepared in the same manner as Em-A, except that the addition amounts of $AgNO_3$ and KBr at nucleation was 0.7-fold of that for the preparation of Em-A, that, with respect to all the spectral sensitizing dyes added prior to chemical sensitization, the addition amounts were 0.9-fold of that for the preparation of Em-A, that the addition amount of N,N-dimethylselenourea at chemical sensitization was 0, and that the addition amounts of other compounds were changed so as to attain the optimum chemical sensitization. The aspect ratio of the thus prepared emulsion was 15.

(Preparation of Em-E')

Em-E' was prepared in the same manner as Em-E, except that the addition amount of $AgNO_3$ and KBr at nucleation was 0.7-fold of that for the preparation of Em-E, that, with respect to all the spectral sensitizing dyes added prior to chemical sensitization, the addition amounts were 0.9-fold of that for the preparation of Em-E, that the addition amount of N,N-dimethylselenourea at chemical sensitization was 0, and that the addition amounts of other compounds were changed so as to attain the optimum chemical sensitization. The aspect ratio of the thus prepared emulsion was 15.

(Preparation of Em-L')

Em-L' was prepared in the same manner as Em-L, except that the addition amount of silver bromide seed crystal emulsion was 0.7-fold of that for the preparation of Em-L, that, with respect to all the spectral sensitizing dyes added prior to chemical sensitization, the addition amounts thereof were 0.9-fold of those for the preparation of Em-L, that the addition amount of N,N-dimethylselenourea at chemical sensitization was 0, and that the addition amounts of other compounds were changed so as to attain the optimum chemical sensitization.

Sample 002 was prepared in the same manner as the sample 001, except that Em-A, Em-E and Em-L were replaced by Em-A', Em-E' and Em-L', respectively.

Preparation of Sample 101 (Comparative Example)

Sample 101 was prepared in the same manner as the sample 001, except that Em-A was replaced by silver iodobromide emulsion (nontabular grains whose average grain size was 2.0 $\mu$m and average silver iodide content was 10 mol %) contained in the fifth layer (third red-sensitive emulsion layer) of sample 001 described in the Example portion of JP-A-63-226650 and that Em-E was replaced by silver iodobromide emulsion (nontabular grains whose average grain size was 2.0 $\mu$m and average silver iodide content was 10 mol %) contained in the ninth layer (third green-sensitive emulsion layer) of sample 001 described in the Example portion of JP-A-63-226650.

Preparation of Samples 102 (Comparative Example), 103 (Comparative Example) and 104 (Comparative Example)

Sample 102 (comparative example) was prepared in the same manner as the sample 001, except that the silver contents of individual layers thereof were changed as indicated in Table 4. Sample 103 (comparative example) was prepared in the same manner as the sample 002, except that the silver contents of individual layers thereof were changed as indicated in Table 4. Sample 104 (comparative example) was prepared in the same manner as the sample 101, except that the silver contents of individual layers thereof were changed as indicated in Table 4.

The above samples 001–002 and 101–104 were placed in an atmosphere of 30±1° C. temperature and 60±5% relative humidity for 2 weeks, gelatin hardener was reacted thereto, and stored under two different conditions specified in Table 5 below.

Table 5

Storage conditions

A: immediately subjected to processing, and

B: stored in natural environment for one year at Fuji Photo Film Co., Ltd. Ashigara Laboratory, MinamiAshigara City, Kanagawa Prefecture before processing.

Storage condition B indicates storage in natural environment for one year, and the radiation dosage in the laboratory was approximately 40 mR/year as measured by TLD (Thermo Luminescence Detector).

The samples having been stored under the different conditions of Table 5 above were exposed through gelatin filter SC-39 manufactured by Fuji Photo Film Co., Ltd. and continuous wedge for 1/100 sec.

The development was carried out by the use of automatic processor FP-360B manufactured by Fuji Photo Film Co., Ltd. under the following conditions. The apparatus was reworked so as to prevent the flow of overflow solution from the bleaching bath toward subsequent baths and to, instead, discharge all the solution into a waste solution tank. This FP-360B is fitted with an evaporation correcting means described in JIII Journal of Technical Disclosure No. 94-4992 issued by Japan Institute of Invention and Innovation.

The processing steps and compositions of processing solutions are as follows.

(Processing Steps)

| Step | Time | Temp. | Qty. of replenisher* | Tank vol. |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |

TABLE 4

| Remarks | Invention | Invention | Comparison | Comparison | Comparison | Comparison |
|---|---|---|---|---|---|---|
| Sample | 001 | 002 | 101 | 102 | 103 | 104 |
| Coated silver amount of high-speed blue sensitive emulsion layer (g/m$^2$) | 0.71 | 0.71 | 0.71 | 0.80 | 1.03 | 1.31 |
| Emulsion of high-speed green sensitive emulsion layer (Aspect ratio) | Em-E (14) | Em-E' (15) | non-tabular | Em-E (14) | Em-E' (15) | non-tabular |
| Coated silver amount (g/m$^2$) | 0.79 | 0.79 | 0.79 | 0.81 | 1.29 | 1.44 |
| Emulsion of high-speed red sensitive emulsion layer (Aspect ratio) | Em-A (14) | Em-A' (15) | non-tabular | Em-A (14) | Em-A' (15) | non-tabular |
| Coated silver amount (g/m$^2$) | 1.11 | 1.11 | 1.11 | 1.73 | 1.89 | 1.73 |
| Total silver amount in the high-speed emulsion layers (g/m$^2$) | 2.61 | 2.61 | 2.61 | 3.34 | 4.21 | 4.48 |
| Total silver amount in the light sensitive material (g/m$^2$) | 7.36 | 7.36 | 7.36 | 8.09 | 8.96 | 9.23 |

-continued

| Step | Time | Temp. | Qty. of replenisher* | Tank vol. |
|---|---|---|---|---|
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60° C. | | |

*The replenishment rate is a value per 1.1 m of a 35-mm wide lightsensitive material (equivalent to one role of 24 Ex. film).

The stabilizer was fed from stabilization (2) to stabilization (1) by counter current. All the overflow of washing water was introduced into fixing bath (2). The amounts of drag-in of developer into the bleaching step, drag-in of bleaching solution into the fixing step and drag-in of fixer into the washing step were 2.5 mL, 2.0 mL and 2.0 mL, respectively, per 1.1 m of a 35-mm wide lightsensitive material. Each crossover time was 6 sec, which was included in the processing time of the previous step.

The open area of the above processor was 100 $cm^2$ for the color developer, 120 $cm^2$ for the bleaching solution and about 100 $cm^2$ for the other processing solutions.

The composition of each of the processing solutions was as follows.

| (Color developer) | Tank soln. (g) | Replenisher (g) |
|---|---|---|
| Diethylenetriamine-pentaacetic acid | 3.0 | 3.0 |
| Disodium catechol-3,5-disulfonate | 0.3 | 0.3 |
| Sodium sulfite | 3.9 | 5.3 |
| Potassium carbonate | 39.0 | 39.0 |
| Disodium-N,N-bis(2-sulfonatoethyl)hydroxylamine | 1.5 | 2.0 |
| Potassium bromide | 1.3 | 0.3 |
| Potassium iodide | 1.3 mg | — |
| 4-Hydroxy-6-methyl-1,3,3a,7-tetrazaindene | 0.05 | — |
| Hydroxylamine sulfate | 2.4 | 3.3 |
| 2-Methyl-4-[N-ethyl-N-(β-hydroxyethyl)amino]-aniline sulfate | 4.5 | 6.5 |
| Water | q.s. ad 1.0 L | |
| pH | 10.05 | 10.18. |

This pH was adjusted by the use of potassium hydroxide and sulfuric acid.

| (Bleaching soln.) | Tank soln. (g) | Replenisher (g) |
|---|---|---|
| Fe(III) ammonium 1,3-diaminopropanetetraacetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water | q.s. ad 1.0 L | |
| pH | 4.6 | 4.0. |

This pH was adjusted by the use of aqueous ammonia.

(Fixing (1) tank soln.)

5:95 (by volume) mixture of the above bleaching tank soln. and the following fixing tank soln, pH 6.8.

| (Fixing (2)) | Tank soln. (g) | Replenisher (g) |
|---|---|---|
| Aq. soln. of ammonium thiosulfate (750 g/L) | 240 mL | 720 mL |
| Imidazole | 7 | 21 |
| Ammonium methanethiosulfonate | 5 | 15 |
| Ammonium methanesulfinate | 10 | 30 |
| Ethylenediaminetetraacetic acid | 13 | 39 |
| Water | q.s. ad 1.0 L | |
| pH | 7.4 | 7.45. |

This pH was adjusted by the use of aqueous ammonia and acetic acid.

(Washing water)

Tap water was passed through a mixed-bed column filled with H-type strongly acidic cation exchange resin (Amberlite IR-120B produced by Rohm & Haas Co.) and OH-type strongly basic anion exchange resin (Amberlite IR-400 produced by the same maker) so as to set the concentration of calcium and magnesium ions at 3 mg/L or less. Subsequently, 20 mg/L of sodium dichloroisocyanurate and 150 mg/L of sodium sulfate were added. The pH of the solution ranged from 6.5 to 7.5.

| (Stabilizer): common to tank solution and replenisher. | (g) |
|---|---|
| Sodium p-toluenesulfinate | 0.03 |
| Polyoxyethylene p-mononylphenyl ether (average polymerization degree 10) | 0.2 |
| Sodium salt of 1,2-benzoisothiazolin-3-one | 0.10 |
| Disodium ethylenediaminetetraacetate | 0.05 |
| 1,2,4-triazole | 1.3 |
| 1,4-bis(1,2,4-triazole-1-ylmethyl)-piperazine | 0.75 |
| Water | q.s. ad 1.0 L |
| pH | 8.5. |

The sensitivity, fog and graininess of each of the samples having undergone the above processing were measured. The graininess was measured by the common RMS (Root Mean Square) method.

The measurement results of sensitivity, fog and graininess are given in Table 6. The RMS values are those obtained by measuring at an exposure amount of 0.0005 lux second.

TABLE 6

| Remarks | | Invention | Invention | Comparison | Comparison | Comparison | Comparison |
|---|---|---|---|---|---|---|---|
| Sample | | 001 | 002 | 101 | 102 | 103 | 104 |
| Coated silver amount of high-speed blue sensitive emulsion layer ($g/m^2$) | | 0.71 | 0.71 | 0.71 | 0.80 | 1.03 | 1.31 |
| Emulsion of high-speed green sensitive emulsion layer (Aspect ratio) | | Em-E (14) | Em-E' (15) | non-tabular | Em-E (14) | Em-E' (15) | non-tabular |
| Coated silver amount ($g/m^2$) | | 0.79 | 0.79 | 0.79 | 0.81 | 1.29 | 1.44 |
| Emulsion of high-speed red sensitive emulsion layer (Aspect ratio) | | Em-A (14) | Em-A' (15) | non-tabular | Em-A (14) | Em-A' (15) | non-tabular |
| Coated silver amount ($g/m^2$) | | 1.11 | 1.11 | 1.11 | 1.73 | 1.89 | 1.73 |
| Total silver amount in the high-speed emulsion layers ($g/m^2$) | | 2.61 | 2.61 | 2.61 | 3.34 | 4.21 | 4.48 |
| Total silver amount in the light sensitive material ($g/m^2$) | | 7.36 | 7.36 | 7.36 | 8.09 | 8.96 | 9.23 |
| Sensitivity | | 800 | 798 | 796 | 800 | 799 | 781 |
| Sensitivity after the storage | | 782 | 775 | 771 | 620 | 574 | 563 |
| Difference of fog values between before and after the storage (Δfog) | B | 0.03 | 0.03 | 0.03 | 0.04 | 0.05 | 0.07 |
| | G | 0.02 | 0.02 | 0.04 | 0.02 | 0.05 | 0.08 |
| | R | 0.01 | 0.02 | 0.04 | 0.04 | 0.06 | 0.07 |
| RMS | B | 0.052 | 0.051 | 0.052 | 0.051 | 0.049 | 0.048 |
| | G | 0.036 | 0.035 | 0.043 | 0.036 | 0.034 | 0.041 |
| | R | 0.028 | 0.028 | 0.038 | 0.026 | 0.026 | 0.035 |
| RMS after the storage | B | 0.055 | 0.057 | 0.057 | 0.056 | 0.060 | 0.063 |
| | G | 0.039 | 0.041 | 0.050 | 0.039 | 0.048 | 0.058 |
| | R | 0.034 | 0.036 | 0.049 | 0.044 | 0.050 | 0.055 |

It is apparent from Table 6 that samples 001 and 002 of the invention, having lower silver content in the high-speed layers and using emulsions of high aspect ratios in two of the high-speed layers, showed excellent performance with a small sensitivity decrease and fog increase after storage in natural environment for one year, and small RMS after storage, compared with samples 102 and 103 for comparison, having higher silver content in the high-speed layers. It is also apparent that the samples of the invention in which tabular grains having high aspect ratios are used in the high-speed layers showed better graininess than sample 101 for comparison in which nontabular grains are used in the high-speed layers. Sample 104 for comparison using nontabular grains generally used in the prior art and having higher silver coating amounts in the high-speed layers, showed large fog increment due to the storage and large RMS after the storage. To the contrary, the advantages attained by samples 001 and 002 of the invention are very large, which are useful.

Also, color-compensating chart produced by Macbeth Co. was photographed with the samples and printed onto color photographic papers on market with the developed samples. As a result, samples of the invention were evidently superior in color saturation, compared to every sample for comparison.

Example 2

Preparation of Samples 221 (Comparative Example)

Sample 221 was prepared from sample 001 by making the following changes.

Sample 221 was prepared in the same manner as Sample 001, except that Em-A and Em-E used in Sample 001 were replaced with Em-A2 and Em-E2, respectively. The preparation methods of Em-A2 and Em-E2 are set forth below.

(Preparation of Em-A2)

Em-A2 was prepared in the same manner as Em-A, except that the gelatin added after completion of ripening at 75° C. during grain formation was changed from "succinated gelatin 35 g" to "lime-treated gelatin 35 g"; that the addition amounts of all the spectral sensitizing dyes added before chemical sensitization were changed to 0.7-fold of those in Em-A, which are the optimum amounts for exerting sensitivity; and that the addition amounts of other compounds were appropriately changed so as to attain the optimum chemical sensitization. Thus, Em-A2 was prepared in the same manner as Em-A, except for the above changes. The grain volume of Em-A2 was equal to that of Em-A, but the aspect ratio of Em-A2 was 7.3.

(Preparation of Em-E2)

Em-E2 was prepared in the same manner as Em-E, except that the gelatin added after completion of ripening at 75° C. during grain formation was changed from "succinated gelatin 15 g and trimellitated gelatin 20 g" to "lime-treated gelatin 35 g"; that the addition amounts of all the spectral sensitizing dyes added before chemical sensitization were changed to 0.7-fold of those in Em-E, which are the optimum amounts for exerting sensitivity; and that the addition amounts of other compounds were appropriately changed so as to attain the optimum chemical sensitization. Thus, Em-E2 was prepared in the same manner as Em-E, except for the above changes. The grain volume of Em-E2 was equal to that of Em-E, but the aspect ratio of Em-E2 was 7.3.

Preparation of Samples 202, 203, 222 and 223

Samples 202, 203, 222 and 223 were prepared by changing the silver coating amounts of the 6th layer (high-speed red-sensitive emulsion layer) and the 11th layer (high-speed green-sensitive emulsion layer) of Sample 001 or 221 as set forth in Table 7. The same evaluations as in Example 1 were performed. The results are set forth in Table 7.

TABLE 7

| Remarks | | Invention | Comparison | Invention | Comparison | Comparison | Comparison |
|---|---|---|---|---|---|---|---|
| Sample | | 001 | 221 | 202 | 222 | 203 | 223 |
| Coated silver amount of high-speed blue sensitive emulsion layer ($g/m^2$) | | 0.71 | 0.71 | 0.90 | 0.90 | 1.10 | 1.10 |
| Emulsion of high-speed green sensitive emulsion layer (Aspect ratio) | | Em-E (14) | Em-E2 (7.3) | Em-E (14) | Em-E2 (7.3) | Em-E (14) | Em-E2 (7.3) |
| Coated silver amount ($g/m^2$) | | 0.79 | 0.79 | 1.00 | 1.00 | 1.40 | 1.40 |
| Emulsion of high-speed red sensitive emulsion layer (Aspect ratio) | | Em-A (14) | Em-A2 (7.3) | Em-A (14) | Em-A2 (7.3) | Em-A (14) | Em-A2 (7.3) |
| Coated silver amount ($g/m^2$) | | 1.11 | 1.11 | 1.30 | 1.30 | 1.75 | 1.75 |
| Total silver amount in the high-speed emulsion layers ($g/m^2$) | | 2.61 | 2.61 | 3.20 | 3.20 | 4.25 | 4.25 |
| Total silver amount in the light sensitive material ($g/m^2$) | | 7.36 | 7.36 | 7.95 | 7.95 | 9.00 | 9.00 |
| Sensitivity | | 800 | 635 | 857 | 713 | 828 | 764 |
| Sensitivity after the storage | | 782 | 621 | 814 | 670 | 729 | 672 |
| Difference of fog values between before and after the storage (Δfog) | B | 0.03 | 0.03 | 0.04 | 0.04 | 0.05 | 0.05 |
| | G | 0.02 | 0.02 | 0.03 | 0.04 | 0.05 | 0.06 |
| | R | 0.01 | 0.01 | 0.02 | 0.03 | 0.04 | 0.05 |
| RMS | B | 0.052 | 0.052 | 0.050 | 0.050 | 0.049 | 0.049 |
| | G | 0.036 | 0.038 | 0.034 | 0.037 | 0.034 | 0.037 |
| | R | 0.028 | 0.030 | 0.026 | 0.028 | 0.026 | 0.028 |
| RMS after the storage | B | 0.055 | 0.055 | 0.057 | 0.057 | 0.060 | 0.060 |
| | G | 0.039 | 0.041 | 0.040 | 0.044 | 0.047 | 0.050 |
| | R | 0.034 | 0.036 | 0.038 | 0.041 | 0.044 | 0.046 |

As set forth in Table 7, Samples 001 and 202 of the invention using emulsions Em-A and Em-E using a high aspect ratio emulsion containing the silver amounts within the scope of the invention showed preferable results in sensitivity, RMS, sensitivity after storage and Δfog.

Comparing with the samples, Samples 221 and 222 using emulsions Em-A2 and Em-E2 whose aspect ratio is low, showed lower sensitivity, lower sensitivity after storage, and inferior RMS.

Sample 223 using emulsions of a low aspect ratio and containing increased coating amounts of silver to a level outside the scope of the invention, showed sensitivity closer to samples of the invention, but, especially, sensitivity after storage is still low, fog increase due to storage, Δfog, is large and graininess after storage remarkably deteriorated.

Sample 203 whose silver coating amount is outside the scope of the invention showed low sensitivity after storage, large fog increase due to storage, Δfog, and considerable deterioration of graininess after storage, and thus, inferior to Samples of the invention, even if Sample 203 uses a high-aspect ratio emulsion.

Among Samples 001 and 202, Sample 001 having the silver coating amount of 1.2 $g/m^2$ or less in each of the high-speed layers and the total silver coating amount in the high-speed layers of 2.61 $g/m^2$ is especially preferable to Sample 202 having the total silver coating amounts in the high-speed layers of 3.20 $g/m^2$, because Sample 001 has smaller change of sensitivity due to storage, smaller fog increase, Δfog, due to storage, smaller deterioration of RNS due to storage, and smaller RMS after storage.

Example 3

Preparation of Sample 441 (Present Invention)

Sample 441 was prepared by changing preparation method of Sample 001 as follows.

That is, Sample 441 was prepared in the same manner as Sample 001, except that Em-A and Em-E used in Sample 001 were replaced with Em-A5 and Em-E5, respectively. The preparation methods are set fort below.

(Preparation of Em-A5)

Em-A5 was prepared in the same manner as Em-A, except that the addition amount of N,N-dimethylselenourea was changed to $0.800\times10^{-6}$ mol per mole of silver and the addition amounts of other compounds were appropriately changed so as to attain optimum chemical sensitization.

In this connection, in the case where the addition amount of N,N-dimethylselenourea was changed to $6.0\times10^{-6}$ mole per mol of silver and the addition amounts of other compounds were appropriately changed, either high fog or soft gradation was merely attained.

(Preparation of Em-E5)

Em-E5 was prepared in the same manner as Em-E, except that the addition amount of N,N-dimethylselenourea was changed to $0.80\times10^{-6}$ mol per mole of silver and the addition amounts of other compounds were appropriately changed so as to attain optimum chemical sensitization.

In this connection, in the case where the addition amount of N,N-dimethylselenourea was changed to $6.0\times10^{-6}$ mole per mol of silver and the addition amounts of other compounds were appropriately changed, either high fog or soft gradation was merely attained.

Preparation of Samples 202, 203, 442 and 443

Samples 202 and 203, and Samples 442 and 443 were prepared by changing the coating amounts of silver in the 6th layer (high-speed red sensitive emulsion layer) and the 11th layer (high-speed green sensitive emulsion layer) in Samples 001 and 441, respectively, as set forth in Table 8. The same evaluations as in Example 1 were made. The results are set forth in Table 8.

TABLE 8

| Remarks | | Invention | Invention | Invention | Invention | Comparison | Comparison |
|---|---|---|---|---|---|---|---|
| Sample | | 001 | 441 | 202 | 442 | 203 | 443 |
| Coated silver amount of high-speed blue sensitive emulsion layer ($g/m^2$) | | 0.71 | 0.71 | 0.90 | 0.90 | 1.10 | 1.10 |
| Emulsion of high-speed green sensitive emulsion layer | | Em-E | Em-E5 | Em-E | Em-E5 | Em-E | Em-E5 |
| Se-sensitizer/silver ($\times 10^{-6}$) | | 3.4 | 0.8 | 3.4 | 0.8 | 3.4 | 0.8 |
| Coated silver amount ($g/m^2$) | | 0.79 | 0.79 | 1.00 | 1.00 | 1.40 | 1.40 |
| Emulsion of high-speed red sensitive emulsion layer | | Em-A | Em-A4 | Em-A | Em-A4 | Em-A | Em-A4 |
| Se-sensitizer/silver ($\times 10^{-6}$) | | 3.4 | 0.8 | 3.4 | 0.8 | 3.4 | 0.8 |
| Coated silver amount ($g/m^2$) | | 1.11 | 1.11 | 1.30 | 1.30 | 1.75 | 1.75 |
| Total silver amount in the high-speed emulsion layers ($g/m^2$) | | 2.61 | 2.61 | 3.20 | 3.20 | 4.25 | 4.25 |
| Total silver amount in the light sensitive material ($g/m^2$) | | 7.36 | 7.36 | 7.95 | 7.95 | 9.00 | 9.00 |
| Sensitivity | | 800 | 713 | 857 | 764 | 828 | 800 |
| Sensitivity after the storage | | 782 | 703 | 814 | 740 | 729 | 696 |
| Difference of fog values | B | 0.03 | 0.03 | 0.04 | 0.04 | 0.05 | 0.05 |
| between before and after | G | 0.02 | 0.015 | 0.03 | 0.025 | 0.05 | 0.04 |
| the storage (Δfog) | R | 0.01 | 0.01 | 0.02 | 0.015 | 0.04 | 0.03 |
| RMS | B | 0.052 | 0.052 | 0.050 | 0.050 | 0.049 | 0.049 |
| | G | 0.036 | 0.035 | 0.034 | 0.034 | 0.034 | 0.034 |
| | R | 0.028 | 0.027 | 0.026 | 0.026 | 0.026 | 0.026 |
| RMS after the storage | B | 0.055 | 0.055 | 0.057 | 0.057 | 0.060 | 0.060 |
| | G | 0.039 | 0.037 | 0.040 | 0.039 | 0.047 | 0.045 |
| | R | 0.034 | 0.033 | 0.038 | 0.037 | 0.044 | 0.043 |

Samples 001 and 202 of the invention containing Em-A and Em-E, which were selenium sensitized so that the amount of the sensitizer becomes $3.4\times10^{-6}$ mol/mol of silver and having the silver amounts within the scope of the invention, showed preferable results in sensitivity, RMS, sensitivity after storage, and Δfog.

On the contrary, Samples 441 and 442, containing Em-A5 and Em-E5, which were selenium sensitized so that the amount of the sensitizer becomes $0.8\times10^{-6}$ mol/mol of silver, attained the advantages of the invention, showing not so large sensitivity decrease due to storage, preferably small increase of fog, Δfog, due to storage, and small values of both RMS and RMS after storage, although sensitivity thereof was a little low. Samples using the emulsion that is selenium sensitized so that the selenium sensitizer becomes $3.4\times10^{-6}$ mol/mol of silver showed more preferable results, in view of higher sensitivity.

Sample 443, using the selenium sensitized emulsion so that the selenium sensitizer becomes $0.8\times10^{-6}$ mol/mol of silver, but the coating amounts of silver are increased to a level outside the scope of the invention, showed especially low sensitivity after storage, large increase of fog, Δfog, due to storage, and remarkably deteriorated graininess after storage, although sensitivity thereof was close to that of the invention.

Example 4

Preparation of Sample 551 (Present Invention)

Sample 551 was prepared by changing the preparation method of Sample 001, as set forth below.

That is, compounds Cpd-7 and Cpd-8 added to 3rd layer, 4th layer and 5th layer of Sample 001 are bleach accelerator-releasing compound upon reaction with an aromatic primary amine-type color developing agent in an oxidized form. Sample 551 was prepared in the same manner as for sample 001, except that by all of the compounds Cpd-7 and Cpd-8 were replaced with a compound that exhibits similar color, but does not release bleach accelerator in an equal weight.

<Preparation of Samples 202, 203, 552 and 553>

Samples 202 and 203, and Samples 552 and 553 were prepared in the same manner as for Sample 001 and 551, respectively, except that the silver amounts of 6th layer (high-speed red sensitive emulsion layer) and 11th layer (high-speed green sensitive emulsion layer) were changed as set forth in Table 9. The same evaluations as in Example 2 were conducted.

TABLE 9

| Remarks | Invention | Invention | Invention | Invention | Comparison | Comparison |
|---|---|---|---|---|---|---|
| Sample | 001 | 551 | 202 | 552 | 203 | 553 |
| Coated silver amount of high-speed blue sensitive emulsion layer ($g/m^2$) | 0.71 | 0.71 | 0.90 | 0.90 | 1.10 | 1.10 |
| Emulsion of high-speed green sensitive emulsion layer | Em-E | Em-E | Em-E | Em-E | Em-E | Em-E |
| Coated silver amount ($g/m^2$) | 0.79 | 0.79 | 1.00 | 1.00 | 1.40 | 1.40 |
| Emulsion of high-speed red sensitive emulsion layer | Em-A | Em-A | Em-A | Em-A | Em-A | Em-A |
| Coated silver amount ($g/m^2$) | 1.11 | 1.11 | 1.30 | 1.30 | 1.75 | 1.75 |
| Bleach-accelerating agent-releasing compound | Present | Absent | Present | Absent | Present | Absent |
| Total silver amount in the high-speed | 2.61 | 2.61 | 3.20 | 3.20 | 4.25 | 4.25 |

TABLE 9-continued

| Remarks | | Invention | Invention | Invention | Invention | Comparison | Comparison |
|---|---|---|---|---|---|---|---|
| emulsion layers ($g/m^2$) | | | | | | | |
| Total silver amount in the light sensitive material ($g/m^2$) | | 7.36 | 7.36 | 7.95 | 7.95 | 9.00 | 9.00 |
| Sensitivity | | 800 | 800 | 857 | 857 | 828 | 828 |
| Sensitivity after the storage | | 782 | 782 | 814 | 814 | 729 | 738 |
| Difference of fog values | B | 0.03 | 0.03 | 0.04 | 0.04 | 0.05 | 0.05 |
| between before and after | G | 0.02 | 0.02 | 0.03 | 0.03 | 0.05 | 0.05 |
| the storage (Δfog) | R | 0.01 | 0.01 | 0.02 | 0.02 | 0.04 | 0.03 |
| RMS | B | 0.052 | 0.052 | 0.050 | 0.050 | 0.049 | 0.049 |
| | G | 0.036 | 0.036 | 0.034 | 0.034 | 0.034 | 0.034 |
| | R | 0.028 | 0.030 | 0.026 | 0.028 | 0.026 | 0.028 |
| RMS after the storage | B | 0.055 | 0.055 | 0.057 | 0.057 | 0.060 | 0.060 |
| | G | 0.039 | 0.039 | 0.040 | 0.040 | 0.047 | 0.047 |
| | R | 0.034 | 0.034 | 0.038 | 0.038 | 0.044 | 0.042 |

The samples of the invention containing a compound capable of releasing bleach accelerator and whose silver amounts are within the scope of the invention showed preferable results in all of sensitivity, RMS, sensitivity after storage, and Δfog.

Comparing with the above samples, Samples 551 and 552, which do not contain a compound capable of releasing a bleach accelerator, attained advantages of the invention, showing sensitivity decrease due to storage which is not so large, small increase of fog, Δfog, due to storage, small values of both RMS and RMS after storage, although RMS value of the red-sensitive emulsion layer was a little large. Thus, samples containing a compound capable of releasing a bleach accelerator are more preferable, in view of smaller RMS value of the red-sensitive layer.

Sample 203, containing a compound capable of releasing a bleach accelerator and whose coating amount of silver is increased to a level outside the scope of the invention, showed larger increase of fog, Δfog, due to storage and deteriorated graininess after storage, compared with Sample 553, which does not contain a compound capable of releasing a bleach accelerator and whose coating amount of silver is increase to a level outside the scope of the invention. That is, in a system containing a compound capable of releasing a bleach accelerator, the advantage attained by decreasing the coating amounts in the high-sensitive layers is especially large.

Example 5

Preparation of Samples 331 and 332 (Present Invention)

Samples 331 and 332 were prepared by changing the preparation method of Sample 001 as set forth below.

Samples 331 and 332 were prepared in the same manner as for Sample 001, except that Em-A and Em-E used therein were replaced with Emulsions Em-A3 and Em-A4, and Emulsions Em-E3 and Em-E4, respectively. The preparation methods of these emulsions are set forth below.

(Preparation of Em-A3 and Em-A4)

Em-A3 was prepared in the same manner as Em-A, except that yellow prussiate of potash was not added, and the addition amounts of other compounds were properly changed so as to attain optimum chemical sensitization. Em-A3 was prepared in the same manner as for the above changes.

Em-A4 was prepared in the same manner as in Em-A, except that $[Ru(bpy)_3]Cl_2$ was used instead of yellow prussiate of potash, the silver potential during the addition thereof was adjusted, and the addition amounts of other compounds were properly changed so as to attain optimum chemical sensitization. Emulsion Em-A4 was thus prepared in the same manner as Em-A, except for the above changes. The volume and aspect ratio of every grain were the same as the grain of Em-A.

(Preparation of Em-E3 and Em-E4)

Em-E3 was prepared in the same manner as the preparation method of Em-E, except that yellow prussiate of potash was not added, and the addition amounts of other compounds were properly changed so as to attain optimum chemical sensitization. Em-E3 was thus prepared in the same manner as for the above changes.

Em-E4 was prepared in the same manner as in Em-E, except that $[Ru(bpy)_3]Cl_2$ was used instead of yellow prussiate of potash, the silver potential during the addition thereof was adjusted, and the addition amounts of other compounds were properly changed so as to attain optimum chemical sensitization. Emulsion Em-E4 was thus prepared in the same manner as Em-E except for the above changes. The volume and aspect ratio of every grain were the same as the grain of Em-A.

Preparation of Samples 202, 203, 333, 334, 335 and 336

Samples 202 and 203, Samples 333 and 334, and Samples 335 and 336 were prepared in the same manner as Samples 001, 331 and 332, respectively, by changing the coating amounts of silver in 6th layer (high-speed red sensitive emulsion layer) and 11th layer (high-speed green sensitive emulsion layer) of Samples 001, 331 and 332 were changed as set forth in Table 10. The same evaluation as in Example 2 was performed. The results set forth in Table 10.

TABLE 10

| Remarks | | Invention | Invention | Invention | Invention | Invention | Invention | Comparison | Comparison | Comparison |
|---|---|---|---|---|---|---|---|---|---|---|
| Sample | | 001 | 331 | 332 | 202 | 333 | 334 | 203 | 335 | 336 |
| Coated silver amount of high-speed blue sensitive emulsion layer ($g/m^2$) | | 0.71 | 0.71 | 0.71 | 0.90 | 0.90 | 0.90 | 1.10 | 1.10 | 1.10 |
| Emulsion of high-speed green sensitive emulsion layer | | Em-E | Em-E3 | Em-E4 | Em-E | Em-E3 | Em-E4 | Em-E | Em-E3 | Em-E4 |
| Electron-friggering center | | Yellow prussiate | Absent | *1 | Yellow prussiate | Absent | *1 | Yellow prussiate | Absent | *1 |
| Coated silver amount ($g/m^2$) | | 0.79 | 0.79 | 0.79 | 1.00 | 1.00 | 1.00 | 1.40 | 1.40 | 1.40 |
| Emulsion of high-speed red sensitive emulsion layer | | Em-A | Em-A3 | Em-A4 | Em-A | Em-A3 | Em-A4 | Em-A | Em-A3 | Em-A4 |
| Electron-friggering center | | Yellow prussiate | Absent | *1 | Yellow prussiate | Absent | *1 | Yellow prussiate | Absent | *1 |
| Coated silver amount ($g/m^2$) | | 1.11 | 1.11 | 1.11 | 1.30 | 1.30 | 1.30 | 1.75 | 1.75 | 1.75 |
| Total silver amount in the high-speed emulsion layers ($g/m^2$) | | 2.61 | 2.61 | 2.6 | 3.20 | 3.20 | 3.20 | 4.25 | 4.25 | 4.25 |
| Total silver amount in the light sensitive material ($g/m^2$) | | 7.36 | 7.36 | 7.36 | 7.95 | 7.95 | 7.95 | 9.00 | 9.00 | 9.00 |
| Sensitivity | | 800 | 755 | 781 | 857 | 809 | 836 | 828 | 781 | 808 |
| Sensitivity after the storage | | 782 | 742 | 766 | 814 | 780 | 802 | 729 | 695 | 711 |
| Difference of fog values between before and after the storage (Δfog) | B | 0.03 | 0.03 | 0.03 | 0.04 | 0.04 | 0.04 | 0.05 | 0.05 | 0.05 |
| | G | 0.02 | 0.02 | 0.02 | 0.03 | 0.025 | 0.03 | 0.05 | 0.04 | 0.05 |
| | R | 0.01 | 0.01 | 0.01 | 0.02 | 0.02 | 0.02 | 0.04 | 0.03 | 0.04 |
| RMS | B | 0.052 | 0.052 | 0.052 | 0.050 | 0.050 | 0.050 | 0.049 | 0.049 | 0.049 |
| | G | 0.036 | 0.037 | 0.037 | 0.034 | 0.035 | 0.034 | 0.034 | 0.035 | 0.034 |
| | R | 0.028 | 0.029 | 0.028 | 0.026 | 0.027 | 0.026 | 0.026 | 0.027 | 0.026 |
| RMS after the storage | B | 0.055 | 0.055 | 0.055 | 0.057 | 0.057 | 0.057 | 0.060 | 0.060 | 0.060 |
| | G | 0.039 | 0.039 | 0.039 | 0.040 | 0.039 | 0.040 | 0.047 | 0.048 | 0.047 |
| | R | 0.034 | 0.034 | 0.034 | 0.038 | 0.034 | 0.037 | 0.044 | 0.045 | 0.044 |

*1 ... $[Ru(bpy)_3]Cl_2$

Samples 001 and 202 of the invention using a high aspect ratio emulsion Em-A and Em-E, provided with an electron-capturing zone in which yellow prussiate of potash was used as an electron-capturing center, and whose silver amounts are within the scope of the invention, showed high sensitivity, high sensitivity after storage, small increase of fog, Δfog, due to storage, small values of both RMS and RMS after storage.

Samples 331 and 333, using Em-A3 and Em-E3 that are not provided with an electron-capturing zone by the use of yellow prussiate of potash, attained the advantages of the invention, showing preferable decrease of sensitivity due to storage, which is not so large, small increase of fog, Δfog, due to storage, small values of both RMS and RMS after storage, although sensitivity was a little small. Samples using emulsions provided with the electron capturing zone by the use of yellow prussiate of potash showed better results, in view of higher sensitivity.

Sample 335 using the emulsion not provided with the electron-capturing zone by the use of yellow prussiate of potash and whose coating amounts of silver were increased to a level outside the scope of the invention, showed obviously low sensitivity after storage, large increase of fog, Δfog, due to storage, considerable deterioration of RMS after storage, although sensitivity thereof was close to that of Sample 001.

Samples 332 and 334, which are within the scope of the invention, using emulsions each provided with the electron-capturing zone by the use of $[Ru(bpy)_3]Cl_2$ as the electron-capturing center instead of yellow prussiate of potash were preferable, showing close results to those of Samples 001 and 202. However, Sample 336 whose coating amounts of silver were increased to a level outside the scope of the invention, was inferior to samples of the invention, showing especially low sensitivity after storage, large increase of fog, Δfog, due to storage, considerable deterioration of RMS after storage, in the same manner as Sample 203.

Example 6

Excellent results of the advantages of the invention will be set forth using the above samples of the invention in a form of a photographic material built-in product to which exposure mechanism is provided.

That is, the samples of the invention were loaded into "UTSURUNDESU SUPER 800 27-SHOT" (whose trade name in the U.S. is Quick Snap Super Flash 27) of Fuji Photo Film Co., Ltd. after the samples were processed into a product for a patrone of 35-mm for 24-exposure film. The samples of the invention were also loaded into "UTSURUNDESU SUPERSLIM STAR 25 SHOT" of Fuji Photo Film Co., Ltd. after the samples were processed into a product for a cartridge of APS for 25-exposure film.

As a result of the storage test of the samples in the above form, samples of the invention showed excellent results as in the above Example, compared to samples for comparison.

The samples of the invention and for comparison were loaded into "UTSURUNDESU SUPER 800 27-SHOT" after the samples were processed into the products for such form, and were compared by passing the samples through luggage inspection using X-ray in Narita Airport. The samples of the invention showed especially superior results to the samples for comparison.

The reason why the samples of the invention showed especially superior results is that the samples received stronger influence of X-ray than in a usual form where the samples are loaded into a patrone made of metal, because the patrone for the form of "UTSURUNDESU SUPER 800 27-SHOT" is made of synthetic resin.

As demonstrated above, the photographic material of the invention exhibit especially excellent results in a photographic material built-in photographic product to which exposure mechanism is provided. Additional advantages and modifications will readily occur to those skilled in the art.

Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color negative photographic lightsensitive material comprising at least one red-sensitive silver halide emulsion layer, at least one green-sensitive silver halide emulsion layer and at least one blue-sensitive silver halide emulsion layer on a support, wherein the lightsensitive material has an ISO speed of 640 or more;

the lightsensitive material has the total silver content of 3.0 to 9.0 g/m$^2$;

each of the red-sensitive emulsion layer, green-sensitive emulsion layer and blue-sensitive emulsion layer comprises two or more silver halide emulsion sub-layers having the same color sensitivity but different in speed to each other;

each of the red-sensitive sub-layer having the highest speed, green-sensitive sub-layer having the highest speed and blue-sensitive emulsion sub-layer having the highest speed has a silver content of 0.3 to 1.3 g/m$^2$;

at least two sub-layers selected from the red-sensitive sub-layer having the highest sensitivity, green-sensitive sub-layer having the highest sensitivity and blue-sensitive sub-layer having the highest sensitivity contain silver halide grains in which tabular silver halide grains occupy 50% or more of the total projected area of all the silver halide grains in the sub-layer; and the tabular grains have an average aspect ratio of 8 or more, wherein at least one of the emulsion sub-layers contains a compound capable of releasing a bleach accelerator through a reaction with an aromatic primary amine color developing agent in an oxidized form.

2. The lightsensitive material according to claim 1, wherein each of the red-sensitive sub-layer having the highest speed, green-sensitive sub-layer having the highest speed and blue-sensitive sub-layer having the highest speed has a silver content of 0.3 to 1.2 g/m$^2$.

3. The lightsensitive material according to claim 1, wherein at least one of the sub-layers having the highest speed in which tabular grains occupy 50% or more of the total projected area, contains a selenium sensitizer in an mount of $2\times10^{-6}$ to $5\times10^{-6}$ mol per mol of the silver in the emulsion sub-layer.

4. The lightsensitive material according to claim 3, wherein at least one of emulsions containing the silver halide tabular grains whose average aspect ratio is 8 or more contained in the at least two of the emulsion sub-layers each having the highest sensitivity, contains tabular grains each having an electron-trapping zone.

5. The lightsensitive material according to claim 1, wherein at least one of emulsions containing the silver halide tabular grains whose average aspect ratio is 8 or more contained in the at least two of the emulsion sub-layers each having the highest sensitivity, contains tabular grains each having an electron-trapping zone.

6. A lightsensitive material-built-in photographic product with which an exposure mechanism is provided, wherein the built-in light sensitive material is the light sensitive material according to claim 1.

7. A silver halide color negative photographic lightsentive material comprising at least one red-sensitive silver halide emulsion layer, at least one green-sensitive silver halide emulsion layer and at least one blue-sensitive silver halide emulsion layer on a support, wherein the lightsensitive material has an ISO speed of 640 or more;

the lightsensitive material has the total silver content of 3.0 to 9.0 g/m$^2$;

each of the red-sensitive emulsion layer, green-sensitive emulsion layer and blue-sensitive emulsion layer comprises two or more silver halide emulsion sub-layers having the same color sensitivity but different in speed to each other;

the sum of a silver content in the red-sensitive sub-layer having the highest speed, green-sensitive sub-layer having the highest speed and blue-sensitive sub-layer having the highest speed is 1.5 to 3.5 g/m$^2$;

at least two sub-layers selected from the red-sensitive sub-layer having the highest sensitivity, green-sensitive sub-layer having the highest sensitivity and blue-sensitive sub-layer having the highest speed contain silver halide grains in which tabular silver halide grains occupy 50% or more of the total projected area of all the silver halide grains in the sub-layer; and the tabular grains have an average aspect ratio of 8 or more, wherein at least one of the emulsion sub-layers contains a compound capable of releasing a bleach accelerator through a reaction with an aromatic primary amine color developing agent in an oxidized form.

8. The lightsensitive material according to claim 7, wherein the sum of a silver content in the red-sensitive emulsion sub-layer, green-sensitive emulsion sub-layer and blue-sensitive emulsion sub-layer each having the highest speed is 1.5 to 3.0 g/m$^2$.

9. The lightsensitive material according to claim 7, wherein at least one of the emulsion sub-layers comprising tabular grains in an amount of 50% or more of the total projected area contains a selenium sensitizer in an mount of $2\times10^{-6}$ to $5\times10^{-6}$ mol per mol of the silver in the emulsion sub-layer.

10. The lightsensitive material according to claim 9, wherein at least one of emulsions containing the silver halide tabular grains whose average aspect ratio is 8 or more contained in the at least two of the emulsion sub-layers each having the highest sensitivity, contains tabular grains each having an electron-trapping zone.

11. The lightsensitive material according to claim 7, wherein at least one of emulsions containing the silver halide tabular grains whose average aspect ratio is 8 or more contained in the at least two of the emulsion sub-layers each having the highest sensitivity, contains tabular grains each having an electron-trapping zone.

12. A lightsensitive material-built-in photographic product with which an exposure mechanism is provided, wherein the built-in light sensitive material is the light sensitive material according to claim 7.

* * * * *